US010540931B2

(12) United States Patent
Sako

(10) Patent No.: US 10,540,931 B2
(45) Date of Patent: Jan. 21, 2020

(54) DISPLAY APPARATUS WITH REDUCED AMOUNT OF CALCULATION

(71) Applicant: Japan Display Inc., Tokyo (JP)

(72) Inventor: Kazuhiko Sako, Tokyo (JP)

(73) Assignee: Japan Display Inc., Tokyo (JP)

( * ) Notice: Subject to any disclaimer, the term of this patent is extended or adjusted under 35 U.S.C. 154(b) by 98 days.

(21) Appl. No.: 15/720,328

(22) Filed: Sep. 29, 2017

(65) Prior Publication Data

US 2018/0096658 A1 Apr. 5, 2018

(30) Foreign Application Priority Data

Oct. 4, 2016 (JP) ..... 2016-196646

(51) Int. Cl.
*G09G 3/34* (2006.01)
*G09G 3/20* (2006.01)

(52) U.S. Cl.
CPC ..... *G09G 3/3426* (2013.01); *G09G 3/2003* (2013.01); *G09G 3/3413* (2013.01); *G09G 2320/0626* (2013.01); *G09G 2360/16* (2013.01)

(58) Field of Classification Search
CPC .. G09G 3/3413; G09G 3/3426; G09G 3/2003; G09G 2320/0646; G09G 2330/021; G09G 2380/10; G09G 2360/16; G09G 2320/0626
See application file for complete search history.

(56) References Cited

U.S. PATENT DOCUMENTS

2015/0109352 A1* 4/2015 Takasaki ..... G09G 3/3406 345/690
2015/0317934 A1 11/2015 Takasaki et al.
2016/0293087 A1 10/2016 Sako et al.

FOREIGN PATENT DOCUMENTS

JP 2013-246426 A 12/2013
JP 2015-210461 A 11/2015
JP 2016-188883 A 11/2016
JP 2016-224398 A 12/2016

* cited by examiner

*Primary Examiner* — Yaron Cohen
(74) *Attorney, Agent, or Firm* — K&L Gates LLP

(57) ABSTRACT

According to an aspect, a display apparatus includes a segment necessary luminance calculator, a segment necessary luminance corrector, and a light emission amount calculator. The segment necessary luminance calculator creates segment necessary luminance data indicating the luminance necessary for each of light-emitting segments in accordance with image data. The segment necessary luminance corrector corrects the segment necessary luminance data for each of light-emitting blocks according to the highest luminance of one or a plurality of light-emitting segments included in each light-emitting block, in accordance with control data for dividing a light-emitting region and a display region into a plurality of blocks and the segment necessary luminance data. The light emission amount calculator calculates the amount of light emission from the light-emitting segments in accordance with the segment necessary luminance data corrected by the segment necessary luminance corrector and outputs a light emission amount control signal to the light emitter.

17 Claims, 30 Drawing Sheets

| | 0 | 1 | 2 | 3 | 4 | 5 | 6 | 7 | 8 | 9 |
|---|---|---|---|---|---|---|---|---|---|---|
| 0 | 0% | 0% | 0% | 0% | 0% | 0% | 0% | 0% | 0% | 0% |
| 1 | 0% | 50% | 50% | 50% | 0% | 90% | 50% | 50% | 50% | 90% |
| 2 | 0% | 50% | 0% | 50% | 80% | 80% | 50% | 0% | 50% | 90% |
| 3 | 0% | 100% | 100% | 50% | 80% | 80% | 50% | 100% | 50% | 50% |
| 4 | 0% | 50% | 100% | 50% | 70% | 70% | 50% | 100% | 100% | 90% |
| 5 | 0% | 50% | 0% | 50% | 70% | 70% | 50% | 0% | 100% | 90% |
| 6 | 0% | 50% | 50% | 50% | 0% | 0% | 50% | 50% | 50% | 50% |
| 7 | 80% | 90% | 0% | 0% | 0% | 0% | 0% | 0% | 0% | 0% |

cont_h

| | x | | | | | | | | |
|---|---|---|---|---|---|---|---|---|---|
| | 0 | 1 | 2 | 3 | 4 | 5 | 6 | 7 | 8 |
| y 0 | 1 | 1 | 1 | 0 | 1 | 0 | 1 | 1 | 1 |
| 1 | 0 | 1 | 1 | 0 | 1 | 0 | 1 | 1 | 0 |
| 2 | 0 | 1 | 1 | 0 | 1 | 0 | 1 | 1 | 0 |
| 3 | 0 | 1 | 1 | 0 | 1 | 0 | 1 | 1 | 0 |
| 4 | 0 | 1 | 1 | 0 | 1 | 0 | 1 | 1 | 0 |
| 5 | 0 | 1 | 1 | 0 | 1 | 0 | 1 | 1 | 0 |
| 6 | 0 | 1 | 1 | 0 | 1 | 0 | 1 | 1 | 0 |
| 7 | 1 | 1 | 1 | 0 | 1 | 0 | 1 | 1 | 1 |

$1/\alpha$

| | 0 | 1 | 2 | 3 | 4 | 5 | 6 | 7 | 8 | 9 |
|---|---|---|---|---|---|---|---|---|---|---|
| 0 | 0% | 0% | 0% | 0% | 0% | 0% | 0% | 0% | 0% | 0% |
| 1 | 0% | 50% | 50% | 50% | 0% | 90% | 50% | 50% | 50% | 90% |
| 2 | 0% | 50% | 0% | 50% | 80% | 80% | 50% | 0% | 50% | 90% |
| 3 | 0% | 100% | 100% | 50% | 80% | 80% | 50% | 100% | 50% | 50% |
| 4 | 0% | 50% | 100% | 50% | 70% | 70% | 50% | 100% | 100% | 90% |
| 5 | 0% | 50% | 0% | 50% | 70% | 70% | 50% | 0% | 100% | 90% |
| 6 | 0% | 50% | 50% | 50% | 0% | 0% | 50% | 50% | 50% | 50% |
| 7 | 80% | 90% | 0% | 0% | 0% | 0% | 0% | 0% | 0% | 0% |

FIG.22

1/α

| | 0 | 1 | 2 | 3 | 4 | 5 | 6 | 7 | 8 | 9 |
|---|---|---|---|---|---|---|---|---|---|---|
| 0 | 0% | 0% | 0% | 0% | 0% | 0% | 0% | 0% | 0% | 0% |
| 1 | 0% | 50% | 50% | 50% | 90% | 90% | 50% | 50% | 50% | 90% |
| 2 | 0% | 50% | 50% | 50% | 80% | 80% | 50% | 50% | 50% | 90% |
| 3 | 0% | 100% | 100% | 100% | 80% | 80% | 100% | 100% | 100% | 50% |
| 4 | 0% | 100% | 100% | 100% | 70% | 70% | 100% | 100% | 100% | 90% |
| 5 | 0% | 50% | 50% | 50% | 70% | 70% | 100% | 100% | 100% | 90% |
| 6 | 0% | 50% | 50% | 50% | 0% | 0% | 50% | 50% | 50% | 50% |
| 7 | 90% | 90% | 90% | 90% | 0% | 0% | 0% | 0% | 0% | 0% |

X

Y

1/α

| | 0 | 1 | 2 | 3 | 4 | 5 | 6 | 7 | 8 | 9 |
|---|---|---|---|---|---|---|---|---|---|---|
| 0 | 0% | 0% | 0% | 0% | 90% | 90% | 0% | 0% | 0% | 0% |
| 1 | 0% | 100% | 100% | 100% | 90% | 90% | 100% | 100% | 100% | 90% |
| 2 | 0% | 100% | 100% | 100% | 80% | 80% | 100% | 100% | 100% | 90% |
| 3 | 0% | 100% | 100% | 100% | 80% | 80% | 100% | 100% | 100% | 90% |
| 4 | 0% | 100% | 100% | 100% | 70% | 70% | 100% | 100% | 100% | 90% |
| 5 | 0% | 100% | 100% | 100% | 70% | 70% | 100% | 100% | 100% | 90% |
| 6 | 0% | 100% | 100% | 100% | 0% | 0% | 100% | 100% | 100% | 90% |
| 7 | 90% | 90% | 90% | 90% | 0% | 0% | 0% | 0% | 0% | 0% |

$1/\alpha max$

| | 0 | 1 | 2 | 3 | 4 | 5 | 6 | 7 | 8 | 9 |
|---|---|---|---|---|---|---|---|---|---|---|
| 0 | 0% | 0% | 0% | 0% | 0% | 0% | 0% | 0% | 0% | 0% |
| 1 | 0% | 50% | 50% | 50% | 0% | 90% | 50% | 50% | 50% | 90% |
| 2 | 0% | 50% | 0% | 50% | 80% | 80% | 50% | 0% | 50% | 90% |
| 3 | 0% | 100% | 100% | 50% | 80% | 80% | 50% | 100% | 50% | 50% |
| 4 | 0% | 50% | 100% | 50% | 70% | 70% | 50% | 100% | 100% | 90% |
| 5 | 0% | 50% | 0% | 50% | 70% | 70% | 50% | 0% | 100% | 90% |
| 6 | 0% | 50% | 50% | 50% | 0% | 0% | 50% | 50% | 50% | 50% |
| 7 | 80% | 90% | 0% | 0% | 0% | 0% | 0% | 0% | 0% | 0% |

$1/\alpha$ max

| | 0 | 1 | 2 | 3 | 4 | 5 | 6 | 7 | 8 | 9 |
|---|---|---|---|---|---|---|---|---|---|---|
| 0 | 0% | 0% | 0% | 0% | 90% | 90% | 0% | 0% | 0% | 0% |
| 1 | 0% | 100% | 100% | 100% | 90% | 90% | 100% | 100% | 100% | 90% |
| 2 | 0% | 100% | 100% | 100% | 80% | 80% | 100% | 100% | 100% | 90% |
| 3 | 0% | 100% | 100% | 100% | 80% | 80% | 100% | 100% | 100% | 90% |
| 4 | 0% | 100% | 100% | 100% | 70% | 70% | 100% | 100% | 100% | 90% |
| 5 | 0% | 100% | 100% | 100% | 70% | 70% | 100% | 100% | 100% | 90% |
| 6 | 0% | 100% | 100% | 100% | 0% | 0% | 100% | 100% | 100% | 90% |
| 7 | 90% | 90% | 90% | 90% | 0% | 0% | 0% | 0% | 0% | 0% |

$1/\alpha$ max

| | 0 | 1 | 2 | 3 | 4 | 5 | 6 | 7 | 8 | 9 |
|---|---|---|---|---|---|---|---|---|---|---|
| 0 | 0% | 0% | 0% | 0% | 81% | 81% | 0% | 0% | 0% | 0% |
| 1 | 0% | 90% | 90% | 90% | 81% | 81% | 90% | 90% | 90% | 81% |
| 2 | 0% | 90% | 90% | 90% | 72% | 72% | 90% | 90% | 90% | 81% |
| 3 | 0% | 90% | 90% | 90% | 72% | 72% | 90% | 90% | 90% | 81% |
| 4 | 0% | 90% | 90% | 90% | 63% | 63% | 90% | 90% | 90% | 81% |
| 5 | 0% | 90% | 90% | 90% | 63% | 63% | 90% | 90% | 90% | 81% |
| 6 | 0% | 90% | 90% | 90% | 0% | 0% | 90% | 90% | 90% | 81% |
| 7 | 81% | 81% | 81% | 81% | 0% | 0% | 0% | 0% | 0% | 0% |

DISPLAY APPARATUS WITH REDUCED AMOUNT OF CALCULATION

CROSS-REFERENCE TO RELATED APPLICATIONS

This application claims priority from Japanese Application No. 2016-196646, filed on Oct. 4, 2016, the contents of which are incorporated by reference herein in its entirety.

BACKGROUND

1. Technical Field

The present disclosure relates to a display apparatus.

2. Description of the Related Art

Japanese Patent Application Laid-open Publication No. 2013-246426, for example, discloses a display apparatus employing a local dimming method for dividing a light source device, such as a backlight, into a plurality of light-emitting regions and controlling the amount of light emission in each light-emitting region in accordance with a video signal for a display region corresponding to the light-emitting region.

To support users' various utilization forms, the local dimming method needs to divide a light source device into a large number of light-emitting segments and divide a display panel into a large number of display segments. To secure the display quality of an image object extending across a plurality of display segments, the local dimming method needs to perform complicated calculation of luminance distribution at boundaries between the display segments, resulting in increased amount of calculation.

Meanwhile, a display apparatus for limited utilization (e.g., an automobile meter) often displays an object whose size is larger than that of the light-emitting segment and that of the display segment. Such a display apparatus has a few types of layouts, and has a low frequency of display change. Thus, calculation performed in the conventional technologies is considered to be excessive.

For the foregoing reasons, there is a need for a display apparatus that can reduce the amount of calculation.

SUMMARY

According to an aspect, a display apparatus includes: a light emitter having a light-emitting region including a plurality of light-emitting segments, an amount of light emission from which is individually controllable; a display device having a display region including a plurality of display segments corresponding to the respective light-emitting segments; and a processor configured to output, to the light emitter, a light emission amount control signal for controlling the amount of light emission from the light-emitting segments, in accordance with image data supplied from an outside and control data supplied from the outside and used to divide the light-emitting region into a plurality of light-emitting blocks and divide the display region into a plurality of display blocks. The light-emitting blocks each include one or a plurality of the light-emitting segments. The display blocks correspond to the respective light-emitting blocks. The processor includes: a segment necessary luminance calculator configured to create segment necessary luminance data indicating luminance necessary for each of the light-emitting segments in accordance with the image data; a segment necessary luminance corrector configured to correct the segment necessary luminance data for each of the light-emitting blocks according to the highest luminance of one or a plurality of the light-emitting segments included in each of the light-emitting blocks, in accordance with the control data and the segment necessary luminance data; and a light emission amount calculator configured to calculate the amount of light emission from the light-emitting segments in accordance with the segment necessary luminance data corrected by the segment necessary luminance corrector, and output the light emission amount control signal to the light emitter.

According to an aspect, a display apparatus includes: a light emitter having a light-emitting region including a plurality of light-emitting segments, an amount of light emission from which is individually controllable; a display device having a display region including a plurality of display segments corresponding to the respective light-emitting segments; and a processor configured to output, to the light emitter, a light emission amount control signal for controlling the amount of light emission from the light-emitting segments, in accordance with image data supplied from an outside and control data supplied from the outside and used to divide the light-emitting region into a plurality of light-emitting blocks and divide the display region into a plurality of display blocks. The light-emitting blocks each include one or a plurality of the light-emitting segments. The display blocks correspond to the respective light-emitting blocks. The processor is configured to control the amount of light emission individually in units of the light-emitting blocks.

BRIEF DESCRIPTION OF THE DRAWINGS

FIG. 22 is a diagram illustrating the segment necessary luminance data according to the embodiment;

DETAILED DESCRIPTION

Figure 1:
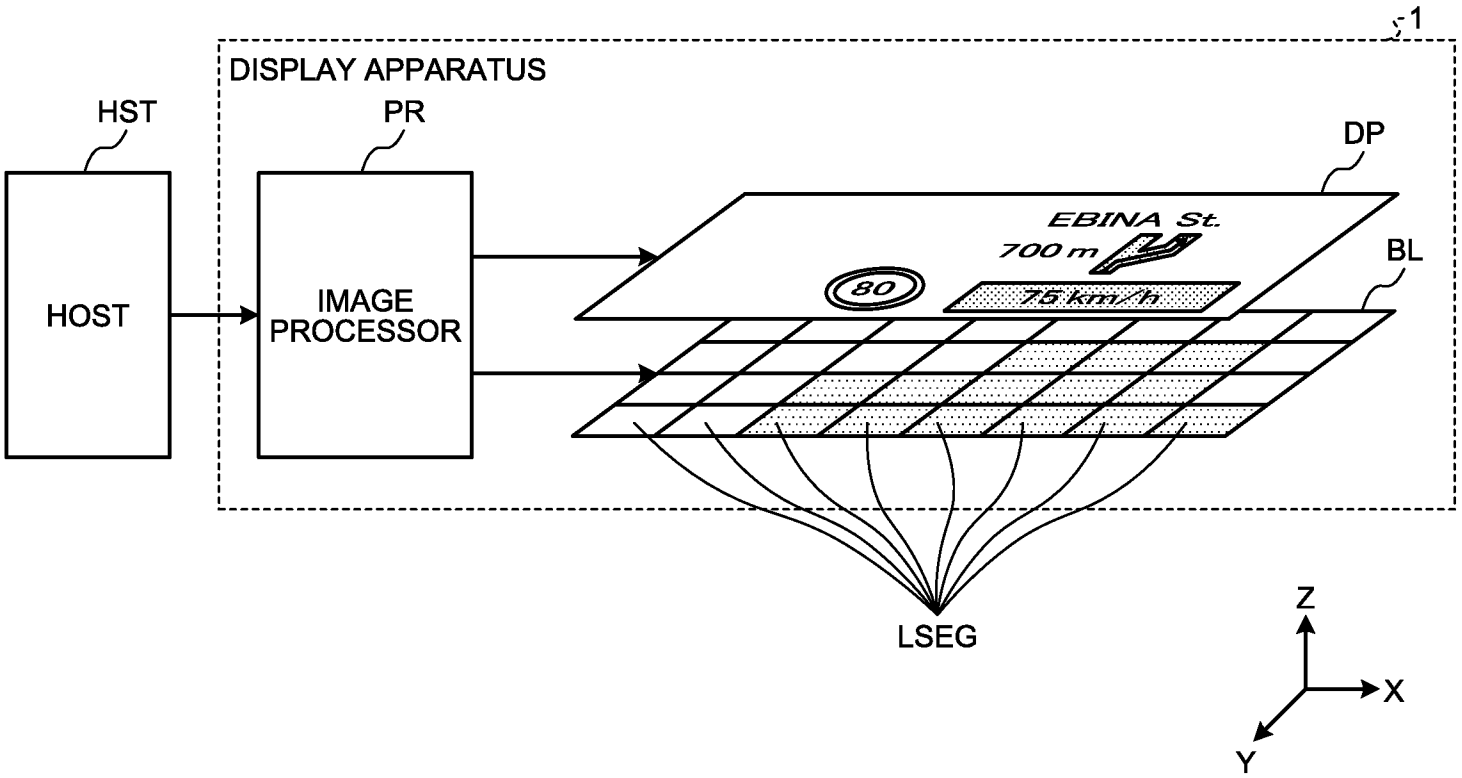
FIG. 1 is a block diagram illustrating a configuration of a display apparatus according to an embodiment of the present disclosure.

Modes (embodiments) for carrying out the present disclosure will be described in detail with reference to the drawings. The disclosure is merely an example, and the present disclosure naturally encompasses appropriate modifications maintaining the gist of the disclosure that is easily conceivable by those skilled in the art. To further clarify the description, a width, a thickness, a shape, and the like of each component may be schematically illustrated in the drawings as compared with an actual aspect. However, this is merely an example and interpretation of the disclosure is not limited thereto. The same elements as those described in the drawings that have already been discussed are denoted by the same reference numerals throughout the description and the drawings, and detailed description thereof will not be repeated in some cases.

Embodiment

Outline of the Configuration

FIG. 1 is a block diagram illustrating a configuration of a display apparatus according to an embodiment of the present disclosure.

A display apparatus 1 according to the present embodiment includes a display device DP, a light emitter BL, and an image processor PR. The display device DP has a main plane extending along an X-Y plane and displays an image in a Z-direction. A transmissive or transflective liquid crystal display apparatus that transmits light to output an image exemplifies the display device DP, but the display device DP is not limited thereto. The display device DP may be a reflective liquid crystal display apparatus or a digital micromirror device (DMD (registered trademark)), for example.

The light emitter BL is positioned in an opposite direction of the Z-direction with respect to the display device DP. The light emitter BL has a main plane extending along the X-Y plane and emits light in the Z-direction. The display device DP uses incident light from the light emitter BL to display an image in the Z-direction.

The light emitter BL includes a plurality of two-dimensionally arrayed light-emitting segments LSEG. Each light-emitting segment LSEG is a unit region in which the amount of light emission can be controlled. The light-emitting segments LSEG each include a plurality of pixels in the display device DP viewed in the Z-direction. In other words, the size of the light-emitting segment LSEG is larger than that of the pixel.

The image processor PR controls the display device DP and the light emitter BL in accordance with image data and control data supplied from a host HST. The host HST is a central processing unit (CPU), for example.

The image processor PR corresponds to a "processor" according to the present disclosure.

Figure 2:
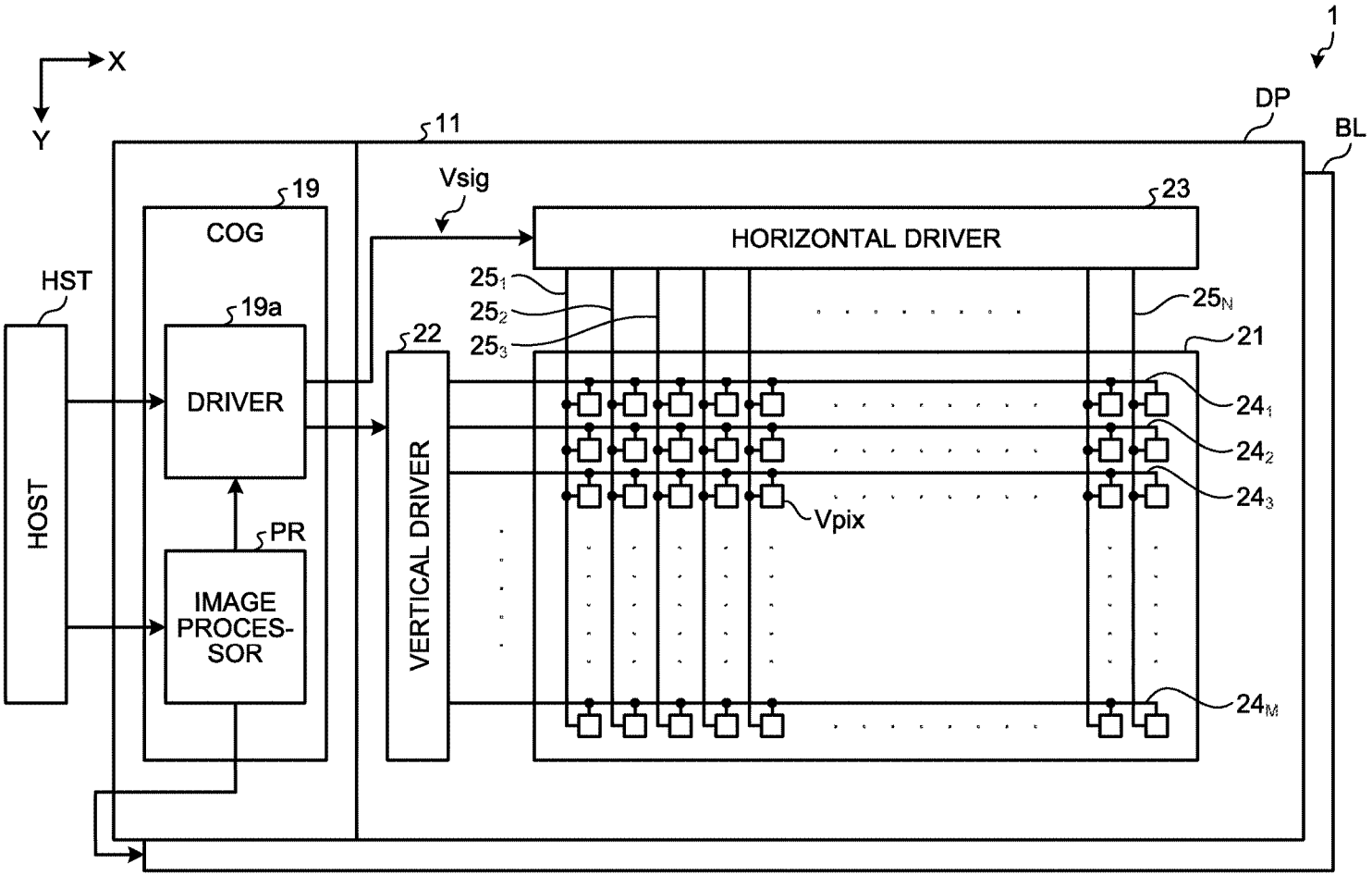
FIG. 2 is a diagram illustrating a module configuration of the display apparatus according to the embodiment.

FIG. 2 is a diagram illustrating a module configuration of the display apparatus according to the embodiment.

The display apparatus 1 includes the display device DP, the light emitter BL, and a chip on glass (COG) 19 serving as a driver integrated circuit (IC). The COG 19 is coupled to the host HST and the light emitter BL via a flexible printed circuit (FPC), which is not illustrated. The COG 19 includes a driver 19*a* and the image processor PR.

The display device DP includes a glass substrate 11, a display region 21, a vertical driver (vertical drive circuit) 22, and a horizontal driver (horizontal drive circuit) 23. The glass substrate 11 is a translucent insulating substrate, for example. The display region 21 is provided on the surface of the glass substrate 11, and a large number of sub-pixels Vpix each including liquid crystal cells are arranged therein in a matrix manner (row-column configuration).

The glass substrate 11 includes a first substrate and a second substrate. In the first substrate, a large number of pixel circuits each including an active element (e.g., a transistor) are arranged in a matrix manner (row-column configuration). The second substrate is arranged to face the first substrate with a predetermined gap interposed therebetween. The first substrate and the second substrate are kept separated from each other at a predetermined gap by photo spacers arranged at various positions on the first substrate. Liquid crystal is sealed between the first substrate and the second substrate. The arrangement and the size of each element in FIG. 2 are schematically illustrated and do not reflect the actual arrangement and the actual size thereof.

The display region 21 has a matrix configuration (row-column configuration) in which M×N sub-pixels Vpix are arranged. In the present specification, a row indicates a pixel row including N sub-pixels Vpix arrayed in one direction. A column indicates a pixel column including M sub-pixels Vpix arrayed in a direction orthogonal to the direction in which the row extends. The values of M and N are determined depending on the display resolution in the vertical direction and that in the horizontal direction, respectively.

The display region 21 has scanning lines $\mathbf{24}_1$, $\mathbf{24}_2$, $\mathbf{24}_3$, . . . , $\mathbf{24}_M$ arranged for respective rows and signal lines $\mathbf{25}_1$, $\mathbf{25}_2$, $\mathbf{25}_3$, . . . , $\mathbf{25}_N$ arranged for respective columns in the array of M×N sub-pixels Vpix. In the description below, the scanning lines $\mathbf{24}_1$, $\mathbf{24}_2$, $\mathbf{24}_3$, . . . , $\mathbf{24}_M$ according to the present embodiment may be collectively referred to as scanning lines 24, and the signal lines $\mathbf{25}_1$, $\mathbf{25}_2$, $\mathbf{25}_3$, . . . , $\mathbf{25}_N$ may be collectively referred to as signal lines 25. Certain three scanning lines out of the scanning lines $\mathbf{24}_1$, $\mathbf{24}_2$, $\mathbf{24}_3$, . . . , $\mathbf{24}_M$ according to the present embodiment are referred to as scanning lines $\mathbf{24}_m$, $\mathbf{24}_{m+1}$, and $\mathbf{24}_{m+2}$ (m is a natural number satisfying m≤M−2). Certain three signal lines out of the signal lines $\mathbf{25}_1$, $\mathbf{25}_2$, $\mathbf{25}_3$, . . . , $\mathbf{25}_N$ are referred to as signal lines $\mathbf{25}_n$, $\mathbf{25}_{n+1}$, and $\mathbf{25}_{2+2}$ (n is a natural number satisfying n≤N−2).

The driver 19*a* receives a master clock signal, a horizontal synchronization signal, and a vertical synchronization signal serving as external signals from the host HST. The driver 19*a* performs level conversion on the master clock signal, the horizontal synchronization signal, and the vertical synchronization signal each having a voltage amplitude of an external power source to have a voltage amplitude of an internal power source required for driving the liquid-crystals. The driver 19*a* thus generates the master clock signal, the horizontal synchronization signal, and the vertical synchronization signal. The driver 19*a* outputs the master clock signal, the horizontal synchronization signal, and the vertical synchronization signal generated in this manner to the vertical driver 22 and the horizontal driver 23. The driver 19*a* generates a common potential (counter electrode potential) to be supplied to drive electrodes for the respective sub-pixels Vpix and outputs the common potential to the display region 21.

The vertical driver 22 latches, for each one horizontal unit, digital data output from the driver 19*a* in synchronization with the vertical synchronization signal and the horizontal synchronization signal. The vertical driver 22 sequentially outputs and supplies the latched digital data of one line as a vertical scanning pulse to the scanning lines $\mathbf{24}_m$, $\mathbf{24}_{m+1}$, $\mathbf{24}_{m+2}$, . . . of the display region 21, thereby sequentially selecting sub-pixels Vpix row by row. The vertical driver 22, for example, outputs the digital data to the scanning lines $\mathbf{24}_m$, $\mathbf{24}_{m+1}$, $\mathbf{24}_{m+2}$, . . . in the order from the upper part of the display region 21, that is, the upper side in the vertical scanning direction to the lower part of the display region 21, that is, the lower side in the vertical scanning direction. Alternatively, the vertical driver 22 may output the digital data to the scanning lines $\mathbf{24}_m$, $\mathbf{24}_{m+1}$, $\mathbf{24}_{m+2}$, . . . in the order from the lower part of the display region 21, that is, the lower side in the vertical scanning direction to the upper part of the display region 21, that is, the upper side in the vertical scanning direction.

The horizontal driver 23 is supplied with 6-bit digital video data Vsig of R (red), G (green), B (blue), and W (white), for example, from the driver 19*a*. The horizontal driver 23 writes display data to the sub-pixels Vpix in the row selected in the vertical scanning performed by the vertical driver 22 in units of a sub-pixel, a plurality of sub-pixels, or all the sub-pixels via the signal lines 25.

In the display apparatus 1, continuous application of a direct current (DC) voltage of the same polarity to the liquid crystal elements may possibly deteriorate resistivity (substance-specific resistance) or the like of the liquid crystal. To prevent deterioration in the resistivity (substance-specific resistance) or the like of the liquid crystal, the display apparatus 1 employs a driving method of reversing the polarity of video signals with a predetermined period based on the common potential of drive signals.

Line inversion, dot inversion, and frame inversion driving methods are known as methods for driving a liquid crystal display apparatus. The line inversion driving method is a driving method of reversing the polarity of video signals with a time period of 1H (H represents a horizontal period) corresponding to one line (one pixel row). The dot inversion driving method is a driving method of alternately reversing the polarity of video signals for pixels vertically and horizontally adjacent to each other. The frame inversion driving method is a driving method of simultaneously reversing the polarity of video signals to be written to all the sub-pixels Vpix for each one frame corresponding to one screen to the same polarity. The display apparatus 1 may employ any one of the driving methods described above.

The image processor PR outputs, to the light emitter BL, a light emission amount control signal for controlling the amount of light emission in accordance with the image data and the control data received from the host HST. The image processor PR adjusts image data in accordance with the image data and the control data received from the host HST and outputs the adjusted image data to the driver 19*a*.

While the image processor PR according to the present embodiment is included in the COG 19, the configuration is not limited thereto. The image processor PR may be mounted on another chip different from the COG 19.

Figure 3:
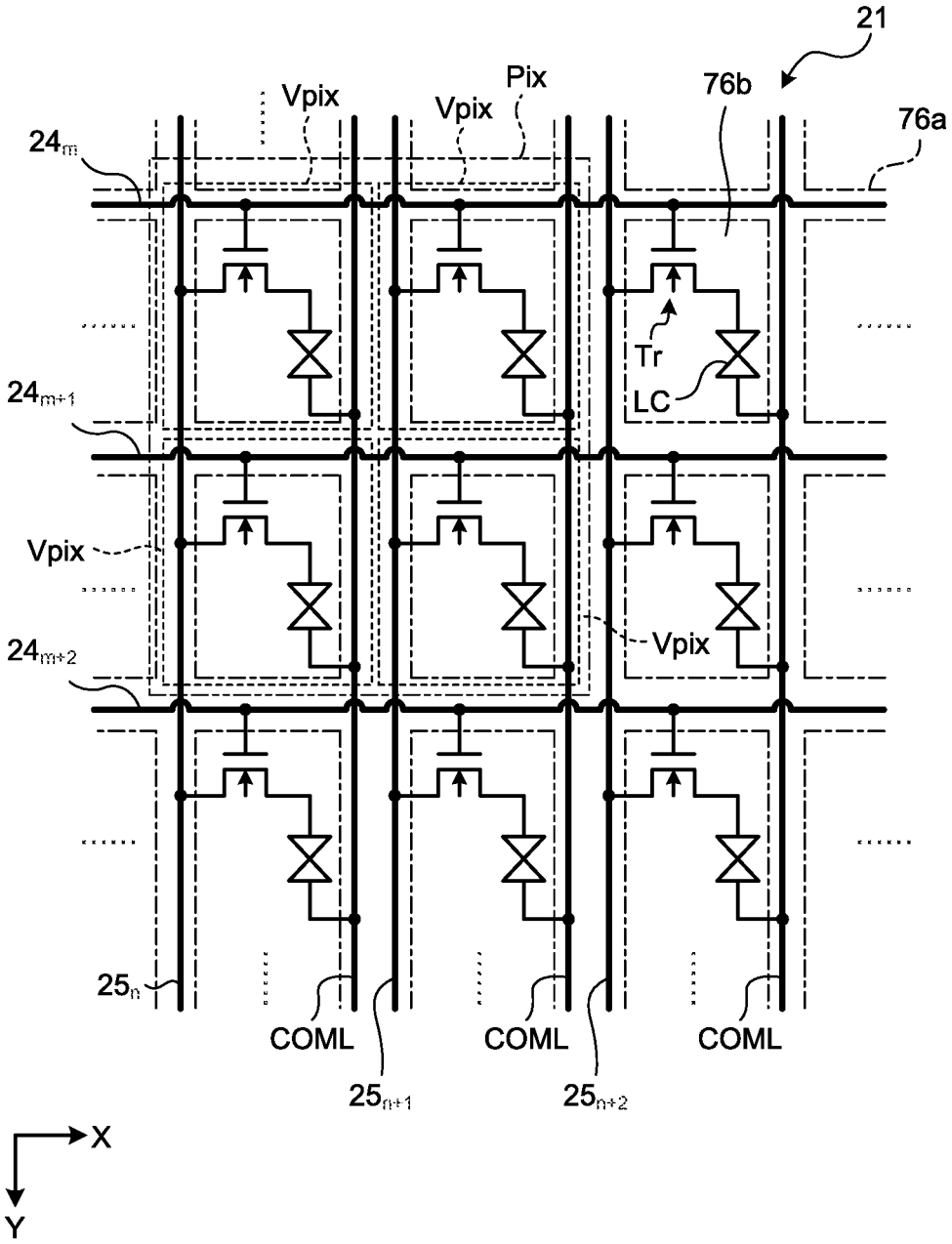
FIG. 3 is a circuit diagram illustrating a drive circuit that drives pixels in a display device of the display apparatus according to the embodiment.

FIG. 3 is a circuit diagram illustrating a drive circuit that drives pixels in the display device of the display apparatus according to the embodiment.

Pixels Pix each include the sub-pixels Vpix. The display region 21 is provided with wiring of the signal lines $\mathbf{25}_n$, $\mathbf{25}_{n+1}$, and $\mathbf{25}_{n+2}$ and the scanning lines $\mathbf{24}_m$, $\mathbf{24}_{m+1}$, and $\mathbf{24}_{m+2}$, for example. The signal lines $\mathbf{25}_n$, $\mathbf{25}_{n+1}$, and $\mathbf{25}_{n+2}$ supply pixel signals serving as display data to thin film transistor (TFT) elements Tr in the respective sub-pixels Vpix. The scanning lines $\mathbf{24}_m$, $\mathbf{24}_{m+1}$, and $\mathbf{24}_{m+2}$ drive the TFT elements Tr. As described above, the signal lines $\mathbf{25}_n$, $\mathbf{25}_{n+1}$, and $\mathbf{25}_{n+2}$ extend on a plane parallel to the surface of the glass substrate 11 and supply the pixel signals for displaying an image to the sub-pixels Vpix.

The sub-pixels Vpix each include the TFT element Tr and a liquid crystal element LC. The TFT element Tr is a thin film transistor, that is, an n-channel metal oxide semiconductor (MOS) TFT in this example. One of the source and the drain of the TFT element Tr is coupled to the signal line $\mathbf{25}_n$, $\mathbf{25}_{n+1}$, or $\mathbf{25}_{n+2}$, the gate thereof is coupled to the scanning line $\mathbf{24}_m$, $\mathbf{24}_{m+1}$, or $\mathbf{24}_{m+2}$, and the other of the source and the drain is coupled to a first end of the liquid crystal element LC. The first end of the liquid crystal element LC is coupled to the other of the source and the drain of the TFT element Tr, and a second end thereof is coupled to a drive electrode COML. The drive electrode COML is supplied with drive signals by a drive electrode driver, which is not illustrated. The drive electrode driver may be a component of the driver 19*a* or an independent circuit.

The sub-pixel Vpix is coupled to other sub-pixels Vpix belonging to the same row in the display region 21 by the scanning line $\mathbf{24}_m$, $\mathbf{24}_{m+1}$, or $\mathbf{24}_{m+2}$. The scanning lines $\mathbf{24}_m$, $\mathbf{24}_{m+1}$, and $\mathbf{24}_{m+2}$ are coupled to the vertical driver 22 and supplied with the vertical scanning pulses serving as scanning signals from the vertical driver 22. The sub-pixel Vpix is further coupled to other sub-pixels Vpix belonging to the same column in the display region 21 by the signal line $\mathbf{25}_n$, $\mathbf{25}_{n+1}$, $\mathbf{25}_{n+2}$. The signal lines $\mathbf{25}_n$, $\mathbf{25}_{n+1}$, and $\mathbf{25}_{n+2}$ are coupled to the horizontal driver 23 and supplied with pixel signals from the horizontal driver 23. The sub-pixel Vpix is further coupled to the other sub-pixels Vpix belonging to the same column in the display region 21 by the drive electrode COML. The drive electrodes COML are coupled to the drive electrode driver, which is not illustrated, and supplied with drive signals from the drive electrode driver.

The vertical driver 22 illustrated in FIG. 2 applies the vertical scanning pulses to the gates of the respective TFT elements Tr of the sub-pixels Vpix via the scanning lines $\mathbf{24}_m$, $\mathbf{24}_{m+1}$, and $\mathbf{24}_{m+2}$ illustrated in FIG. 3. The vertical driver 22 thus sequentially selects one row (one horizontal line) out of the sub-pixels Vpix arranged in a matrix manner (row-column configuration) in the display region 21 as a target of display drive. The horizontal driver 23 illustrated in FIG. 2 supplies the pixel signals to the respective sub-pixels Vpix included in one horizontal line sequentially selected by the vertical driver 22 via the signal lines $\mathbf{25}_n$, $\mathbf{25}_{n+1}$, and $\mathbf{25}_{n+2}$ illustrated in FIG. 3. These sub-pixels Vpix perform display of one horizontal line in accordance with the supplied pixel signals. The drive electrode driver applies the drive signals, thereby driving the drive electrodes COML in units of drive electrode blocks each including a predetermined number of drive electrodes COML.

As described above, the vertical driver 22 in the display apparatus 1 sequentially scans and drives the scanning lines $\mathbf{24}_m$, $\mathbf{24}_{m+1}$, and $\mathbf{24}_{m+2}$, thereby sequentially selecting one horizontal line. The horizontal driver 23 in the display apparatus 1 supplies the pixel signals to the sub-pixels Vpix belonging to one horizontal line, thereby performing display of each one horizontal line. To perform the display operation, the drive electrode driver applies the drive signals to the drive electrodes COML corresponding to the one horizontal line.

The display region 21 includes a color filter. The color filter includes a grid-shaped black matrix 76*a* and apertures 76*b*. The black matrix 76*a* is formed to cover the outer peripheries of the sub-pixels Vpix as illustrated in FIG. 3. In other words, the black matrix 76*a* is arranged at boundaries between the two-dimensionally arranged sub-pixels Vpix, thereby having a grid shape. The black matrix 76*a* is made of a material having a high light absorption rate. The apertures 76*b* are openings formed by the grid shape of the black matrix 76*a* and are arranged at positions corresponding to the respective sub-pixels Vpix.

The apertures 76*b* include color regions of three colors (e.g., R (red), G (green), and B (blue)) or four colors corresponding to the respective sub-pixels Vpix. Specifically, the apertures 76*b* include color regions colored with three colors of red (R), green (G), and blue (B), which are examples of a first color, a second color, and a third color, and a color region of a fourth color (e.g., white (W)), for example. In the color filter, the color regions colored with the three colors of red (R), green (G), and blue (B) are periodically arrayed on the respective apertures 76*b*, for example. In a case where the fourth color is white (W), no color is applied to the apertures 76*b* of white (W) by the color filter. In a case where the fourth color is another color, the color employed as the fourth color is applied by the color filter.

The color regions of the three colors of R, G, and B and the fourth color (e.g., W), that is, a total of four colors may be provided to the respective sub-pixels Vpix illustrated in FIG. 3 as a set serving as a pixel Pix. Alternatively, the color regions of the three colors of R, G, and B, that is, a total of three colors may be provided to the respective sub-pixels Vpix illustrated in FIG. 3 as a set serving as a pixel Pix. Still alternatively, the color regions of a plurality of other colors may be provided to the respective sub-pixels Vpix as a set serving as a pixel Pix. The pixel signals for one pixel Pix according to the present embodiment correspond to the output of one pixel Pix including the sub-pixels Vpix of red (R), green (G), blue (B), and the fourth color (white (W)). In the description of the present embodiment, red (R), green (G), blue (B), and white (W) may be simply referred to as R, G, B, and W. In a case where the pixels Pix each include the sub-pixels Vpix of two or less colors or five or more colors, digital data corresponding to the number of colors is supplied in accordance with original image data.

The color filter may have a combination of other colors as long as it is colored with difference colors. In typical color filters, the luminance of the color region of green (G) is higher than that of the color regions of red (R) and blue (B). In a case where the fourth color is white (W), the color filter may be made of a transmissive resin to produce white.

When viewed in a direction orthogonal to the front face, the scanning lines 24 and the signal lines 25 in the display region 21 are arranged at regions corresponding to the black matrix 76*a* of the color filter. In other words, the scanning lines 24 and the signal lines 25 are hidden behind the black matrix 76*a* when viewed in the direction orthogonal to the front face. In the display region 21, regions not provided with the black matrix 76*a* serve as the apertures 76*b*.

Figure 4:
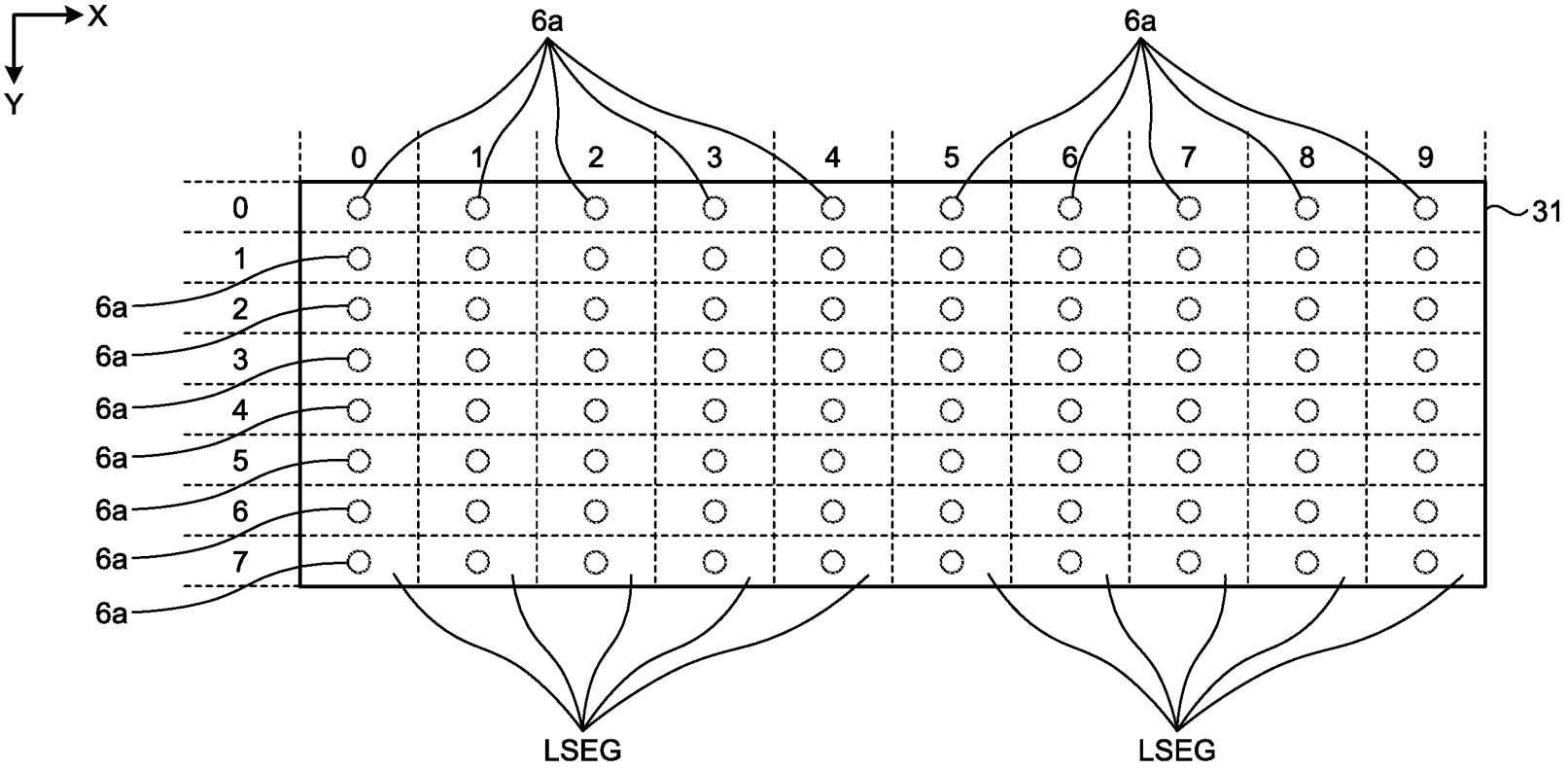
FIG. 4 is a diagram illustrating a plurality of light-emitting segments included in a light emitter of the display apparatus according to the embodiment.

FIG. 4 is a diagram illustrating a plurality of light-emitting segments included in the light emitter of the display apparatus according to the embodiment.

As illustrated in FIG. 4, a light-emitting region 31 of the light emitter BL includes a total of 10×8=80 light-emitting segments LSEG from 0 to 9 in the X-direction and from 0 to 7 in the Y-direction. The number of light-emitting segments LSEG illustrated in FIG. 4 is given by way of example only. The number of light-emitting segments LSEG is not limited thereto and may be appropriately changed.

As illustrated in FIG. 4, the light-emitting segments LSEG each include a light source 6*a*. A light-emitting diode (LED) exemplifies the light source 6*a*, but the light source 6*a* is not limited thereto. While the light-emitting segments LSEG each include one light source 6*a* in FIG. 4, the present disclosure is not limited thereto. The light emitter BL may have any configuration as long as it can control the amounts of light emission individually in the respective light-emitting segments LSEG and adjust the luminance of the light-emitting segments LSEG individually. The light-emitting segments LSEG, for example, may each include two or more light sources 6*a* the amount of light emission of which can be controlled.

Figure 5:
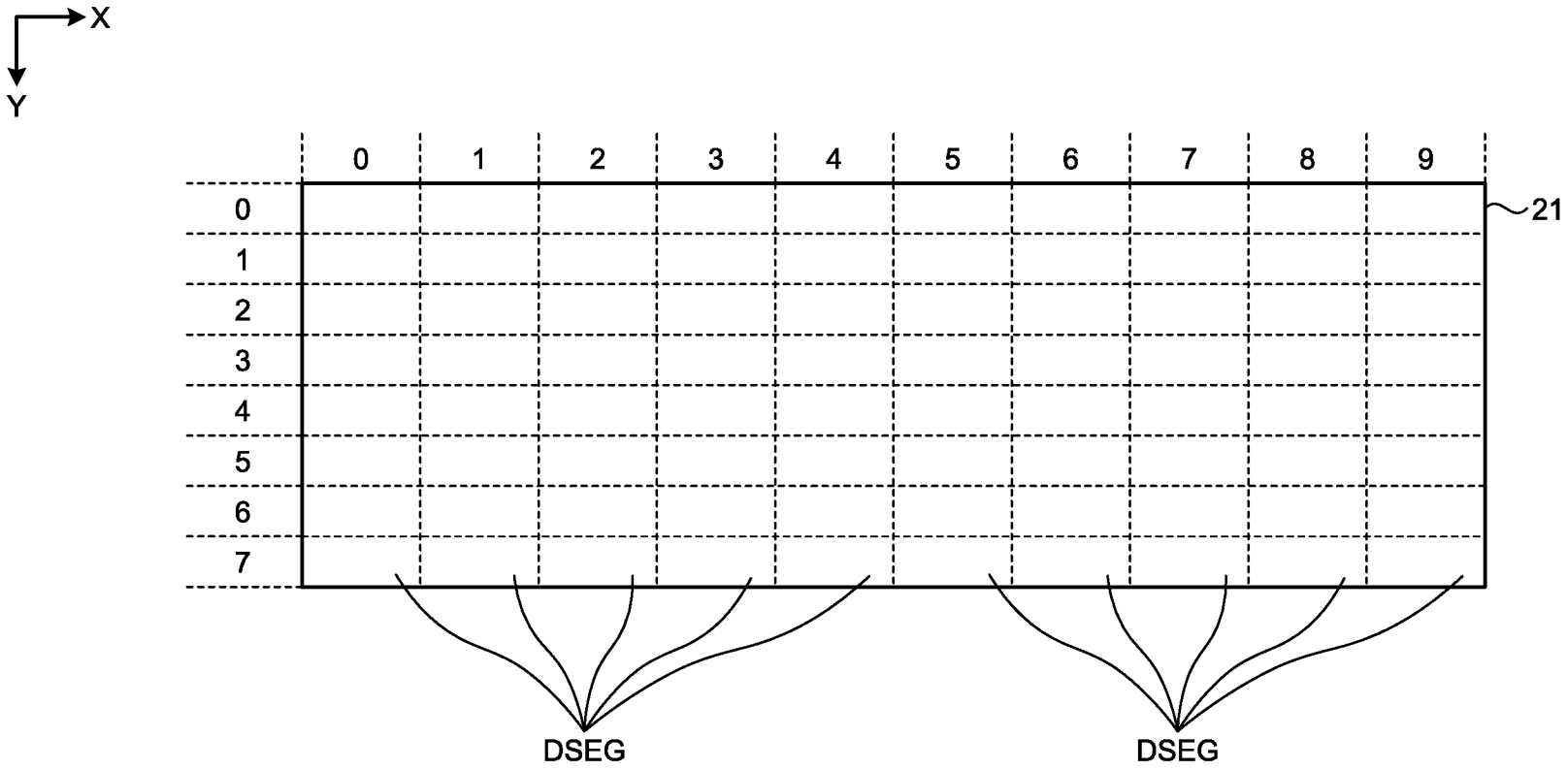
FIG. 5 is a diagram illustrating an example of division of a display region of the display apparatus according to the embodiment.

FIG. 5 is a diagram illustrating an example of division of the display region of the display apparatus according to the embodiment.

The display region 21 is divided into a plurality of display segments DSEG. The display segments each include one or a plurality of pixels Pix. The display segments DSEG are arranged so as to correspond to the respective light-emitting segments LSEG. Specifically, as illustrated in FIG. 5, for example, the display region 21 is divided into ten equal parts from 0 to 9 in the X-direction and eight equal parts from 0 to 7 in the Y-direction to obtain a total of 10×8=80 display segments DSEG. The number of the display segments DSEG corresponds to that of the light-emitting segments LSEG. The size of the display segment DSEG corresponds to that of the light-emitting segment LSEG. The display segments DSEG overlap the respective light-emitting segments LSEG in planar view.

In a case where the display region 21 includes 800 pixels Pix in the X-direction and 480 pixels Pix in the Y-direction, that is, 800×480 pixels Pix arranged in a matrix manner (row-column configuration), for example, the display segments DSEG each include 80×60 pixels Pix. The example of division and the number of the pixels in the display region 21 illustrated in FIG. 5 are given by way of example only. They are not limited thereto and may be appropriately changed.

Light from a plurality of light sources 6*a* is output not only to the corresponding display segments DSEG but also to other display segments DSEG near the corresponding display segments DSEG. When two light sources 6*a* corresponding to two adjacent display segments DSEG are both turned on, for example, the two display segments DSEG are irradiated with synthesized light of the light output from the two light sources 6*a*.

Operating Principles

Comparative Example

Figure 6:
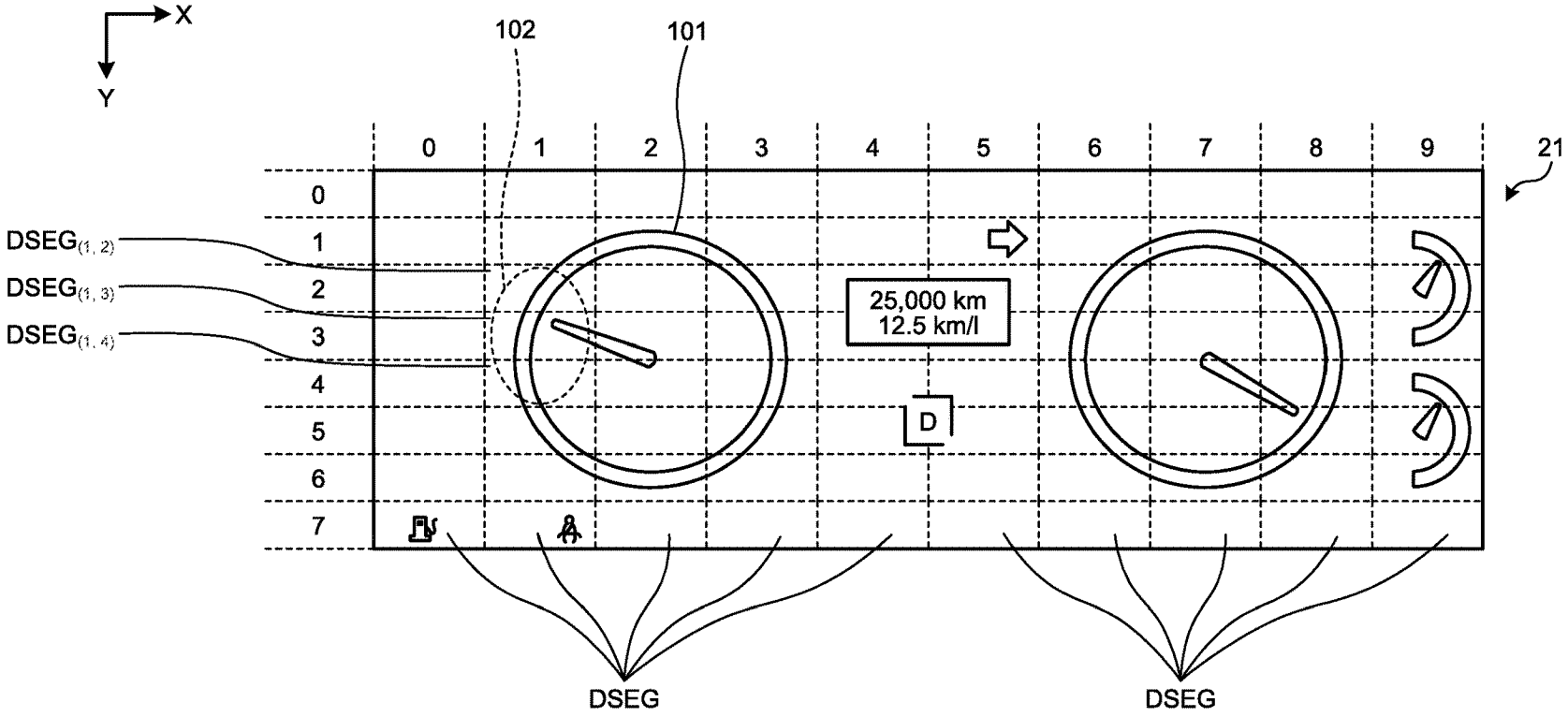
FIG. 6 is a diagram illustrating an example of an image displayed on the display region of the display apparatus according to a comparative example.

FIG. 6 is a diagram illustrating an example of an image displayed on the display region of the display apparatus according to a comparative example. In FIG. 6, the display region 21 displays an image of automobile meters.

Figure 7:
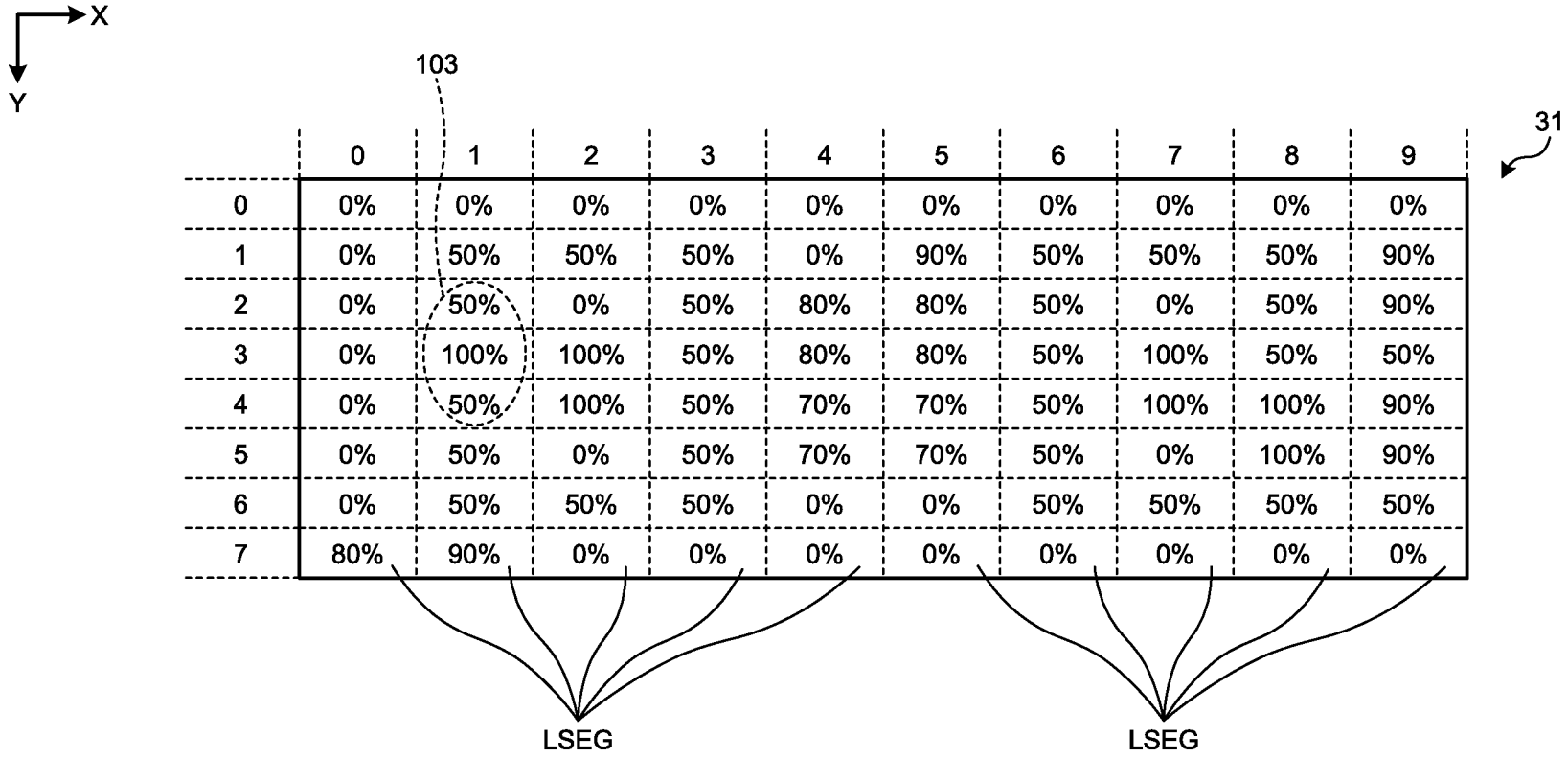
FIG. 7 is a diagram illustrating an example of the amounts of light emission from the light emitter of the display apparatus according to the comparative example.

FIG. 7 is a diagram illustrating an example of the amounts of light emission from the light emitter of the display apparatus according to the comparative example. FIG. 7 illustrates the amounts of light emission from the respective light-emitting segments LSEG in percentage with respect to a rated light emission amount as a panel when the image processor PR performs local dimming, thereby causing the light emitter BL to output light to the display device DP that displays the image illustrated in FIG. 6.

The image processor PR performs local dimming. In other words, the image processor PR controls the light sources 6*a* such that the amounts of light emission from the respective light sources 6*a* correspond to the luminance necessary for the respective display segments.

If the output gradation values of all the pixels Pix included in the display segment $DSEG_{(0,0)}$ illustrated in FIG. 6 are black (e.g., (R, G, B)=(0, 0, 0)), for example, the image processor PR does not turn on the light source 6*a* in the light-emitting segment $LSEG_{(0,0)}$. Assume a case where the ratio of the output gradation value of the pixel Pix that requires light having the highest luminance in one of two display segments DSEG to that of the pixel Pix that requires light having the highest luminance in the other is 1:2. Simply and schematically explaining this case, the image processor PR performs control such that the ratio of the luminance provided by light emission from the two light sources 6*a* corresponding to the respective two display segments is 1:2.

The following describes a region 102 including the display segment $DSEG_{(1,3)}$, the display segment $DSEG_{(1,2)}$, and the display segment $DSEG_{(1,4)}$ illustrated in FIG. 6. The display segment $DSEG_{(1,3)}$ displays the needle point of a speed meter 101. The display segment $DSEG_{(1,2)}$ is adjacent to the display segment $DSEG_{(1,3)}$ on the upper side. The display segment $DSEG_{(1,4)}$ is adjacent to the display segment $DSEG_{(1,3)}$ on the lower side.

As illustrated in FIG. 7, a region 103 in the light-emitting region 31 corresponds to the region 102 in the display region 21. The region 103 includes the light-emitting segment $LSEG_{(1,3)}$, the light-emitting segment $LSEG_{(1,2)}$ adjacent to the light-emitting segment $LSEG_{(1,3)}$ on the upper side, and the light-emitting segment $LSEG_{(1,4)}$ adjacent to the light-emitting segment $LSEG_{(1,3)}$ on the lower side.

The image processor PR adjusts, to 100% of the rated light emission amount as a panel, the amount of light emission from the light source 6*a* in the light-emitting segment $LSEG_{(1,3)}$ corresponding to the display segment $DSEG_{(1,3)}$ that displays the needle point of the speed meter 101. The image processor PR adjusts, to 50% of the rated light emission amount as a panel, the amounts of light emission from the light sources 6*a* in the light-emitting segment $LSEG_{(1,2)}$ adjacent to the light-emitting segment $LSEG_{(1,3)}$ on the upper side and in the light-emitting segment $LSEG_{(1,4)}$ adjacent to the light-emitting segment $LSEG_{(1,3)}$ on the lower side.

As described above, the image processor PR performs local dimming, thereby causing part of the light-emitting segments LSEG to emit relatively brighter light and causing other part of the light-emitting segments LSEG to emit relatively dimmer light or preventing them from emitting light. With this mechanism, the image processor PR can reduce the power consumption in the light emitter BL. To secure the display quality in a plurality of successive display segments DSEG, however, the image processor PR needs to perform complicated arithmetic operations in consideration of the amounts of light emission and the luminance distribution of the corresponding light-emitting segments LSEG.

Specifically, as described above, the light from the light sources 6*a* is output not only to the corresponding display segments DSEG but also to display segments near the corresponding display segments. To precisely perform local dimming, it is necessary to consider the relation among the light sources 6*a*.

Figure 8:
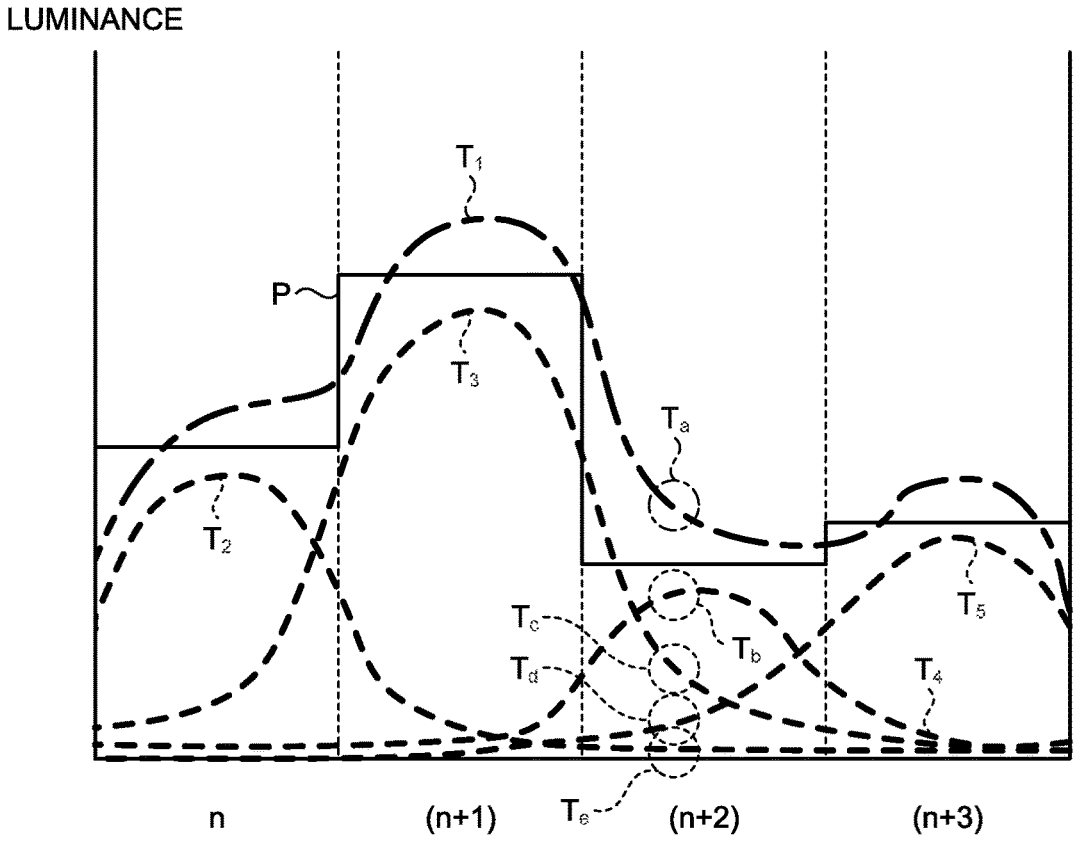
FIG. 8 is a graph illustrating an example of control patterns of four light sources aligned in one direction.

FIG. 8 is a graph illustrating an example of control patterns of four light sources aligned in one direction. Specifically, FIG. 8 is a graph indicating an example of the correspondence relation among a control pattern P of four light sources 6*a* aligned in one direction, patterns of luminance distribution $T_2$, $T_3$, $T_4$, and $T_5$ of the respective four light sources 6*a*, and luminance distribution $T_1$ obtained by synthesizing light from the four light sources 6*a*.

The horizontal axis in FIG. 8 is either the X-direction or the Y-direction. FIG. 8 illustrates the four light sources 6*a* corresponding to four display segments n, (n+1), (n+2), and (n+3) aligned in one direction (the X-direction or the Y-direction). The display segment (n+3) is positioned at an end in the direction.

In the example illustrated in FIG. 8, the four light sources 6*a* corresponding to the four display segments n, (n+1), (n+2), and (n+3) are turned on at amounts of light emission showing the luminance distribution $T_2$, $T_3$, $T_4$, and $T_5$, respectively, in correspondence with the control pattern P of the four light sources 6*a*. The luminance distribution of light output to the four display segments n, (n+1), (n+2), and (n+3) is represented by the luminance distribution $T_1$ obtained by synthesizing the light from the four light sources 6*a*. More specifically, in the luminance distribution $T_1$, luminance $T_a$ of light at a certain position in the display segment (n+2), for example, is obtained by synthesizing luminance $T_b$, $T_c$, $T_d$, and $T_e$ provided by the light from the respective four light sources 6*a* at the certain position.

The control pattern P illustrated in FIG. 8 represents the amounts of light emission indicated by the light emission amount control signals input to the four light sources 6*a* corresponding to the four display segments n, (n+1), (n+2), and (n+3). In other words, the control pattern P represents the amounts of light emission from the four light sources 6*a*, which is determined in accordance with the luminance necessary for the four display segments n, (n+1), (n+2), and (n+3). In FIG. 8, the necessary luminance is higher in the order of the display segments (n+1), n, (n+3), and (n+2).

As described above, the luminance distribution $T_1$ does not coincide with the control pattern P. To precisely calculate the luminance distribution $T_1$, it is necessary to perform an arithmetic operation in accordance with the luminance distribution $T_2$, $T_3$, $T_4$, and $T_5$. However, it is difficult to generalize the luminance distribution of the respective light sources 6*a*, such as the luminance distribution $T_2$, $T_3$, $T_4$, and $T_5$, by using an expression having coordinates as a variable, for example.

To precisely obtain information indicating the luminance distribution of the respective light sources 6*a* in accordance with the amounts of light emission indicated by the light emission amount control signals, it is necessary to perform individual measurement in advance. Holding the information requires a storage capacity to comprehensively store the measured luminance distribution patterns of the light sources 6*a*. The information can be restricted to some extent by recording the sampled luminance distribution in a form of a look up table (LUT) and calculating an approximate value of the luminance between the samples by interpolation. Even in this case, however, a memory having a storage capacity according to the degree of precision in sampling is required.

In the processing for calculating the luminance distribution (e.g., the luminance distribution $T_1$) obtained by synthesizing the light from the light sources 6*a*, an arithmetic operation is performed based on the LUT and an algorithm for the interpolation. However, the arithmetic operation requires enormous computing power. The following schematically describes a specific example using the example illustrated in FIG. 8. The patterns of the luminance distribution $T_2$, $T_3$, $T_4$, and $T_5$ of the respective light sources 6*a* are calculated based on the control pattern P. Subsequently, the processing of calculating the luminance $T_a$ in accordance with the luminance $T_b$, $T_c$, $T_d$, and $T_e$ at a certain position in the luminance distribution $T_2$, $T_3$, $T_4$, and $T_5$, respectively, is performed at a plurality of positions not limited to the certain position. As a result, the luminance distribution $T_1$ obtained by synthesizing the luminance distribution $T_2$, $T_3$, $T_4$, and $T_5$ is calculated. To calculate the luminance distribution in the display region 21 by the same method as that of the mechanism for calculating the luminance distribution $T_1$, the processing load further increases in accordance with increase in the number of display segments and light sources 6*a*.

As described above, to precisely perform local dimming, it is necessary to perform an arithmetic operation for deriving the luminance distribution in the entire display region causing an enormous processing load as described with reference to FIG. 8. In addition, the LUT indicating the luminance distribution of the respective light sources 6*a* is required as a precondition for the arithmetic operation. To solve this problem, the present embodiment performs local dimming with a simpler mechanism.

Operating Principles According to the Embodiment

Figure 9:
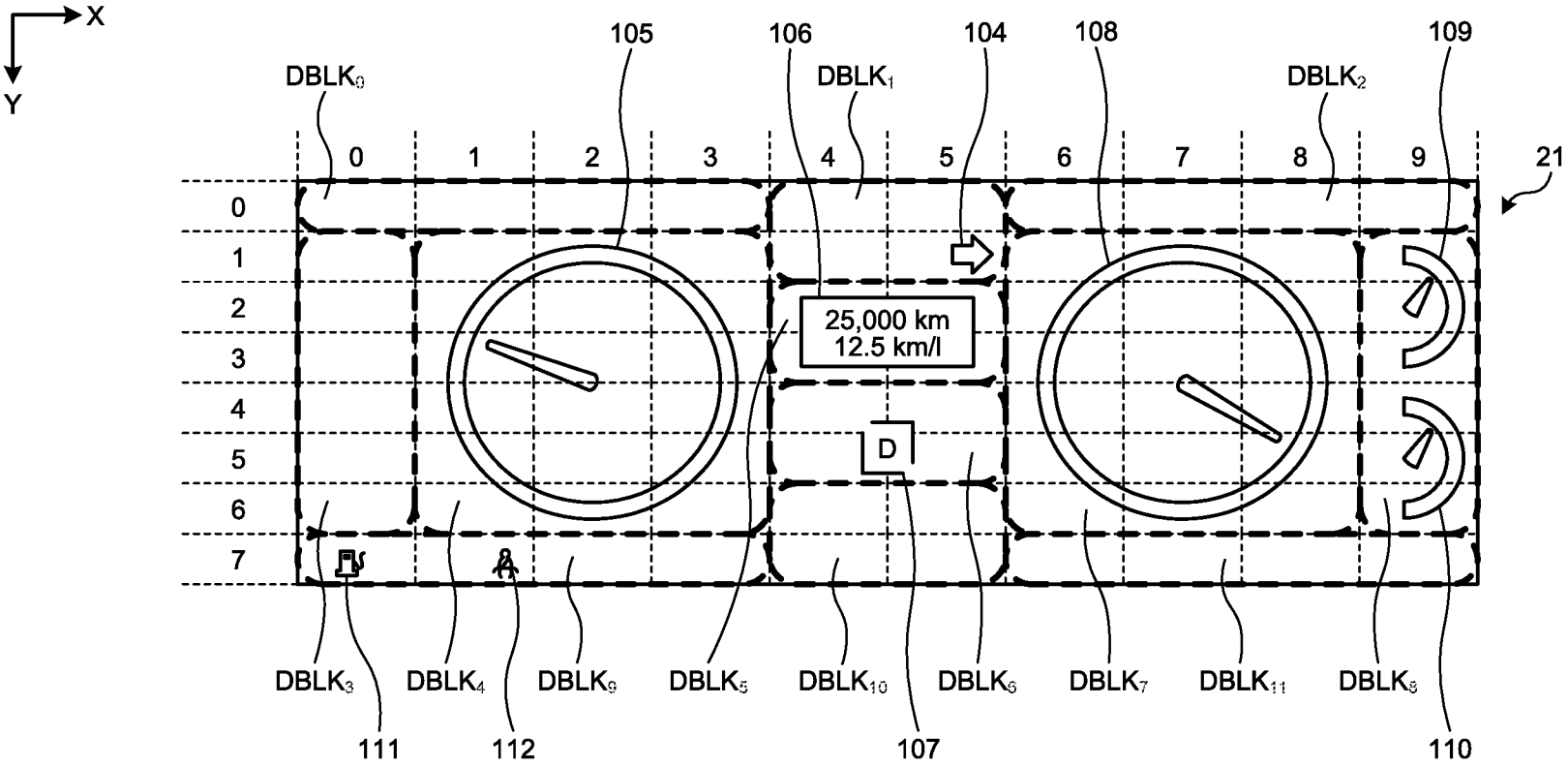
FIG. 9 is a diagram illustrating an example of an image displayed on the display region of the display apparatus according to the embodiment.

FIG. 9 is a diagram illustrating an example of an image displayed on the display region of the display apparatus according to the embodiment. In FIG. 9, the display region 21 displays an image of automobile meters.

The image processor PR divides the display region 21 into a plurality of rectangular display blocks $DBLK_0$ to $DBLK_{11}$. The display blocks $DBLK_0$ to $DBLK_{11}$ correspond to respective image objects. The display block $DBLK_1$ corresponds to an image object 104 of a right turn signal. The display block $DBLK_4$ corresponds to an image object 105 of a speed meter. The display block $DBLK_5$ corresponds to an image object 106 of an odometer and a fuel consumption indicator. The display block $DBLK_6$ corresponds to an image object 107 indicating the state of transmission. The display block $DBLK_7$ corresponds to an image object 108 of a tachometer. The display block $DBLK_8$ corresponds to an image object 109 indicating residual fuel and an image object 110 indicating water temperature. The display block $DBLK_9$ corresponds to an image object 111 urging a driver to fill the car with fuel and an image object 112 urging the driver to wear a seat belt.

The display blocks $DBLK_0$ to $DBLK_{11}$ each include one or a plurality of display segments DSEG. Control data indicating how to divide the display region 21 into the display blocks $DBLK_0$ to $DBLK_{11}$ is output from the host HST to the image processor PR. The control data will be described later.

The display block $DBLK_0$ includes the display segments $DSEG_{(0,0)}$, $DSEG_{(1,0)}$, $DSEG_{(2,0)}$, and $DSEG_{(3,0)}$. In the display block $DBLK_0$, no image object is displayed.

The display block $DBLK_1$ includes the display segments $DSEG_{(4,0)}$, $DSEG_{(5,0)}$, $DSEG_{(4,1)}$, and $DSEG_{(5,1)}$. In the display block $DBLK_1$, the image object 104 of a right turn signal is displayed.

The display block $DBLK_2$ includes the display segments $DSEG_{(6,0)}$, $DSEG_{(7,0)}$, $DSEG_{(8,0)}$, and $DSEG_{(9,0)}$. In the display block $DBLK_2$, no image object is displayed.

The display block $DBLK_3$ includes the display segments $DSEG_{(0,1)}$, $DSEG_{(0,2)}$, $DSEG_{(0,3)}$, $DSEG_{(0,4)}$, $DSEG_{(0,5)}$, and $DSEG_{(0,6)}$. In the display block $DBLK_3$, no image object is displayed.

The display block $DBLK_4$ includes the display segments $DSEG_{(1,1)}$, $DSEG_{(2,1)}$, $DSEG_{(3,1)}$, $DSEG_{(1,2)}$, $DSEG_{(2,2)}$, $DSEG_{(3,2)}$, $DSEG_{(1,3)}$, $DSEG_{(2,3)}$, $DSEG_{(3,3)}$, $DSEG_{(1,4)}$, $DSEG_{(2,4)}$, $DSEG_{(3,4)}$, $DSEG_{(1,5)}$, $DSEG_{(2,5)}$, $DSEG_{(3,5)}$, $DSEG_{(1,6)}$, $DSEG_{(2,6)}$, and $DSEG_{(3,6)}$. In the display block $DBLK_4$, the image object 105 of a speed meter is displayed.

The display block $DBLK_5$ includes the display segments $DSEG_{(4,2)}$, $DSEG_{(5,2)}$, $DSEG_{(4,3)}$, and $DSEG_{(5,3)}$. In the display block $DBLK_5$, the image object 106 of an odometer and a fuel consumption indicator is displayed.

The display block $DBLK_6$ includes the display segments $DSEG_{(4,4)}$, $DSEG_{(5,4)}$, $DSEG_{(4,5)}$, and $DSEG_{(5,5)}$. In the display block $DBLK_6$, the image object 107 indicating the state of transmission is displayed.

The display block $DBLK_7$ includes the display segments $DSEG_{(6,1)}$, $DSEG_{(7,1)}$, $DSEG_{(8,1)}$, $DSEG_{(6,2)}$, $DSEG_{(7,2)}$, $DSEG_{(8,2)}$, $DSEG_{(6,3)}$, $DSEG_{(7,3)}$, $DSEG_{(8,3)}$, $DSEG_{(6,4)}$, $DSEG_{(7,4)}$, $DSEG_{(8,4)}$, $DSEG_{(6,5)}$, $DSEG_{(7,5)}$, $DSEG_{(8,5)}$, $DSEG_{(6,6)}$, $DSEG_{(7,6)}$, and $DSEG_{(8,6)}$. In the display block $DBLK_7$, the image object 108 of a tachometer is displayed.

The display block $DBLK_8$ includes the display segments $DSEG_{(9,1)}$, $DSEG_{(9,2)}$, $DSEG_{(9,3)}$, $DSEG_{(9,4)}$, $DSEG_{(9,5)}$, and $DSEG_{(9,6)}$. In the display block $DBLK_8$, the image object 109 indicating residual fuel and the image object 110 indicating water temperature are displayed.

The display block $DBLK_9$ includes the display segments $DSEG_{(0,7)}$, $DSEG_{(1,7)}$, $DSEG_{(2,7)}$, and $DSEG_{(3,7)}$. In the display block $DBLK_9$, the image object 111 urging the driver to fill the car with fuel and the image object 112 urging the driver to wear a seat belt are displayed.

The display block $DBLK_{10}$ includes the display segments $DSEG_{(4,6)}$, $DSEG_{(5,6)}$, $DSEG_{(4,7)}$, and $DSEG_{(5,7)}$. In the display block $DBLK_{10}$, no image object is displayed.

The display block $DBLK_{11}$ includes the display segments $DSEG_{(6,7)}$, $DSEG_{(7,7)}$, $DSEG_{(8,7)}$, and $DSEG_{(9,7)}$. In the display block $DBLK_{11}$, no image object is displayed.

Figure 10:
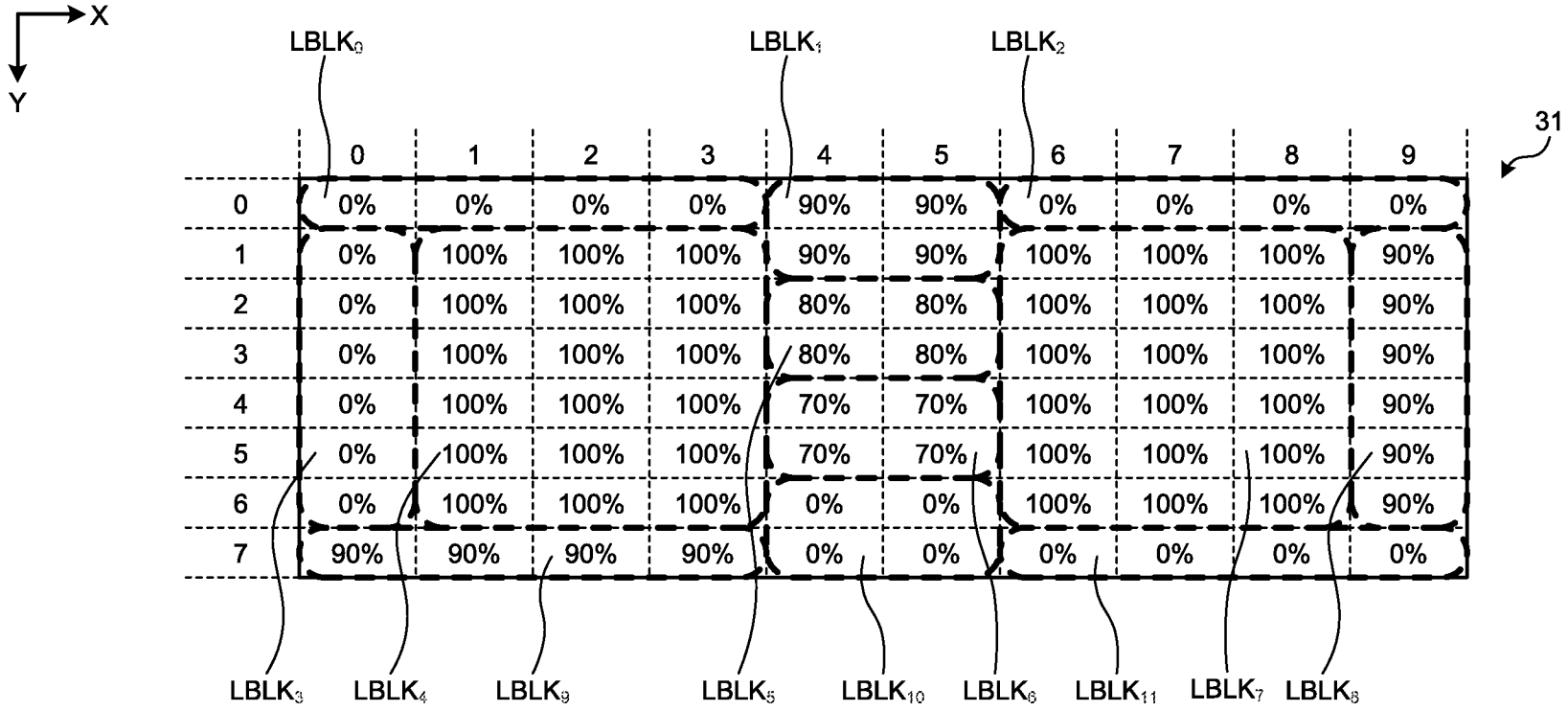
FIG. 10 is a diagram illustrating an example of the amounts of light emission from the light emitter of the display apparatus according to the embodiment.

FIG. 10 is a diagram illustrating an example of the amounts of light emission from the light emitter of the display apparatus according to the embodiment. FIG. 10 illustrates the amounts of light emission in the respective light-emitting segments LSEG in percentage with respect to the rated light emission amount as a panel when the image processor PR performs local dimming, thereby causing the light emitter BL to output light to the display device DP that displays the image illustrated in FIG. 9.

The image processor PR divides the light-emitting region 31 into a plurality of rectangular light-emitting blocks $LBLK_0$ to $LBLK_{11}$. The light-emitting blocks $LBLK_0$ to $LBLK_{11}$ each include one or a plurality of light-emitting segments LSEG. Control data indicating how to divide the light emitter BL into the light-emitting blocks $LBLK_0$ to $LBLK_{11}$ is the same as the control data indicating how to divide the display region 21 into the display blocks $DBLK_0$ to $DBLK_{11}$ and is output from the host HST to the image processor PR. The control data will be described later.

The light-emitting block $LBLK_0$ includes the light-emitting segments $LSEG_{(0,0)}$, $LSEG_{(1,0)}$, $LSEG_{(2,0)}$, and $LSEG_{(3,0)}$. The image processor PR controls the amounts of light emission from the light-emitting segments $LSEG_{(0,0)}$, $LSEG_{(1,0)}$, $LSEG_{(2,0)}$, and $LSEG_{(3,0)}$ in accordance with the largest amount of light emission out of the amounts of light emission necessary for the light-emitting segments $LSEG_{(0,0)}$, $LSEG_{(1,0)}$, $LSEG_{(2,0)}$, and $LSEG_{(3,0)}$.

In the display block $DBLK_0$, no image object is displayed. The largest amount of light emission out of the amounts of light emission necessary for the light-emitting segments $LSEG_{(0,0)}$, $LSEG_{(1,0)}$, $LSEG_{(2,0)}$, and $LSEG_{(3,0)}$ is 0% of the rated light emission amount as a panel. The image processor PR adjusts the amounts of light emission from the light-emitting segments $LSEG_{(0,0)}$, $LSEG_{(1,0)}$, $LSEG_{(2,0)}$, and $LSEG_{(3,0)}$ uniformly to 0% of the rated light emission amount as a panel, for example.

The light-emitting block $LBLK_1$ includes the light-emitting segments $LSEG_{(4,0)}$, $LSEG_{(5,0)}$, $LSEG_{(4,1)}$, and $LSEG_{(5,1)}$. The image processor PR controls the amounts of light emission from the light-emitting segments $LSEG_{(4,0)}$, $LSEG_{(5,0)}$, $LSEG_{(4,1)}$, and $LSEG_{(5,1)}$ in accordance with the largest amount of light emission out of the amounts of light emission necessary for the light-emitting segments $LSEG_{(4,0)}$, $LSEG_{(5,0)}$, $LSEG_{(4,1)}$, and $LSEG_{(5,1)}$.

In the display block $DBLK_1$, the image object 104 of a right turn signal is displayed. The amount of light emission necessary for displaying the image object 104 of a right turn signal is 90% of the rated light emission amount as a panel, for example. The image processor PR adjusts the amounts of light emission from the light-emitting segments $LSEG_{(4,0)}$, $LSEG_{(5,0)}$, $LSEG_{(4,1)}$, and $LSEG_{(5,1)}$ uniformly to 90% of the rated light emission amount as a panel.

The light-emitting block $LBLK_2$ includes the light-emitting segments $LSEG_{(6,0)}$, $LSEG_{(7,0)}$, $LSEG_{(8,0)}$, and $LSEG_{(9,0)}$. The image processor PR controls the amounts of light emission from the light-emitting segments $LSEG_{(6,0)}$, $LSEG_{(7,0)}$, $LSEG_{(8,0)}$, and $LSEG_{(9,0)}$ in accordance with the largest amount of light emission out of the amounts of light emission necessary for the light-emitting segments $LSEG_{(6,0)}$, $LSEG_{(7,0)}$, $LSEG_{(8,0)}$, and $LSEG_{(9,0)}$.

In the display block $DBLK_2$, no image object is displayed. The largest amount of light emission out of the amounts of light emission necessary for the light-emitting segments $LSEG_{(6,0)}$, $LSEG_{(7,0)}$, $LSEG_{(8,0)}$, and $LSEG_{(9,0)}$ is 0% of the rated light emission amount as a panel. The image processor PR adjusts the amounts of light emission from the light-emitting segments $LSEG_{(6,0)}$, $LSEG_{(7,0)}$, $LSEG_{(8,0)}$, and $LSEG_{(9,0)}$ uniformly to 0% of the rated light emission amount as a panel, for example.

The light-emitting block $LBLK_3$ includes the light-emitting segments $LSEG_{(0,1)}$, $LSEG_{(0,2)}$, $LSEG_{(0,3)}$, $LSEG_{(0,4)}$, $LSEG_{(0,5)}$, and $LSEG_{(0,6)}$. The image processor PR controls the amounts of light emission from the light-emitting segments $LSEG_{(0,1)}$, $LSEG_{(0,2)}$, $LSEG_{(0,3)}$, $LSEG_{(0,4)}$, $LSEG_{(0,5)}$, and $LSEG_{(0,6)}$ in accordance with the largest amount of light emission out of the amounts of light emission necessary for the light-emitting segments $LSEG_{(0,1)}$, $LSEG_{(0,2)}$, $LSEG_{(0,3)}$, $LSEG_{(0,4)}$, $LSEG_{(0,5)}$, and $LSEG_{(0,6)}$.

In the display block $DBLK_3$, no image object is displayed. The largest amount of light emission out of the amounts of light emission necessary for the light-emitting segments $LSEG_{(0,1)}$, $LSEG_{(0,2)}$, $LSEG_{(0,3)}$, $LSEG_{(0,4)}$, $LSEG_{(0,5)}$, and $LSEG_{(0,6)}$ is 0% of the rated light emission amount as a panel. The image processor PR adjusts the amounts of light emission from the light-emitting segments $LSEG_{(0,1)}$, $LSEG_{(0,2)}$, $LSEG_{(0,3)}$, $LSEG_{(0,4)}$, $LSEG_{(0,5)}$, and $LSEG_{(0,6)}$ uniformly to 0% of the rated light emission amount as a panel, for example.

The light-emitting block $LBLK_4$ includes the light-emitting segments $LSEG_{(1,1)}$, $LSEG_{(2,1)}$, $LSEG_{(3,1)}$, $LSEG_{(1,2)}$, $LSEG_{(2,2)}$, $LSEG_{(3,2)}$, $LSEG_{(1,3)}$, $LSEG_{(2,3)}$, $LSEG_{(3,3)}$, $LSEG_{(1,4)}$, $LSEG_{(2,4)}$, $LSEG_{(3,4)}$, $LSEG_{(1,5)}$, $LSEG_{(2,5)}$, $LSEG_{(3,5)}$, $LSEG_{(1,6)}$, $LSEG_{(2,6)}$, and $LSEG_{(3,6)}$.

The image processor PR controls the amounts of light emission from the light-emitting segments $LSEG_{(1,1)}$, $LSEG_{(2,1)}$, $LSEG_{(3,1)}$, $LSEG_{(1,2)}$, $LSEG_{(2,2)}$, $LSEG_{(3,2)}$, $LSEG_{(1,3)}$, $LSEG_{(2,3)}$, $LSEG_{(3,3)}$, $LSEG_{(1,4)}$, $LSEG_{(2,4)}$, $LSEG_{(3,4)}$, $LSEG_{(1,5)}$, $LSEG_{(2,5)}$, $LSEG_{(3,5)}$, $LSEG_{(1,6)}$, $LSEG_{(2,6)}$, and $LSEG_{(3,6)}$ in accordance with the largest amount of light emission out of the amounts of light emission necessary for the light-emitting segments $LSEG_{(1,1)}$, $LSEG_{(2,1)}$, $LSEG_{(3,1)}$, $LSEG_{(1,2)}$, $LSEG_{(2,2)}$, $LSEG_{(3,2)}$, $LSEG_{(1,3)}$, $LSEG_{(2,3)}$, $LSEG_{(3,3)}$, $LSEG_{(1,4)}$, $LSEG_{(2,4)}$, $LSEG_{(3,4)}$, $LSEG_{(1,5)}$, $LSEG_{(2,5)}$, $LSEG_{(3,5)}$, $LSEG_{(1,6)}$, $LSEG_{(2,6)}$, and $LSEG_{(3,6)}$.

In the display block $DBLK_4$, the image object 105 of a speed meter is displayed. The amount of light emission necessary for displaying the image object 105 of a speed meter is 100% of the rated light emission amount as a panel, for example. The image processor PR adjusts the amounts of light emission from the light-emitting segments $LSEG_{(1,1)}$, $LSEG_{(2,1)}$, $LSEG_{(3,1)}$, $LSEG_{(1,2)}$, $LSEG_{(2,2)}$, $LSEG_{(3,2)}$, $LSEG_{(1,3)}$, $LSEG_{(2,3)}$, $LSEG_{(3,3)}$, $LSEG_{(1,4)}$, $LSEG_{(2,4)}$, $LSEG_{(3,4)}$, $LSEG_{(1,5)}$, $LSEG_{(2,5)}$, $LSEG_{(3,5)}$, $LSEG_{(1,6)}$, $LSEG_{(2,6)}$, and $LSEG_{(3,6)}$ uniformly to 100% of the rated light emission amount as a panel.

The light-emitting block $LBLK_5$ includes the light-emitting segments $LSEG_{(4,2)}$, $LSEG_{(5,2)}$, $LSEG_{(4,3)}$, and $LSEG_{(5,3)}$. The image processor PR controls the amounts of light emission from the light-emitting segments $LSEG_{(4,2)}$, $LSEG_{(5,2)}$, $LSEG_{(4,3)}$, and $LSEG_{(5,3)}$ in accordance with the largest amount of light emission out of the amounts of light emission necessary for the light-emitting segments $LSEG_{(4,2)}$, $LSEG_{(5,2)}$, $LSEG_{(4,3)}$, and $LSEG_{(5,3)}$.

In the display block $DBLK_5$, the image object 106 of an odometer and a fuel consumption indicator is displayed. The amount of light emission necessary for displaying the image object 106 of an odometer and a fuel consumption indicator is 80% of the rated light emission amount as a panel, for example. The image processor PR adjusts the amounts of light emission from the light-emitting segments $LSEG_{(4,2)}$, $LSEG_{(5,2)}$, $LSEG_{(4,3)}$, and $LSEG_{(5,3)}$ uniformly to 80% of the rated light emission amount as a panel.

The light-emitting block $LBLK_6$ includes the light-emitting segments $LSEG_{(4,4)}$, $LSEG_{(5,4)}$, $LSEG_{(4,5)}$, and $LSEG_{(5,5)}$. The image processor PR controls the amounts of light emission from the light-emitting segments $LSEG_{(4,4)}$, $LSEG_{(5,4)}$, $LSEG_{(4,5)}$, and $LSEG_{(5,5)}$ in accordance with the largest amount of light emission out of the amounts of light emission necessary for the light-emitting segments $LSEG_{(4,4)}$, $LSEG_{(5,4)}$, $LSEG_{(4,5)}$, and $LSEG_{(5,5)}$.

In the display block $DBLK_6$, the image object 107 indicating the state of transmission is displayed. The amount of light emission necessary for displaying the image object 107 indicating the state of transmission is 70% of the rated light emission amount as a panel, for example. The image processor PR adjusts the amounts of light emission from the light-emitting segments $LSEG_{(4,4)}$, $LSEG_{(5,4)}$, $LSEG_{(4,5)}$, and $LSEG_{(5,5)}$ uniformly to 70% of the rated light emission amount as a panel.

The light-emitting block $LBLK_7$ includes the light-emitting segments $LSEG_{(6,1)}$, $LSEG_{(7,1)}$, $LSEG_{(8,1)}$, $LSEG_{(6,2)}$, $LSEG_{(7,2)}$, $LSEG_{(8,2)}$, $LSEG_{(6,3)}$, $LSEG_{(7,3)}$, $LSEG_{(8,3)}$, $LSEG_{(6,4)}$, $LSEG_{(7,4)}$, $LSEG_{(8,4)}$, $LSEG_{(6,5)}$, $LSEG_{(7,5)}$, $LSEG_{(8,5)}$, $LSEG_{(6,6)}$, $LSEG_{(7,6)}$, and $LSEG_{(8,6)}$.

The image processor PR controls the amounts of light emission from the light-emitting segments $LSEG_{(6,1)}$, $LSEG_{(7,1)}$, $LSEG_{(8,1)}$, $LSEG_{(6,2)}$, $LSEG_{(7,2)}$, $LSEG_{(8,2)}$, $LSEG_{(6,3)}$, $LSEG_{(7,3)}$, $LSEG_{(8,3)}$, $LSEG_{(6,4)}$, $LSEG_{(7,4)}$, $LSEG_{(8,4)}$, $LSEG_{(6,5)}$, $LSEG_{(7,5)}$, $LSEG_{(8,5)}$, $LSEG_{(6,6)}$, $LSEG_{(7,6)}$, and $LSEG_{(8,6)}$ in accordance with the largest amount of light emission out of the amounts of light emission necessary for the light-emitting segments $LSEG_{(6,1)}$, $LSEG_{(7,1)}$, $LSEG_{(8,1)}$, $LSEG_{(6,2)}$, $LSEG_{(7,2)}$, $LSEG_{(8,2)}$, $LSEG_{(6,3)}$, $LSEG_{(7,3)}$, $LSEG_{(8,3)}$, $LSEG_{(6,4)}$, $LSEG_{(7,4)}$, $LSEG_{(8,4)}$, $LSEG_{(6,5)}$, $LSEG_{(7,5)}$, $LSEG_{(8,5)}$, $LSEG_{(6,6)}$, $LSEG_{(7,6)}$, and $LSEG_{(8,6)}$.

In the display block $DBLK_7$, the image object 108 of a tachometer is displayed. The amount of light emission necessary for displaying the image object 108 of a tachometer is 100% of the rated light emission amount as a panel, for example. The image processor PR adjusts the amounts of light emission from the light-emitting segments $LSEG_{(6,1)}$, $LSEG_{(7,1)}$, $LSEG_{(8,1)}$, $LSEG_{(6,2)}$, $LSEG_{(7,2)}$, $LSEG_{(8,2)}$, $LSEG_{(6,3)}$, $LSEG_{(7,3)}$, $LSEG_{(8,3)}$, $LSEG_{(6,4)}$, $LSEG_{(7,4)}$, $LSEG_{(8,4)}$, $LSEG_{(6,5)}$, $LSEG_{(7,5)}$, $LSEG_{(8,5)}$, $LSEG_{(6,6)}$, $LSEG_{(7,6)}$, and $LSEG_{(8,6)}$ uniformly to 100% of the rated light emission amount as a panel.

The light-emitting block $LBLK_8$ includes the light-emitting segments $LSEG_{(9,1)}$, $LSEG_{(9,2)}$, $LSEG_{(9,3)}$, $LSEG_{(9,4)}$, $LSEG_{(9,5)}$, and $LSEG_{(9,6)}$. The image processor PR controls the amounts of light emission from the light-emitting segments $LSEG_{(9,1)}$, $LSEG_{(9,2)}$, $LSEG_{(9,3)}$, $LSEG_{(9,4)}$, $LSEG_{(9,5)}$, and $LSEG_{(9,6)}$ in accordance with the largest amount of light emission out of the amounts of light emission necessary for the light-emitting segments $LSEG_{(9,1)}$, $LSEG_{(9,2)}$, $LSEG_{(9,3)}$, $LSEG_{(9,4)}$, $LSEG_{(9,5)}$, and $LSEG_{(9,6)}$.

In the display block $DBLK_8$, the image object 109 indicating residual fuel and the image object 110 indicating water temperature are displayed. The amount of light emission necessary for displaying the image object 109 indicating residual fuel and the image object 110 indicating water temperature is 90% of the rated light emission amount as a panel, for example. The image processor PR adjusts the amounts of light emission from the light-emitting segments $LSEG_{(9,1)}$, $LSEG_{(9,2)}$, $LSEG_{(9,3)}$, $LSEG_{(9,4)}$, $LSEG_{(9,5)}$, and $LSEG_{(9,6)}$ uniformly to 90% of the rated light emission amount as a panel.

The light-emitting block $LBLK_9$ includes the light-emitting segments $LSEG_{(0,7)}$, $LSEG_{(1,7)}$, $LSEG_{(2,7)}$, and $LSEG_{(3,7)}$. The image processor PR controls the amounts of light emission from the light-emitting segments $LSEG_{(0,7)}$, $LSEG_{(1,7)}$, $LSEG_{(2,7)}$, and $LSEG_{(3,7)}$ in accordance with the largest amount of light emission out of the amounts of light emission necessary for the light-emitting segments $LSEG_{(0,7)}$, $LSEG_{(1,7)}$, $LSEG_{(2,7)}$, and $LSEG_{(3,7)}$.

In the display block $DBLK_9$, the image object 111 urging the driver to fill the car with fuel and the image object 112 urging the driver to wear a seat belt are displayed. The amount of light emission necessary for displaying the image object 111 urging the driver to fill the car with fuel and the image object 112 urging the driver to wear a seat belt is 90% of the rated light emission amount as a panel, for example. The image processor PR adjusts the amounts of light emission from the light-emitting segments $LSEG_{(0,7)}$, $LSEG_{(1,7)}$, $LSEG_{(2,7)}$, and $LSEG_{(3,7)}$ uniformly to 90% of the rated light emission amount as a panel.

The light-emitting block $LBLK_{10}$ includes the light-emitting segments $LSEG_{(4,6)}$, $LSEG_{(5,6)}$, $LSEG_{(4,7)}$, and $LSEG_{(5,7)}$. The image processor PR controls the amounts of light emission from the light-emitting segments $LSEG_{(4,6)}$, $LSEG_{(5,6)}$, $LSEG_{(4,7)}$, and $LSEG_{(5,7)}$ in accordance with the largest amount of light emission out of the amounts of light emission necessary for the light-emitting segments $LSEG_{(4,6)}$, $LSEG_{(5,6)}$, $LSEG_{(4,7)}$, and $LSEG_{(5,7)}$.

In the display block $DBLK_{10}$, no image object is displayed. The largest amount of light emission out of the amounts of light emission necessary for the light-emitting segments $LSEG_{(4,6)}$, $LSEG_{(5,6)}$, $LSEG_{(4,7)}$, and $LSEG_{(5,7)}$ is 0% of the rated light emission amount as a panel. The image processor PR adjusts the amounts of light emission from the light-emitting segments $LSEG_{(4,6)}$, $LSEG_{(5,6)}$, $LSEG_{(4,7)}$, and $LSEG_{(5,7)}$ uniformly to 0% of the rated light emission amount as a panel, for example.

The light-emitting block $LBLK_{11}$ includes the light-emitting segments $LSEG_{(6,7)}$, $LSEG_{(7,7)}$, $LSEG_{(8,7)}$, and $LSEG_{(9,7)}$. The image processor PR controls the amounts of light emission from the light-emitting segments $LSEG_{(6,7)}$, $LSEG_{(7,7)}$, $LSEG_{(8,7)}$, and $LSEG_{(9,7)}$ in accordance with the largest amount of light emission out of the amounts of light emission necessary for the light-emitting segments $LSEG_{(6,7)}$, $LSEG_{(7,7)}$, $LSEG_{(8,7)}$, and $LSEG_{(9,7)}$.

In the display block $DBLK_{11}$, no image object is displayed. The largest amount of light emission out of the amounts of light emission necessary for the light-emitting segments $LSEG_{(6,7)}$, $LSEG_{(7,7)}$, $LSEG_{(8,7)}$, and $LSEG_{(9,7)}$ is 0% of the rated light emission amount as a panel. The image processor PR adjusts the amounts of light emission from the light-emitting segments $LSEG_{(6,7)}$, $LSEG_{(7,7)}$, $LSEG_{(8,7)}$, and $LSEG_{(9,7)}$ uniformly to 0% of the rated light emission amount as a panel, for example.

If a difference in light emission amount between the light-emitting segments LSEG falls within a certain range, and when the image processor PR uniformly controls the amounts of light emission from adjacent light-emitting segments LSEG, the adjacent light-emitting segments LSEG can reliably emit light at the amounts of light emission within a certain range. In this case, the image processor PR need not calculate the luminance distribution at the segment boundaries in the light-emitting blocks $LBLK_0$ to $LBLK_{11}$.

Assume a case where the image processor PR adjusts the amounts of light emission from the light-emitting segments $LSEG_{(4,0)}$, $LSEG_{(5,0)}$, $LSEG_{(4,1)}$, and $LSEG_{(5,1)}$ in the light-emitting block $LBLK_1$ uniformly to 90% of the rated light emission amount as a panel, for example. In this case, if the light-emitting segments $LSEG_{(4,0)}$, $LSEG_{(5,0)}$, $LSEG_{(4,1)}$, and $LSEG_{(5,1)}$ can reliably emit light within the certain range from 90% of the rated light emission amount as a panel, the image processor PR need not calculate the luminance distribution at the segment boundaries in the light-emitting block $LBLK_1$ (segment boundaries between the light-emitting segments $LSEG_{(4,0)}$, $LSEG_{(5,0)}$, $LSEG_{(4,1)}$, and $LSEG_{(5,1)}$).

Consequently, the image processor PR according to the present embodiment simply needs to calculate the luminance distribution at the block boundaries between the light-emitting blocks $LBLK_0$ to $LBLK_{11}$.

By contrast, the comparative example illustrated in FIG. 7 individually controls the amounts of light emission in the respective light-emitting segments LSEG. The number of segment boundaries having different amounts of light emission is larger than that in FIG. 10. As a result, the number of segment boundaries for which the image processor PR needs to calculate the luminance distribution is larger than that in FIG. 10.

Consequently, the present embodiment can reduce the amount of calculation of the luminance distribution compared with the comparative example.

Calculation of the luminance distribution at boundaries according to the present embodiment The image processor PR performs calculation of Expression (1) on a pixel input gradation value received from the host HST to obtain a pixel output gradation value to be output to the driver 19*a*.

$$\text{Pixel Output Gradation Value} = 100(\%)/\text{Amount of Light Emission in Light Segment} \times \text{Pixel Input Gradation Value} \quad (1)$$

If two adjacent light-emitting segments have different amounts of light emission, the uniformity in the luminance of the pixels at the segment boundary is not secured. The image processor PR performs luminance distribution processing at the segment boundary in accordance with luminance information on the pixels in two display segments included in respective two adjacent display blocks, thereby determining the luminance of the pixels in the display segments.

Figure 11:
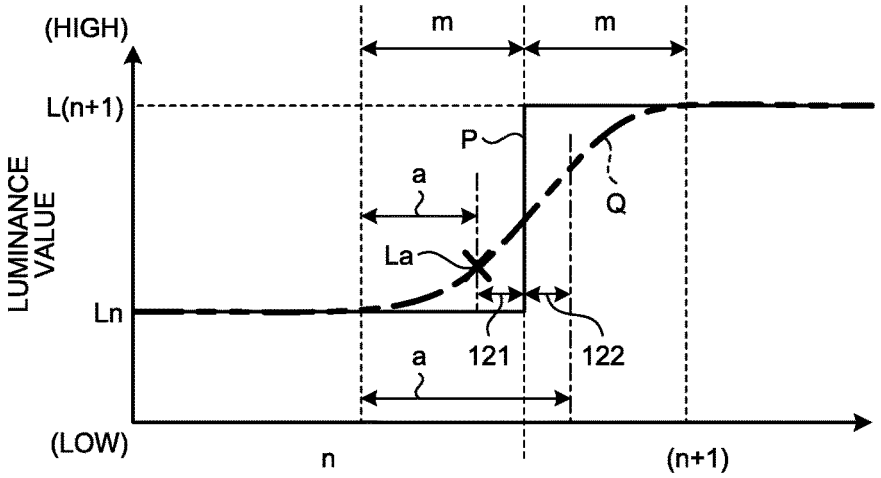
FIG. 11 is a diagram for explaining calculation of luminance distribution at a boundary according to the embodiment.

FIG. 11 is a diagram for explaining calculation of the luminance distribution at a boundary according to the embodiment. Specifically, FIG. 11 is a graph indicating an example of the relation among calculated luminance distribution Q between two display segments n and (n+1) included in respective two adjacent display blocks, the positions of the pixels Pix arranged up to the m-th position in directions away from the boundary between the two display segments, and the position of the a-th pixel Pix counting from the side farther from the boundary out of the pixels Pix arranged up to the m-th position in the direction away from the boundary. The boundary indicates a boundary between a first display segment corresponding to the light source 6*a* having a relatively large amount of light emission and a second display segment corresponding to the light source 6*a* having a relatively small amount of light emission.

If the amounts of light emission from two light sources 6*a* corresponding to two display segments DSEG included in respective two adjacent display blocks are different, the image processor PR according to the present embodiment performs first correction and second correction.

The first correction is performed on the pixels Pix in the first display segment corresponding to the light source 6*a* having a relatively large amount of light emission. In the first correction, the image processor PR changes the LUT so as to decrease the output gradation values of the pixels Pix up to the m-th position in the direction away from the boundary out of the pixels Pix.

The second correction is performed on the pixels Pix in the second display segment. In the second correction, the image processor PR changes the LUT so as to increase the output gradation values of the pixels Pix up to the m-th position in the direction away from the boundary out of the pixels Pix.

The image processor PR according to the present embodiment performs the first correction and the second correction, thereby correcting the output gradation values of the pixels Pix up to the m-th position in the directions away from the boundary. As a result, the present embodiment can reproduce a state similar to that indicated by the calculated luminance distribution Q illustrated in FIG. 11. That is, the present embodiment can reproduce the state where the luminance of light, which is output to the range of the pixels Pix arranged up to the m-th position in the directions away from the boundary, gradually changes between the first display segment (e.g., the display segment (n+1)) and the second display segment (e.g., the display segment n).

Specifically, Ln is the amount of light emission from the light source 6*a* having a relatively small amount of light emission, and L(n+1) is the amount of light emission from the light source 6*a* having a relatively large amount of light emission. Given that a pixel at a predetermined position is the first pixel, La is the amount of light emission from a first virtual light source or a second virtual light source that irradiates the pixel Pix arranged at the a-th position from the predetermined position.

The first virtual light source is a light source whose light emission amount is calculated by virtually changing the amount of light emission from the light source 6*a* having a relatively large amount of light emission. The second virtual light source is a light source whose light emission amount is calculated by virtually changing the amount of light emission from the light source 6*a* having a relatively small amount of light emission. The term "virtually changing" does not mean changing the amount of light emission from the light source 6*a* itself but means changing the LUT of the output gradation values of the pixels Pix irradiated by the light source 6*a*. In other words, the term "virtually changing" means providing display output (brightness) at the same level as that in the case where the amount of light emission from the light source 6*a* is changed.

La determined by the image processor PR indicates "the amount of light emission from the virtual light source that irradiates the pixel Pix at the position of the pixel Pix" corresponding to the brightness reproduced by changing the LUT of the output gradation values of the pixels Pix. The term "predetermined position" means the position of the m-th pixel Pix in the direction away from the boundary on the side of the light source 6*a* having a relatively small amount of light emission. The term "the a-th position from the predetermined position" means the position of the pixel Pix at the a-th position in the direction from the light source 6*a* having a relatively small amount of light emission to the light source 6*a* having a relatively large amount of light emission.

The image processor PR determines La using Expression (3) based on Expression (2).

$$A=a/2m \quad (2)$$

$$La=L(n+1)-\{L(n+1)-Ln\}\times(2\times A^3-3\times A^2+1) \quad (3)$$

The image processor PR calculates the amount of light emission (La) from the first virtual light source or the second virtual light source individually for all the pixels Pix arranged within a range up to the m-th position in the directions away from the boundary on both sides thereof. The calculated luminance distribution Q is provided by connecting: a curve or an approximate curve obtained by connecting the amounts of light emission (La) calculated for all the pixels Pix; and the amounts of light emission in the respective partial regions within the range farther than the m-th pixel Pix in both the directions away from the boundary.

The image processor PR corrects the luminance of the pixels in accordance with the determined La. Specifically, given that P1 is the output gradation value prior to the second correction of the pixel Pix arranged at a position 121 (refer to FIG. 11), i.e., the m-th position (a≤m) from the predetermined position in the second display segment (e.g., the display segment n) and that P2 is the output gradation value subsequent to the second correction, the image processor PR calculates P2 by Expression (4):

$$P2=P1\times Ln/La \quad (4)$$

La in Expression (4) satisfies Ln<La<(Ln+L(n+1))/2. In other words, the output gradation value subsequent to the second correction is an output gradation value obtained when the pixel Pix controlled by the output gradation value prior to the second correction is irradiated with light from the second virtual light source having an amount of light emission larger than the amount of light emission (Ln) from the light source 6*a* having a relatively small amount of light emission and equal to or smaller than an intermediate amount of light emission ((Ln+L(n+1))/2) of the amounts of light emission from the two light sources 6*a*.

Specifically, assume a case where P1 is expressed by (R, G, B, W)=(0, 0, 0, 50), and Ln/La=0.6 is satisfied, for example. In this case, 50×0.6=30 is satisfied, and thus P2 is expressed by (R, G, B, W)=(0, 0, 0, 30). As described above, the image processor PR corrects the output gradation value, thereby increasing the luminance of the pixel Pix arranged at the position corresponding to La to the luminance higher than the luminance corresponding to the amount of light emission (Ln) from the light source 6*a* having a relatively small amount of light emission.

Given that P3 is the output gradation value prior to the first correction of the pixel Pix at a position 122 (refer to FIG. 11), i.e., the m-th position (a>m) from the predetermined position in the second display segment (e.g., the display segment (n+1)) and that P4 is the output gradation value subsequent to the first correction, the image processor PR calculates P4 by Expression (5):

$$P4=P3\times L(n+1)/La \quad (5)$$

La in Expression (5) satisfies (Ln+L(n+1))/2<La<L(n+1). In other words, the output gradation value subsequent to the first correction is an output gradation value obtained when the pixel Pix controlled by the output gradation value prior to the first correction is irradiated with light from the first virtual light source having an amount of light emission smaller than the amount of light emission (L(n+1)) from the light source 6*a* having a relatively large amount of light emission and equal to or larger than an intermediate amount of light emission ((Ln+L(n+1))/2) of the amounts of light emission from the two light sources 6*a*.

Specifically, assume a case where P3 is expressed by (R, G, B, W)=(0, 0, 0, 50), and L(n+1)/La=1.2 is satisfied, for example. In this case, 50×1.2=60 is satisfied, and thus P4 is expressed by (R, G, B, W)=(0, 0, 0, 60). As described above, the image processor PR corrects the output gradation value, thereby decreasing the luminance of the pixel Pix arranged at the position corresponding to La to the luminance lower than the luminance corresponding to the amount of light emission (L(n+1)) from the light source 6*a* having a relatively large amount of light emission.

Given that $n_1$ ($n_1$ is a natural number) is the number of all the pixels in the display region 21 according to the present embodiment, $n_1$=800×480 is satisfied. Given that $n_2$ ($n_2$ is a natural number) is the number of pixels Pix aligned in the X-direction or the Y-direction in one display segment, $n_2$=80 or $n_2$=60 is satisfied. For example, m (m is a natural number) in "the m-th pixel Pix in the direction away from the boundary" is 8. Therefore, $n_1>n_2>m\geq 1$ is satisfied. The values of $n_1$, $n_2$, and m are given by way of example only and are not limited thereto. The values of $n_1$, $n_2$, and m may be appropriately changed as long as $n_1>n_2>m\geq 1$ is satisfied.

The image processor PR increases the degree of correction on the output gradation values of the pixels Pix positioned closer to the boundary in the first correction and the second correction. In the display segment n, as illustrated in FIG. 11, for example, the image processor PR calculates the amount of light emission (La) from the second virtual light source such that the calculated luminance distribution Q is curved from the amount of light emission (Ln) from the light source 6*a* having a relatively small amount of light emission toward the amount of light emission (L(n+1)) from the light source 6*a* having a relatively large amount of light emission, as the position is closer to the boundary between the two display segments n and (n+1).

In the display segment (n+1), the image processor PR calculates the amount of light emission (La) from the first virtual light source such that the calculated luminance distribution Q is curved from the amount of light emission (L(n+1)) from the light source 6*a* having a relatively large amount of light emission toward the amount of light emission (Ln) from the light source 6*a* having a relatively small amount of light emission, as the position is closer to the boundary between the two display segments n and (n+1). To increase the degree of correction on the output gradation values of the pixels Pix positioned closer to the boundary in the first correction and the second correction, m≥2 is satisfied.

Figure 12:
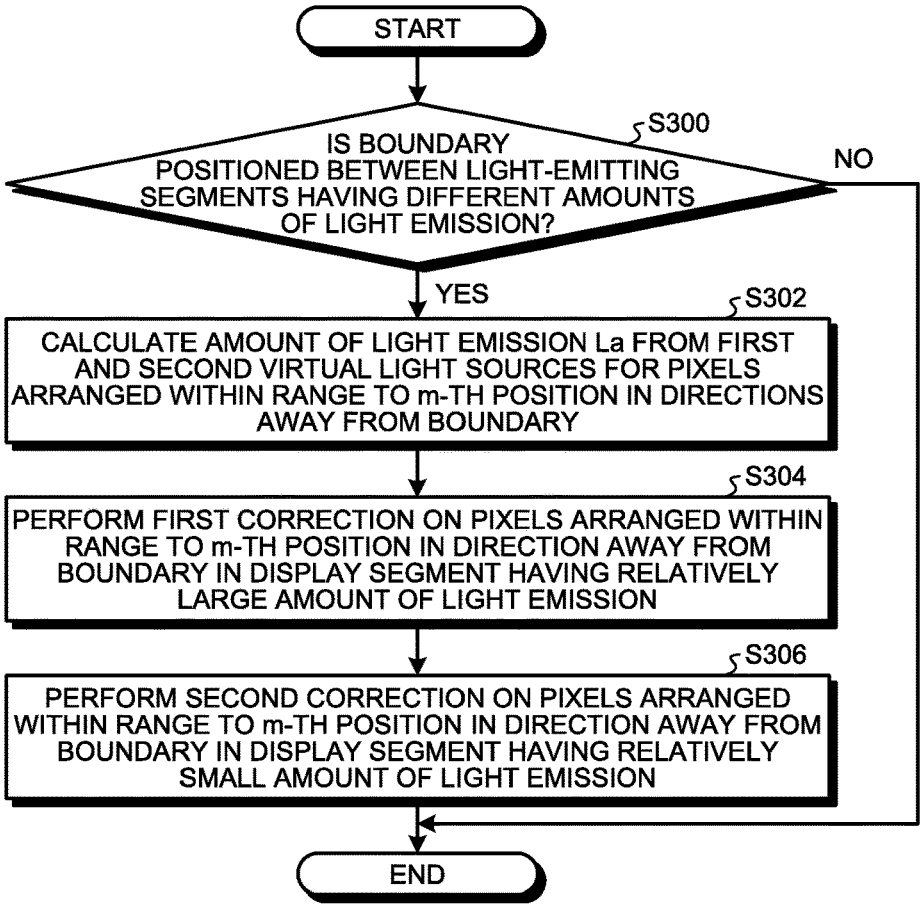
FIG. 12 is a flowchart for correction performed on a boundary in the display apparatus according to the embodiment.

FIG. 12 is a flowchart for correction performed on a boundary in the display apparatus according to the embodiment. The image processor PR performs the processing illustrated in FIG. 12 on all the segment boundaries.

At Step S300, the image processor PR determines whether the boundary is positioned between two adjacent light-emitting segments having different amounts of light emission. If the image processor PR determines that the boundary is positioned between two adjacent light-emitting segments having different amounts of light emission (Yes at Step S300), the image processor PR performs the processing at Step S302. If the image processor PR determines that the boundary is not positioned between two adjacent light-emitting segments having different amounts of light emission (No at Step S300), the image processor PR finishes the processing.

At Step S302, the image processor PR calculates the amount of light emission (La) from the first and the second virtual light sources for the pixels arranged within a range up to the m-th position in the directions away from the boundary on both sides thereof by Expression (3).

At Step S304, the image processor PR performs the first correction on the pixels arranged within the range up to the m-th position in the direction away from the boundary in the display segment having a relatively large amount of light emission.

At Step S306, the image processor PR performs the second correction on the pixels arranged within the range up to the m-th position in the direction away from the boundary in the display segment having a relatively small amount of light emission. Subsequently, the image processor PR finishes the processing.

Figure 13:
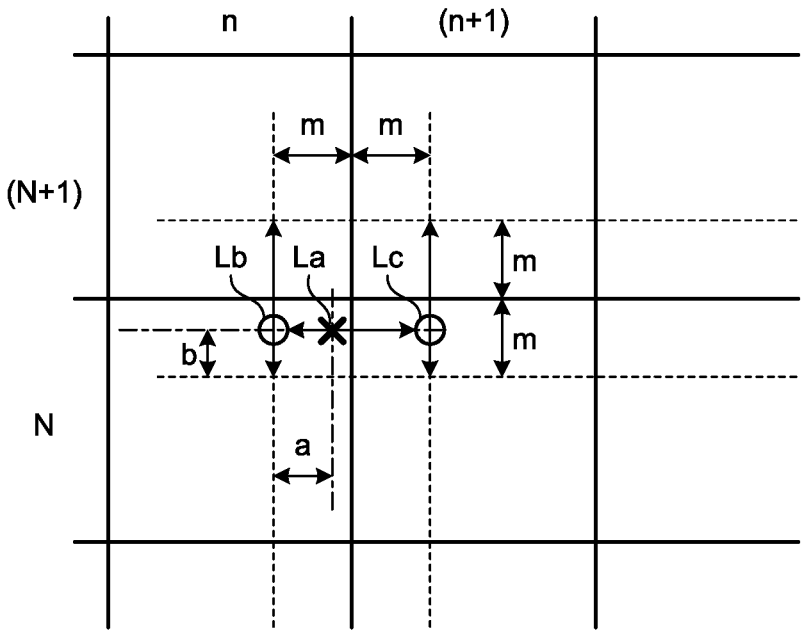
FIG. 13 is a diagram for explaining calculation of the luminance distribution at boundaries according to the embodiment.

FIG. 13 is a diagram for explaining calculation of the luminance distribution at boundaries according to the embodiment. Specifically, FIG. 13 is a diagram schematically illustrating an example of correction of the output gradation values in the X-direction and the Y-direction at a position where four display blocks are adjacently arranged.

As illustrated in FIG. 5, the display segments according to the present embodiment are aligned in the X-direction and the Y-direction. The image processor PR corrects the output gradation values both in the X-direction and the Y-direction. Specifically, as illustrated in FIG. 13, for example, the image processor PR corrects the output gradation values with respect to a combination of two display segments N and (N+1) aligned in the Y-direction using the same mechanism as that with respect to the combination of the display segments n and (n+1) described above. The image processor PR also corrects the output gradation values with respect to the combination of the two display segments n and (n+1) aligned in the X-direction.

More specifically, as illustrated in FIG. 13, LN is the amount of light emission from the light source 6*a* having a relatively small amount of light emission, and L(N+1) is the amount of light emission from the light source 6*a* having a relatively large amount of light emission, for example. The image processor PR calculates the amounts of light emission (Lb and Lc) from the second virtual light source that irradiates the b-th pixel Pix counting from the side farther from the boundary and on the side of the light source 6*a* having a relatively small amount of light emission out of the pixels Pix arranged within the range up to the m-th position in the direction away from the boundary. Here, Lb and Lc are the amounts of light emission from the second virtual light source at the pixels Pix present at the m-th (or m+1-th) position in the respective directions away from the boundary between the display segments n and (n+1).

In other words, Lb and Lc are the amounts of light emission at the same coordinate in the Y-direction. If the amount of light emission Lb from the second virtual light source in the display segment n is different from the amount of light emission Lc from the second virtual light source in the display segment (n+1), the image processor PR performs the first correction and the second correction. In the first correction, the image processor PR decreases the output gradation values of the pixels Pix arranged up to the m-th position in the direction away from the boundary with a second display segment corresponding to the second virtual light source having a relatively small amount of light emission out of the pixels Pix in a first display segment corresponding to the second virtual light source having a relatively large amount of light emission. In the second correction, the image processor PR increases the output gradation values of the pixels Pix arranged up to the m-th position in the direction away from the boundary out of the pixels Pix in the second display segment.

L(n+1) is the amount of light emission from the second virtual light source having a relatively large amount of light emission. Ln is the amount of light emission from the second virtual light source having a relatively small amount of light emission. The image processor PR according to the present embodiment calculates the amount of light emission (La) from the second virtual light source (or the first virtual light source) that irradiates the a-th pixel Pix counting from the side farther from the boundary and on the side of the light source 6*a* having a relatively small amount of light emission out of the pixels Pix arranged within the range up to the m-th position in the direction away from the boundary. If the relation of relative brightness is opposite to that described above in the combination of the two display segments N and (N+1), Lb and Lc are the amounts of light emission from the first virtual light source. Also in this case, the first correction and the second correction are performed in the X-direction.

In the description above, the image processor PR calculates the amount of light emission (e.g., the amounts of light emission Lb and Lc) from the first virtual light source and the second virtual light source in the Y-direction first, and then calculates the amount of light emission (La) from the first virtual light source and the second virtual light source in the X-direction. Alternatively, the image processor PR may calculate the amount of light emission from the first virtual light source and the second virtual light source in the X-direction first, and then calculate the amount of light emission from the first virtual light source and the second virtual light source in the Y-direction.

The present embodiment determines the amount of light emission from one light source 6*a* corresponding to one display segment DSEG in accordance with the luminance of light necessary for the display segment DSEG, and performs local dimming by processing performed independently of the luminance distribution (e.g., the luminance distribution $T_2$) of the respective light sources 6*a*. With this mechanism, the present embodiment does not require any resources used to perform an arithmetic operation for deriving the luminance distribution (e.g., the luminance distribution $T_2$) by synthesizing the patterns of luminance distribution of a plurality of light sources 6*a* and to hold the patterns of luminance distribution of the respective light sources 6*a*. Consequently, the present embodiment can perform local dimming with a smaller load. In addition, the present embodiment performs the first correction and the second correction. Consequently, the present embodiment can perform local dimming while making the boundaries less likely to be visually recognized.

If m is equal to or larger than 2, the present embodiment increases the degree of correction on the output gradation values of the pixels Pix positioned closer to the boundary in the first correction and the second correction. As a result, the present embodiment can reduce the difference in luminance between two light sources 6*a* corresponding to respective two partial regions adjacent to each other across the boundary. Consequently, the present embodiment can perform local dimming while making the boundaries less likely to be visually recognized.

The present embodiment determines the amount of light emission La from the first virtual light source or the second virtual light source using Expression (3) based on Expression (2). As a result, the present embodiment can formulate the processing of reducing the difference in luminance between the two light sources 6*a* corresponding to the respective two partial regions adjacent to each other across the boundary. Consequently, the present embodiment can perform local dimming with a smaller load while making the boundaries less likely to be visually recognized.

If no image object is displayed in either of the two partial regions adjacent to each other across the boundary, the image processor PR need not perform the calculation of the luminance distribution described above on the boundary between the two display segments.

As illustrated in FIG. 9, for example, no image object is displayed in the display segment $DSEG_{(3,0)}$ in the display block $DBLK_0$ or the display segment $DSEG_{(4,0)}$ in the display block $DBLK_1$.

As illustrated in FIG. 10, the light-emitting segment $LSEG_{(3,0)}$ in the light-emitting block $LBLK_0$ is adjusted to 0% of the rated light emission amount as a panel, and the light-emitting segment $LSEG_{(4,0)}$ in the light-emitting block $LBLK_1$ is adjusted to 90% of the rated light emission amount as a panel. The display segments $DSEG_{(3,0)}$ and $DSEG_{(4,0)}$ both display black because no image object is displayed in the display segment $DSEG_{(3,0)}$ or the display segment $DSEG_{(4,0)}$. As a result, the image processor PR need not perform the calculation of the luminance distribution described above on the boundary between the display segments $DSEG_{(3,0)}$ and $DSEG_{(4,0)}$.

In other words, the image processer PR simply needs to perform the calculation of the luminance distribution described above on a boundary between two display segments DSEG adjacent to each other across the boundary only when an image object is displayed in at least one of the two display segments DSEG. With this mechanism, the image processor PR can reduce the amount of calculation.

Configuration and Operations of the Image Processor

Figure 14:
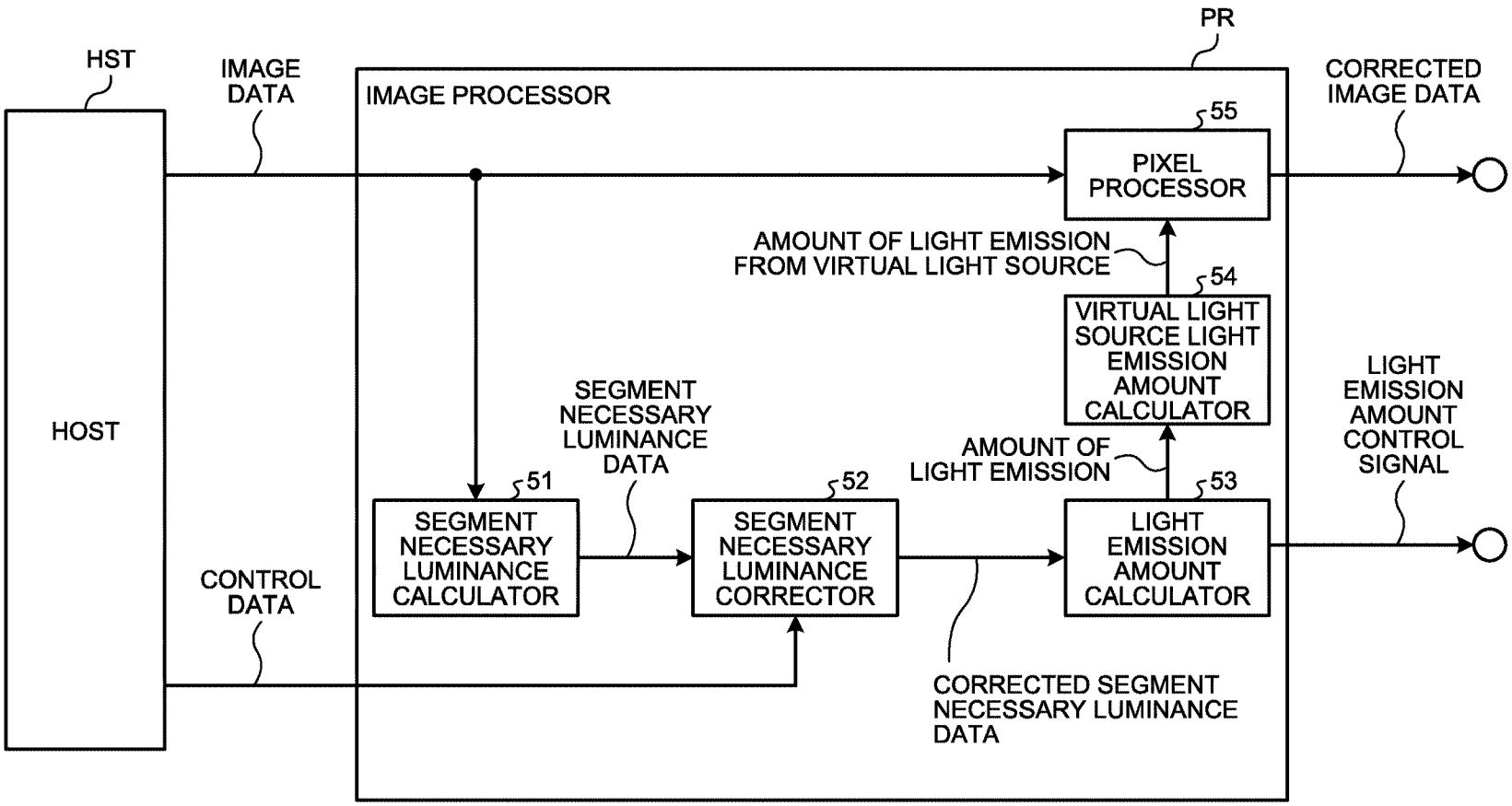
FIG. 14 is a diagram illustrating functional blocks of an image processor of the display apparatus according to the embodiment.

FIG. 14 is a diagram illustrating functional blocks of the image processor of the display apparatus according to the embodiment. The image processor PR includes a segment necessary luminance calculator 51, a segment necessary luminance corrector 52, a light emission amount calculator 53, a virtual light source light emission amount calculator 54, and a pixel processor 55.

The image processor PR is supplied with image data from the host HST. The image processor PR according to the present embodiment is supplied with image data for displaying the image illustrated in FIG. 9 from the host HST.

The image processor PR is supplied with control data for dividing the display region 21 into the display blocks $DBLK_0$ to $DBLK_{11}$ and dividing the light-emitting region 31 into the light-emitting blocks $LBLK_0$ to $LBLK_{11}$ from the host HST.

Figure 15:
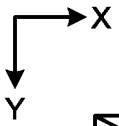
FIG. 15 is a diagram illustrating control data supplied to the display apparatus according to the embodiment.

FIG. 15 is a diagram illustrating the control data supplied to the display apparatus according to the embodiment.

Control data cont_h is 9×8-bit, that is, 72-bit data. While the control data cont_h is illustrated as a two-dimensional array in FIG. 15, the data structure is not limited thereto. The control data cont_h may be a simple bit string of 72 bits in length.

The control data cont_h[x][y] indicates whether the boundary between two adjacent display segments $DSEG_{(x,y)}$ and $DSEG_{(x+1,y)}$ is a block boundary, and whether the boundary between two adjacent light-emitting segments $LSEG_{(x,y)}$ and $LSEG_{(x+1,y)}$ is a block boundary. The reference numerals x in the X-direction in FIG. 15 correspond to the respective boundaries between the reference numerals x and (x+1) in the X-direction of the display segments DBLK in FIG. 9. The reference numerals y in the Y-direction in FIG. 15 correspond to the respective reference numerals y in the Y-direction of the display segments DBLK in FIG. 9.

As illustrated in FIG. 9, for example, the display segment $DSEG_{(3,0)}$ is included in the display block $DBLK_0$, and the display segment $DSEG_{(4,0)}$ is included in the display block $DBLK_1$. The control data cont_h[3][0] illustrated in FIG. 15 is set to "0" indicating that the boundary between the two adjacent display segments $DSEG_{(3,0)}$ and $DSEG_{(4,0)}$ is a block boundary. The control data cont_h[3][0] also indicates that the boundary between the two adjacent light-emitting segments $LSEG_{(3,0)}$ and $LSEG_{(4,0)}$ is a block boundary.

In other words, the control data cont_h[3][0] indicates that the two adjacent display segments $DSEG_{(3,0)}$ and $DSEG_{(4,0)}$ are not included in a single display block. The control data cont_h[3][0] also indicates that the two adjacent light-emitting segments $LSEG_{(3,0)}$ and $LSEG_{(4,0)}$ are not included in a single light-emitting block.

As illustrated in FIG. 9, for example, the display segments $DSEG_{(0,0)}$ and $DSEG_{(1,0)}$ are included in the single display block $DBLK_0$. The control data cont_h[0][0] illustrated in FIG. 15 is set to "1" indicating that the boundary between the two adjacent display segments $DSEG_{(0,0)}$ and $DSEG_{(1,0)}$ is not a block boundary. The control data cont_h[0][0] also indicates that the boundary between the two adjacent light-emitting segments $LSEG_{(0,0)}$ and $LSEG_{(1,0)}$ is not a block boundary.

In other words, the control data cont_h[0][0] indicates that the two adjacent display segments $DSEG_{(0,0)}$ and $DSEG_{(1,0)}$ are included in a single display block. The control data cont_h[0][0] also indicates that the two adjacent light-emitting segments $LSEG_{(0,0)}$ and $LSEG_{(1,0)}$ are included in a single light-emitting block.

Figure 16:
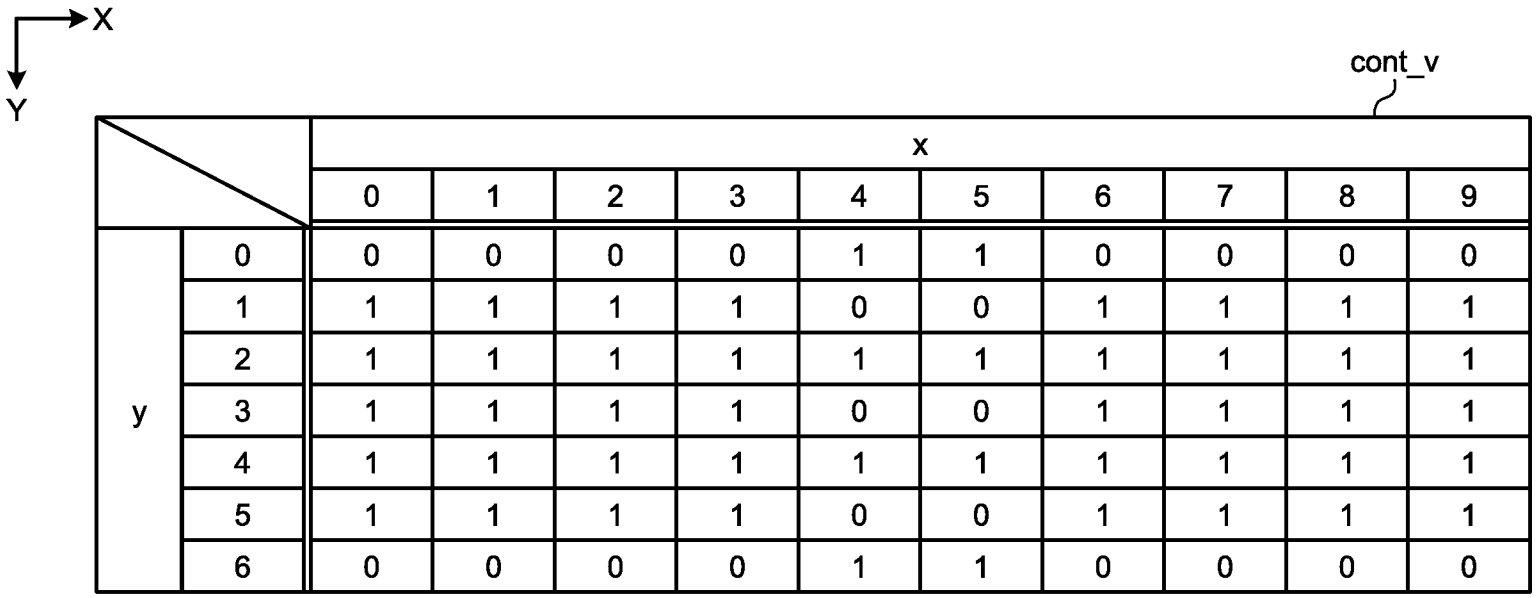
FIG. 16 is a diagram illustrating control data supplied to the display apparatus according to the embodiment.

FIG. 16 is a diagram illustrating the control data supplied to the display apparatus according to the embodiment.

Control data cont_v is 10×7-bit, that is, 70-bit data. While the control data cont_v is illustrated as a two-dimensional array in FIG. 16, the data structure is not limited thereto. The control data cont_v may be a simple bit string of 70 bits in length.

The control data cont_v[x][y] indicates whether the boundary between display segments $DSEG_{(x,y)}$ and $DSEG_{(x,y+1)}$ is a block boundary, and whether the boundary between two adjacent light-emitting segments $LSEG_{(x,y)}$ and $LSEG_{(x,y+1)}$ is a block boundary. The reference numerals x in the X-direction in FIG. 16 correspond to the respective reference numerals x in the X-direction of the display segments DBLK in FIG. 9. The reference numerals y in the Y-direction in FIG. 16 correspond to the respective boundaries between the reference numerals y and (y+1) in the Y-direction of the display segments DBLK in FIG. 9.

As illustrated in FIG. 9, for example, the display segment $DSEG_{(0,0)}$ is included in the display block $DBLK_0$, and the display segment $DSEG_{(0,1)}$ is included in the display block $DBLK_3$. The control data cont_v[0][0] illustrated in FIG. 16 is set to "0" indicating that the boundary between the two adjacent display segments $DSEG_{(0,0)}$ and $DSEG_{(0,1)}$ is a block boundary. The control data cont_v[0][0] also indicates that the boundary between the two adjacent light-emitting segments $LSEG_{(0,0)}$ and $LSEG_{(0,1)}$ is a block boundary.

In other words, the control data cont_v[0][0] indicates that the two adjacent display segments $DSEG_{(0,0)}$ and $DSEG_{(0,1)}$ are not included in a single display block. The control data cont_v[0][0] also indicates that the two adjacent light-emitting segments $LSEG_{(0,0)}$ and $LSEG_{(0,1)}$ are not included in a single light-emitting block.

As illustrated in FIG. 9, for example, the display segments $DSEG_{(0,1)}$ and $DSEG_{(0,2)}$ are included in the single display block $DBLK_3$. The control data cont_v[0][1] illustrated in FIG. 16 is set to "1" indicating that the boundary between the two adjacent display segments $DSEG_{(0,1)}$ and $DSEG_{(0,2)}$ is not a block boundary. The control data cont_v[0][1] also indicates that the boundary between the two adjacent light-emitting segments $LSEG_{(0,1)}$ and $LSEG_{(0,2)}$ is not a block boundary.

In other words, the control data cont_v[0][1] indicates that the two adjacent display segments $DSEG_{(0,1)}$ and $DSEG_{(0,2)}$ are included in a single display block. The control data cont_v[0][1] also indicates that the two adjacent light-emitting segments $LSEG_{(0,1)}$ and $LSEG_{(0,2)}$ are included in a single light-emitting block.

Figure 17:
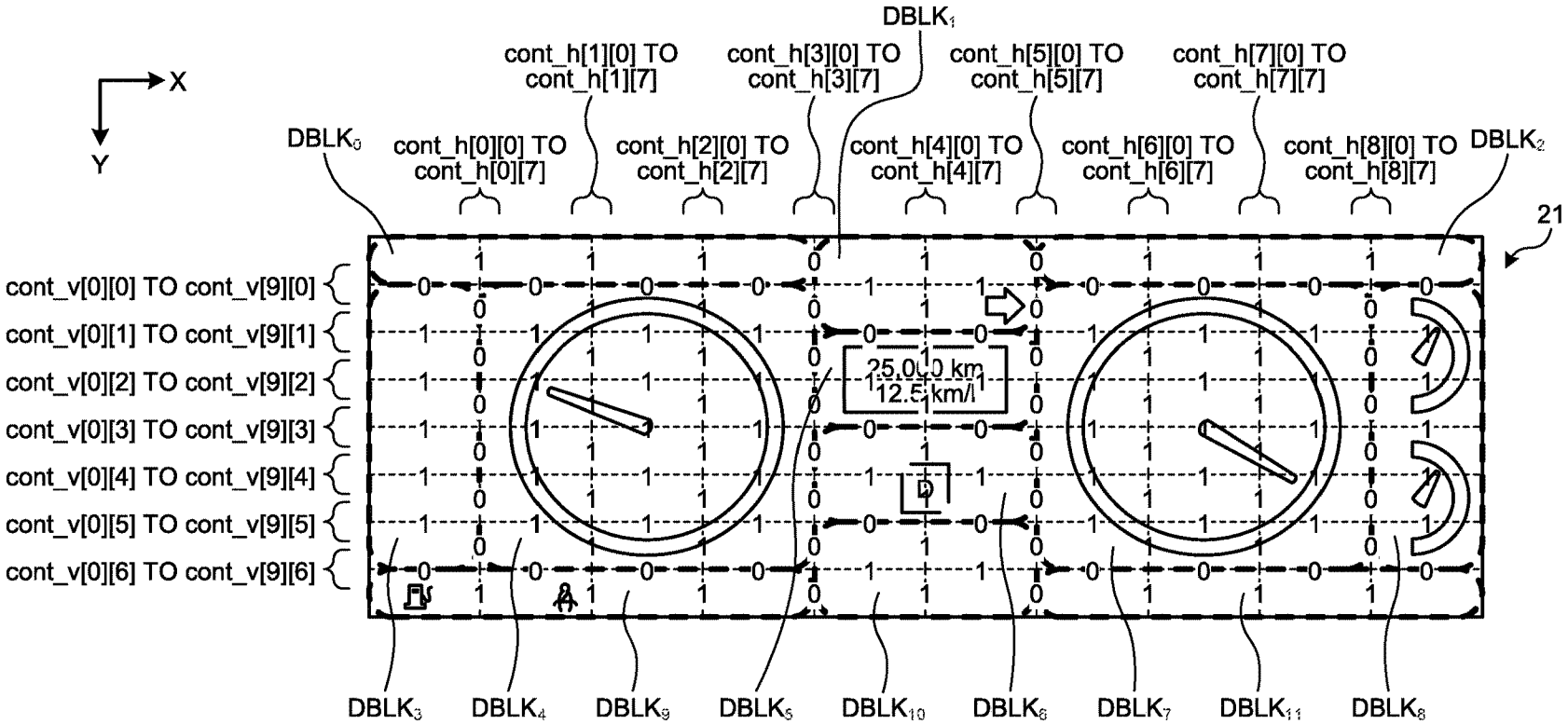
FIG. 17 is a schematic diagram illustrating correspondence between display segments and the control data according to the embodiment.

FIG. 17 is a schematic diagram illustrating correspondence between the display segments and the control data according to the embodiment. Specifically, FIG. 17 is a diagram obtained by superimposing corresponding bits in the control data cont_h and cont_v on the respective boundaries between the display segments. FIG. 17 is just a schematic diagram, and the control data cont_h or cont_v is not displayed on the display device DP in the actual configuration.

As illustrated in FIG. 17, the image processor PR can divide the display region 21 into the display blocks $DBLK_0$ to $DBLK_{11}$ using the control data cont_h and cont_v. The image processor PR can also divide the light-emitting region 31 into the light-emitting blocks $LBLK_0$ to $LBLK_{11}$ using the control data cont_h and cont_v.

While the control data cont_h and the control data cont_v according to the present embodiment are different pieces of data, the data structure is not limited thereto. The control data cont_h and cont_v may be one piece of data of 142 bits in length.

Referring back to FIG. 14, the segment necessary luminance calculator 51 calculates the luminance necessary for the light-emitting segments LSEG in accordance with the image data supplied from the host HST. The segment necessary luminance calculator 51 can calculate the luminance necessary for the light-emitting segments LSEG using an image analysis technology employed in the conventional local dimming method. The segment necessary luminance calculator 51 creates segment necessary luminance data $1/\alpha$ including the luminance necessary for the light-emitting segments LSEG. Here, $\alpha$ is an extension coefficient.

Figure 18:
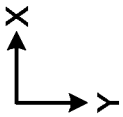
FIG. 18 is a diagram illustrating segment necessary luminance data according to the embodiment.

FIG. 18 is a diagram illustrating the segment necessary luminance data according to the embodiment. The segment necessary luminance data $1/\alpha$ includes $10\times8=80$ elements correspondingly to the respective light-emitting segments LSEG. The elements of the segment necessary luminance data $1/\alpha$ each include a value indicating the luminance necessary for the respective light-emitting segments in percentage with respect to rated luminance.

Referring back to FIG. 14, the segment necessary luminance corrector 52 corrects the values in the segment necessary luminance data $1/\alpha$ in accordance with the highest luminance of one or a plurality of light-emitting segments LSEG included in the light-emitting block LBLK for each of the light-emitting blocks $LBLK_0$ to $LBLK_{11}$, in accordance with the control data cont_h and cont_v supplied from the host HST and the segment necessary luminance data $1/\alpha$ calculated by the segment necessary luminance calculator 51.

Figure 19:
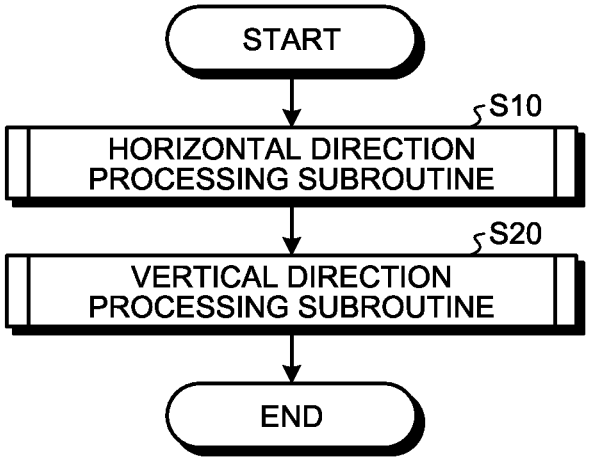
FIG. 19 is a flowchart for processing performed by a segment necessary luminance corrector according to the embodiment.
Figure 20:
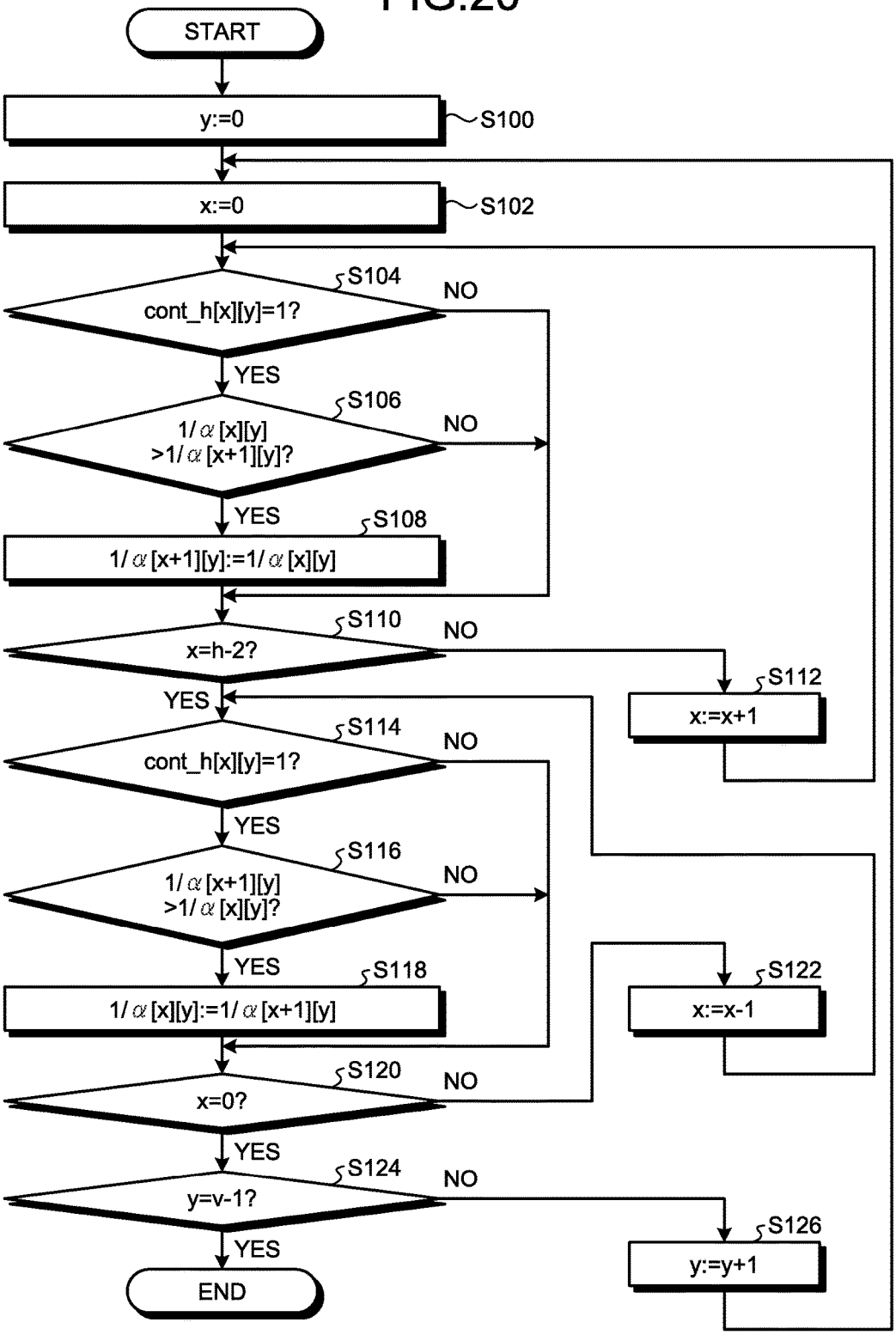
FIG. 20 is a flowchart for processing performed by the segment necessary luminance corrector according to the embodiment.
Figure 21:
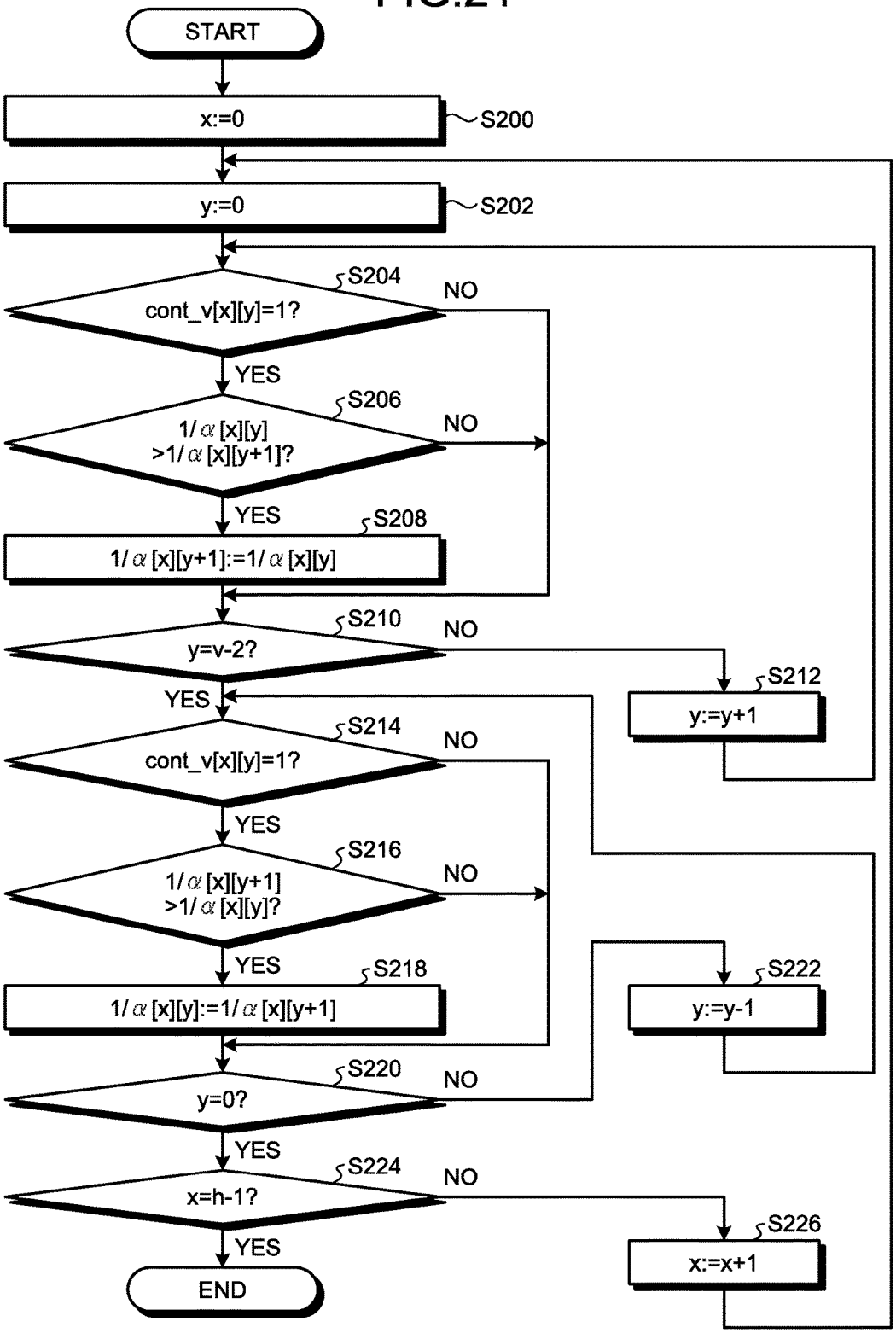
FIG. 21 is a flowchart for processing performed by the segment necessary luminance corrector according to the embodiment.

FIGS. 19 to 21 are flowcharts for processing performed by the segment necessary luminance corrector according to the embodiment. In FIGS. 19 to 21, a constant h is the number of division (10 in the present embodiment) in the horizontal direction of the light-emitting region 31. A constant v is the number of division (8 in the present embodiment) in the vertical direction of the light-emitting region 31.

As illustrated in FIG. 19, the segment necessary luminance corrector 52 performs a horizontal direction processing subroutine at Step S10. FIG. 20 is a flowchart for the horizontal direction processing subroutine according to the embodiment.

As illustrated in FIG. 20, the segment necessary luminance corrector 52 initializes a variable y to "0" at Step S100. The variable y is used to refer to the control data cont_h[x][y] in FIG. 15 and indicates the position in the Y-direction.

At Step S102, the segment necessary luminance corrector 52 initializes a variable x to "0". The variable x is used to refer to the control data cont_h[x][y] in FIG. 15 and indicates the position in the X-direction.

At Step S104, the segment necessary luminance corrector 52 determines whether the control data cont_h[x][y] is "1". In other words, the segment necessary luminance corrector 52 determines whether the boundary between two adjacent light-emitting segments $LSEG_{(x,y)}$ and $LSEG_{(x+1,y)}$ is not a block boundary and the two adjacent light-emitting segments $LSEG_{(x,y)}$ and $LSEG_{(x+1,y)}$ are included in a single light-emitting block.

If the segment necessary luminance corrector 52 determines that the control data cont_h[x][y] is "1" (Yes at Step S104), the segment necessary luminance corrector 52 performs the processing at Step S106. If the segment necessary luminance corrector 52 determines that the control data cont_h[x][y] is not "1" (No at Step S104), the segment necessary luminance corrector 52 performs the processing at Step S110.

At Step S106, the segment necessary luminance corrector 52 determines whether segment necessary luminance data $1/\alpha$[x][y] is larger than segment necessary luminance data $1/\alpha$[x+1][y]. If the segment necessary luminance corrector 52 determines that the segment necessary luminance data $1/\alpha$[x][y] is larger than the segment necessary luminance data $1/\alpha$[x+1][y] (Yes at Step S106), the segment necessary luminance corrector 52 performs the processing at Step S108. If the segment necessary luminance corrector 52 determines that the segment necessary luminance data $1/\alpha$[x][y] is not larger than the segment necessary luminance data $1/\alpha$[x+1][y] (No at Step S106), the segment necessary luminance corrector 52 performs the processing at Step S110.

At Step S108, the segment necessary luminance corrector 52 substitutes the segment necessary luminance data $1/\alpha$[x][y] into the segment necessary luminance data $1/\alpha$[x+l][y]. In other words, the segment necessary luminance data $1/\alpha$[x+1][y] is a larger one of the segment necessary luminance data $1/\alpha$[x][y] and the segment necessary luminance data $1/\alpha$[x+1][y].

At Step S110, the segment necessary luminance corrector 52 determines whether the variable x is equal to a value (8 in the present embodiment) obtained by subtracting "2" from the constant h. In other words, the segment necessary luminance corrector 52 starts the processing from the beginning of one row in the light-emitting region 31, and determines whether it completes the processing to the end of the row. This is because, in a case where the number of blocks in the horizontal direction is h, the block number takes 0 to (h−1), and the number of boundaries is (h−1). As a result, the array indicating the boundaries between the blocks takes 0 to (h−2).

If the segment necessary luminance corrector 52 determines that the variable x is not equal to a value (8 in the present embodiment) obtained by subtracting "2" from the constant h (No at Step S110), the segment necessary luminance corrector 52 performs the processing at Step S112. If the segment necessary luminance corrector 52 determines that the variable x is equal to a value (8 in the present embodiment) obtained by subtracting "2" from the constant h (Yes at Step S110), the segment necessary luminance corrector 52 performs the processing at Step S114.

The segment necessary luminance corrector 52 increments the variable x at Step S112 and then performs the processing at Step S104.

At Step S114, the segment necessary luminance corrector 52 determines whether the control data cont_h[x][y] is "1". In other words, the segment necessary luminance corrector 52 determines whether the boundary between two adjacent light-emitting segments $LSEG_{(x,y)}$ and $LSEG_{(x+1,y)}$ is not a block boundary and the two adjacent light-emitting segments $LSEG_{(x,y)}$ and $LSEG_{(x+1,y)}$ are included in a single light-emitting block.

If the segment necessary luminance corrector 52 determines that the control data cont_h[x][y] is "1" (Yes at Step S114), the segment necessary luminance corrector 52 performs the processing at Step S116. If the segment necessary luminance corrector 52 determines that the control data cont_h[x][y] is not "1" (No at Step S114), the segment necessary luminance corrector 52 performs the processing at Step S120.

At Step S116, the segment necessary luminance corrector 52 determines whether the segment necessary luminance data 1/α[x+1][y] is larger than the segment necessary luminance data 1/α[x][y]. If the segment necessary luminance corrector 52 determines that the segment necessary luminance data 1/α[x+1][y] is larger than the segment necessary luminance data 1/α[x][y] (Yes at Step S116), the segment necessary luminance corrector 52 performs the processing at Step S118. If the segment necessary luminance corrector 52 determines that the segment necessary luminance data 1/α[x+1][y] is not larger than the segment necessary luminance data 1/α[x][y] (No at Step S116), the segment necessary luminance corrector 52 performs the processing at Step S120.

At Step S118, the segment necessary luminance corrector 52 substitutes the segment necessary luminance data 1/α[x+1][y] into the segment necessary luminance data 1/α[x][y]. In other words, the segment necessary luminance data 1/α[x][y] is a larger one of the segment necessary luminance data 1/α[x][y] and the segment necessary luminance data 1/α[x+1][y].

At Step S120, the segment necessary luminance corrector 52 determines whether the variable x is equal to "0". In other words, the segment necessary luminance corrector 52 starts the processing from the end of one row in the light-emitting region 31, and determines whether it completes the processing to the beginning of the row.

If the segment necessary luminance corrector 52 determines that the variable x is not equal to "0" (No at Step S120), the segment necessary luminance corrector 52 performs the processing at Step S122. If the segment necessary luminance corrector 52 determines that the variable x is equal to "0" (Yes at Step S120), the segment necessary luminance corrector 52 performs the processing at Step S124.

The segment necessary luminance corrector 52 decrements the variable x at Step S122 and then performs the processing at Step S114.

At Step S124, the segment necessary luminance corrector 52 determines whether the variable y is equal to a value (7 in the present embodiment) obtained by subtracting "1" from the constant v. In other words, the segment necessary luminance corrector 52 starts the processing from the first row in the light-emitting region 31, and determines whether it completes the processing to the last row. This is because, in a case where the number of blocks in the vertical direction is v, the block number takes 0 to (v−1).

If the segment necessary luminance corrector 52 determines that the variable y is not equal to a value (7 in the present embodiment) obtained by subtracting "1" from the constant v (No at Step S124), the segment necessary luminance corrector 52 performs the processing at Step S126. The segment necessary luminance corrector 52 increments the variable y at Step S126 and then performs the processing at Step S102.

If the segment necessary luminance corrector 52 determines that the variable y is equal to a value (7 in the present embodiment) obtained by subtracting "1" from the constant v (Yes at Step S124), the segment necessary luminance corrector 52 finishes the horizontal direction processing subroutine.

FIG. 22 is a diagram illustrating the segment necessary luminance data according to the embodiment. FIG. 22 is a diagram illustrating the segment necessary luminance data 1/α obtained by performing the horizontal direction processing subroutine illustrated in FIG. 20 on the segment necessary luminance data 1/α illustrated in FIG. 18.

When a comparison is made between FIG. 22 and FIG. 18, the segment necessary luminance data 1/α[4][1] is corrected from "0%" to "90%" in FIG. 22. This is because the segment necessary luminance corrector 52 determines that the segment necessary luminance data 1/α[5][1] is larger than the segment necessary luminance data 1/α[4][1] at Step S116 in FIG. 20 and then substitutes the segment necessary luminance data 1/α[5][1] into the segment necessary luminance data 1/α[4][1] at Step S118.

When a comparison is made between FIG. 22 and FIG. 18, the segment necessary luminance data 1/α[2][2] is corrected from "0%" to "50%" in FIG. 22. This is because the segment necessary luminance corrector 52 determines that the segment necessary luminance data 1/α[1][2] is larger than the segment necessary luminance data 1/α[2][2] at Step S106 in FIG. 20 and substitutes the segment necessary luminance data 1/α[1][2] into the segment necessary luminance data 1/α[2][2] at Step S108.

When a comparison is made between FIG. 22 and FIG. 18, the segment necessary luminance data 1/α[3][3] is corrected from "50%" to "100%" in FIG. 22. This is because the segment necessary luminance corrector 52 determines that the segment necessary luminance data 1/α[2][3] is larger than the segment necessary luminance data 1/α[3][3] at Step S106 in FIG. 20 and substitutes the segment necessary luminance data 1/α[2][3] into the segment necessary luminance data 1/α[3][3] at Step S108.

When a comparison is made between FIG. 22 and FIG. 18, the segment necessary luminance data 1/α[1][4] is corrected from "50%" to "100%" in FIG. 22. This is because the segment necessary luminance corrector 52 determines that the segment necessary luminance data 1/α[2][4] is larger than the segment necessary luminance data 1/α[1][4] at Step S116 in FIG. 20 and substitutes the segment necessary luminance data 1/α[2][4] into the segment necessary luminance data 1/α[1][4] at Step S118.

When a comparison is made between FIG. 22 and FIG. 18, the segment necessary luminance data 1/α[3][4] is corrected from "50%" to "100%" in FIG. 22. This is because the segment necessary luminance corrector 52 determines that the segment necessary luminance data 1/α[2][4] is larger than the segment necessary luminance data 1/α[3][4] at Step S106 in FIG. 20 and substitutes the segment necessary luminance data 1/α[2][4] into the segment necessary luminance data 1/α[3][4] at Step S108.

When a comparison is made between FIG. 22 and FIG. 18, the segment necessary luminance data 1/α[2][5] is corrected from "0%" to "50%" in FIG. 22. This is because the segment necessary luminance corrector 52 determines that the segment necessary luminance data 1/α[1][5] is larger than the segment necessary luminance data 1/α[2][5] at Step S106 in FIG. 20 and substitutes the segment necessary luminance data 1/α[1][5] into the segment necessary luminance data 1/α[2][5] at Step S108.

When a comparison is made between FIG. 22 and FIG. 18, the segment necessary luminance data 1/α[7][2] is corrected from "0%" to "50%" in FIG. 22. This is because the segment necessary luminance corrector 52 determines that the segment necessary luminance data 1/α[6][2] is larger than the segment necessary luminance data 1/α[7][2] at Step S106 in FIG. 20 and substitutes the segment necessary luminance data 1/α[6][2] into the segment necessary luminance data 1/α[7][2] at Step S108.

When a comparison is made between FIG. 22 and FIG. 18, the segment necessary luminance data 1/α[6][3] is corrected from "50%" to "100%" in FIG. 22. This is because the segment necessary luminance corrector 52 determines that the segment necessary luminance data 1/α[7][3] is larger than the segment necessary luminance data 1/α[6][3] at Step S116 in FIG. 20 and substitutes the segment necessary luminance data 1/α[7][3] into the segment necessary luminance data 1/α[6][3] at Step S118.

When a comparison is made between FIG. 22 and FIG. 18, the segment necessary luminance data 1/α[8][3] is corrected from "50%" to "100%" in FIG. 22. This is because the segment necessary luminance corrector 52 determines that the segment necessary luminance data 1/α[7][3] is larger than the segment necessary luminance data 1/α[8][3] at Step S106 in FIG. 20 and substitutes the segment necessary luminance data 1/α[7][3] into the segment necessary luminance data 1/α[8][3] at Step S108.

When a comparison is made between FIG. 22 and FIG. 18, the segment necessary luminance data 1/α[6][4] is corrected from "50%" to "100%" in FIG. 22. This is because the segment necessary luminance corrector 52 determines that the segment necessary luminance data 1/α[7][4] is larger than the segment necessary luminance data 1/α[6][4] at Step S116 in FIG. 20 and substitutes the segment necessary luminance data 1/α[7][4] into the segment necessary luminance data 1/α[6][4] at Step S118.

When a comparison is made between FIG. 22 and FIG. 18, the segment necessary luminance data 1/α[7][5] is corrected from "0%" to "100%" in FIG. 22. This is because the segment necessary luminance corrector 52 determines that the segment necessary luminance data 1/α[8][5] is larger than the segment necessary luminance data 1/α[7][5] at Step S116 in FIG. 20 and substitutes the segment necessary luminance data 1/α[8][5] into the segment necessary luminance data 1/α[7][5] at Step S118.

When a comparison is made between FIG. 22 and FIG. 18, the segment necessary luminance data 1/α[6][5] is corrected from "50%" to "100%" in FIG. 22. This is because the segment necessary luminance corrector 52 determines that the segment necessary luminance data 1/α[7][5] is larger than the segment necessary luminance data 1/α[6][5] at Step S116 in FIG. 20 and substitutes the segment necessary luminance data 1/α[7][5] into the segment necessary luminance data 1/α[6][5] at Step S118.

When a comparison is made between FIG. 22 and FIG. 18, the segment necessary luminance data 1/α[0][7] is corrected from "80%" to "90%" in FIG. 22. This is because the segment necessary luminance corrector 52 determines that the segment necessary luminance data 1/α[1][7] is larger than the segment necessary luminance data 1/α[0][7] at Step S116 in FIG. 20 and substitutes the segment necessary luminance data 1/α[1][7] into the segment necessary luminance data 1/α[0][7] at Step S118.

When a comparison is made between FIG. 22 and FIG. 18, the segment necessary luminance data 1/α[2][7] is corrected from "0%" to "90%" in FIG. 22. This is because the segment necessary luminance corrector 52 determines that the segment necessary luminance data 1/α[1][7] is larger than the segment necessary luminance data 1/α[2][7] at Step S106 in FIG. 20 and substitutes the segment necessary luminance data 1/α[1][7] into the segment necessary luminance data 1/α[2][7] at Step S108.

When a comparison is made between FIG. 22 and FIG. 18, the segment necessary luminance data 1/α[3][7] is corrected from "0%" to "90%" in FIG. 22. This is because the segment necessary luminance corrector 52 determines that the segment necessary luminance data 1/α[2][7] is larger than the segment necessary luminance data 1/α[3][7] at Step S106 in FIG. 20 and substitutes the segment necessary luminance data 1/α[2][7] into the segment necessary luminance data 1/α[3][7] at Step S108.

Referring back to FIG. 19, the segment necessary luminance corrector 52 performs a vertical direction processing subroutine at Step S20. FIG. 21 is a flowchart for the vertical direction processing subroutine according to the embodiment.

As illustrated in FIG. 21, the segment necessary luminance corrector 52 initializes the variable x to "0" at Step S200.

At Step S202, the segment necessary luminance corrector 52 initializes the variable y to "0".

At Step S204, the segment necessary luminance corrector 52 determines whether the control data cont_v[x][y] is "1". In other words, the segment necessary luminance corrector 52 determines whether the boundary between two adjacent light-emitting segments $LSEG_{(x,y)}$ and $LSEG_{(x,y+1)}$ is not a block boundary and the two adjacent light-emitting segments $LSEG_{(x,y)}$ and $LSEG_{(x,y+1)}$ are included in a single light-emitting block.

If the segment necessary luminance corrector 52 determines that the control data cont_v[x][y] is "1" (Yes at Step S204), the segment necessary luminance corrector 52 performs the processing at Step S206. If the segment necessary luminance corrector 52 determines that the control data cont_v[x][y] is not "1" (No at Step S204), the segment necessary luminance corrector 52 performs the processing at Step S210.

At Step S206, the segment necessary luminance corrector 52 determines whether the segment necessary luminance data 1/α[x][y] is larger than segment necessary luminance data 1/α[x][y+1]. If the segment necessary luminance corrector 52 determines that the segment necessary luminance data 1/α[x][y] is larger than the segment necessary luminance data 1/α[x][y+1] (Yes at Step S206), the segment necessary luminance corrector 52 performs the processing at Step S208. If the segment necessary luminance corrector 52 determines that the segment necessary luminance data 1/α[x][y] is not larger than the segment necessary luminance data 1/α[x][y+1] (No at Step S206), the segment necessary luminance corrector 52 performs the processing at Step S210.

At Step S208, the segment necessary luminance corrector 52 substitutes the segment necessary luminance data 1/α[x][y] into the segment necessary luminance data 1/α[x][y+1]. In other words, the segment necessary luminance data 1/α[x][y+1] is a larger one of the segment necessary luminance data 1/α[x][y] and the segment necessary luminance data 1/α[x][y+1].

At Step S210, the segment necessary luminance corrector 52 determines whether the variable y is equal to a value (6 in the present embodiment) obtained by subtracting "2" from the constant v. In other words, the segment necessary luminance corrector 52 starts the processing from the beginning of one column in the light-emitting region 31, and determines whether it completes the processing to the end of the column. This is because, in a case where the number of blocks in the vertical direction is v, the block number takes 0 to (v−1), and the number of boundaries is (v−1). As a result, the array indicating the boundaries between the blocks takes 0 to (v−2).

If the segment necessary luminance corrector 52 determines that the variable y is not equal to a value (6 in the present embodiment) obtained by subtracting "2" from the constant v (No at Step S210), the segment necessary luminance corrector 52 performs the processing at Step S212. If the segment necessary luminance corrector 52 determines that the variable y is equal to a value (6 in the present embodiment) obtained by subtracting "2" from the constant v (Yes at Step S210), the segment necessary luminance corrector 52 performs the processing at Step S214.

The segment necessary luminance corrector 52 increments the variable y at Step S212 and then performs the processing at Step S204.

At Step S214, the segment necessary luminance corrector 52 determines whether the control data cont_v[x][y] is "1". In other words, the segment necessary luminance corrector 52 determines whether the boundary between two adjacent light-emitting segments $LSEG_{(x,y)}$ and $LSEG_{(x,y+1)}$ is not a block boundary and the two adjacent light-emitting segments $LSEG_{(x,y)}$ and $LSEG_{(x,y+1)}$ are included in a single light-emitting block.

If the segment necessary luminance corrector 52 determines that the control data cont_v[x][y] is "1" (Yes at Step S214), the segment necessary luminance corrector 52 performs the processing at Step S216. If the segment necessary luminance corrector 52 determines that the control data cont_v[x][y] is not "1" (No at Step S214), the segment necessary luminance corrector 52 performs the processing at Step S220.

At Step S216, the segment necessary luminance corrector 52 determines whether the segment necessary luminance data 1/α[x][y+1] is larger than the segment necessary luminance data 1/α[x][y]. If the segment necessary luminance corrector 52 determines that the segment necessary luminance data 1/α[x][y+1] is larger than the segment necessary luminance data 1/α[x][y] (Yes at Step S216), the segment necessary luminance corrector 52 performs the processing at Step S218. If the segment necessary luminance corrector 52 determines that the segment necessary luminance data 1/α[x][y+1] is not larger than the segment necessary luminance data 1/α[x][y] (No at Step S216), the segment necessary luminance corrector 52 performs the processing at Step S220.

At Step S218, the segment necessary luminance corrector 52 substitutes the segment necessary luminance data 1/α[x][y+1] into the segment necessary luminance data 1/α[x][y]. In other words, the segment necessary luminance data 1/α[x][y] is a larger one of the segment necessary luminance data 1/α[x][y] and the segment necessary luminance data 1/α[x][y+1].

At Step S220, the segment necessary luminance corrector 52 determines whether the variable y is equal to "0". In other words, the segment necessary luminance corrector 52 starts the processing from the end of one column in the light-emitting region 31, and determines whether it completes the processing to the beginning of the column.

If the segment necessary luminance corrector 52 determines that the variable y is not equal to "0" (No at Step S220), the segment necessary luminance corrector 52 performs the processing at Step S222. If the segment necessary luminance corrector 52 determines that the variable y is equal to "0" (Yes at Step S220), the segment necessary luminance corrector 52 performs the processing at Step S224.

The segment necessary luminance corrector 52 decrements the variable y at Step S222 and then performs the processing at Step S214.

At Step S224, the segment necessary luminance corrector 52 determines whether the variable x is equal to a value (9 in the present embodiment) obtained by subtracting "1" from the constant h. In other words, the segment necessary luminance corrector 52 starts the processing from the first column in the light-emitting region 31, and determines whether it completes the processing to the last column. This is because, in a case where the number of blocks in the horizontal direction is h, the block number takes 0 to (h−1).

If the segment necessary luminance corrector 52 determines that the variable x is not equal to a value (9 in the present embodiment) obtained by subtracting "1" from the constant h (No at Step S224), the segment necessary luminance corrector 52 performs the processing at Step S226. The segment necessary luminance corrector 52 increments the variable x at Step S226 and then performs the processing at Step S202.

If the segment necessary luminance corrector 52 determines that the variable x is equal to a value (9 in the present embodiment) obtained by subtracting "1" from the constant h (Yes at Step S224), the segment necessary luminance corrector 52 finishes the vertical direction processing subroutine.

As illustrated in FIG. 19, the present embodiment performs the horizontal direction processing subroutine S10 first and then performs the vertical direction processing subroutine S20. Alternatively, the present embodiment may perform the vertical direction processing subroutine S20 first and then perform the horizontal direction processing subroutine S10.

Figure 23:
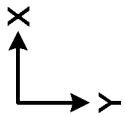
FIG. 23 is a diagram illustrating the segment necessary luminance data according to the embodiment.

FIG. 23 is a diagram illustrating the segment necessary luminance data according to the embodiment. Specifically, FIG. 23 is a diagram illustrating the segment necessary luminance data 1/α obtained by performing the vertical direction processing subroutine illustrated in FIG. 21 on the segment necessary luminance data 1/α illustrated in FIG. 22.

When a comparison is made between FIG. 23 and FIG. 22, the segment necessary luminance data 1/α[4][0] is corrected from "0%" to "90%" in FIG. 23. This is because the segment necessary luminance corrector 52 determines that the segment necessary luminance data 1/α[4][1] is larger than the segment necessary luminance data 1/α[4][0] at Step S216 in FIG. 21 and substitutes the segment necessary luminance data 1/α[4][1] into the segment necessary luminance data 1/α[4][0] at Step S218.

When a comparison is made between FIG. 23 and FIG. 22, the segment necessary luminance data 1/α[5][0] is corrected from "0%" to "90%" in FIG. 23. This is because the segment necessary luminance corrector 52 determines that the segment necessary luminance data 1/α[5][1] is larger than the segment necessary luminance data 1/α[5][0] at Step S216 in FIG. 21 and substitutes the segment necessary luminance data 1/α[5][1] into the segment necessary luminance data 1/α[5][0] at Step S218.

When a comparison is made between FIG. 23 and FIG. 22, the segment necessary luminance data 1/α[1][2] is corrected from "50%" to "100%" in FIG. 23. This is because the segment necessary luminance corrector 52 determines that the segment necessary luminance data 1/α[1][3] is larger than the segment necessary luminance data 1/α[1][2] at Step S216 in FIG. 21 and substitutes the segment necessary luminance data 1/α[1][3] into the segment necessary luminance data 1/α[1][2] at Step S218.

When a comparison is made between FIG. 23 and FIG. 22, the segment necessary luminance data 1/α[1][1] is corrected from "50%" to "100%" in FIG. 23. This is because the segment necessary luminance corrector 52 determines that the segment necessary luminance data 1/α[1][2] is larger than the segment necessary luminance data 1/α[1][1] at Step S216 in FIG. 21 and substitutes the segment necessary luminance data 1/α[1][2] into the segment necessary luminance data 1/α[1][1] at Step S218.

When a comparison is made between FIG. 23 and FIG. 22, the segment necessary luminance data 1/α[2][2] is corrected from "50%" to "100%" in FIG. 23. This is because the segment necessary luminance corrector 52 determines that the segment necessary luminance data 1/α[2][3] is larger than the segment necessary luminance data 1/α[2][2] at Step S216 in FIG. 21 and substitutes the segment necessary luminance data 1/α[2][3] into the segment necessary luminance data 1/α[2][2] at Step S218.

When a comparison is made between FIG. 23 and FIG. 22, the segment necessary luminance data 1/α[2][1] is corrected from "50%" to "100%" in FIG. 23. This is because the segment necessary luminance corrector 52 determines that the segment necessary luminance data 1/α[2][2] is larger than the segment necessary luminance data 1/α[2][1] at Step S216 in FIG. 21 and substitutes the segment necessary luminance data 1/α[2][2] into the segment necessary luminance data 1/α[2][1] at Step S218.

When a comparison is made between FIG. 23 and FIG. 22, the segment necessary luminance data 1/α[3][2] is corrected from "50%" to "100%" in FIG. 23. This is because the segment necessary luminance corrector 52 determines that the segment necessary luminance data 1/α[3][3] is larger than the segment necessary luminance data 1/α[3][2] at Step S216 in FIG. 21 and substitutes the segment necessary luminance data 1/α[3][3] into the segment necessary luminance data 1/α[3][2] at Step S218.

When a comparison is made between FIG. 23 and FIG. 22, the segment necessary luminance data 1/α[3][1] is corrected from "50%" to "100%" in FIG. 23. This is because the segment necessary luminance corrector 52 determines that the segment necessary luminance data 1/α[3][2] is larger than the segment necessary luminance data 1/α[3][1] at Step S216 in FIG. 21 and substitutes the segment necessary luminance data 1/α[3][2] into the segment necessary luminance data 1/α[3][1] at Step S218.

When a comparison is made between FIG. 23 and FIG. 22, the segment necessary luminance data 1/α[1][5] is corrected from "50%" to "100%" in FIG. 23. This is because the segment necessary luminance corrector 52 determines that the segment necessary luminance data 1/α[1][4] is larger than the segment necessary luminance data 1/α[1][5] at Step S206 in FIG. 21 and substitutes the segment necessary luminance data 1/α[1][4] into the segment necessary luminance data 1/α[1][5] at Step S208.

When a comparison is made between FIG. 23 and FIG. 22, the segment necessary luminance data 1/α[1][6] is corrected from "50%" to "100%" in FIG. 23. This is because the segment necessary luminance corrector 52 determines that the segment necessary luminance data 1/α[1][5] is larger than the segment necessary luminance data 1/α[1][6] at Step S206 in FIG. 21 and substitutes the segment necessary luminance data 1/α[1][5] into the segment necessary luminance data 1/α[1][6] at Step S208.

When a comparison is made between FIG. 23 and FIG. 22, the segment necessary luminance data 1/α[2][5] is corrected from "50%" to "100%" in FIG. 23. This is because the segment necessary luminance corrector 52 determines that the segment necessary luminance data 1/α[2][4] is larger than the segment necessary luminance data 1/α[2][5] at Step S206 in FIG. 21 and substitutes the segment necessary luminance data 1/α[2][4] into the segment necessary luminance data 1/α[2][5] at Step S208.

When a comparison is made between FIG. 23 and FIG. 22, the segment necessary luminance data 1/α[2][6] is corrected from "50%" to "100%" in FIG. 23. This is because the segment necessary luminance corrector 52 determines that the segment necessary luminance data 1/α[2][5] is larger than the segment necessary luminance data 1/α[2][6] at Step S206 in FIG. 21 and substitutes the segment necessary luminance data 1/α[2][5] into the segment necessary luminance data 1/α[2][6] at Step S208.

When a comparison is made between FIG. 23 and FIG. 22, the segment necessary luminance data 1/α[3][5] is corrected from "50%" to "100%" in FIG. 23. This is because the segment necessary luminance corrector 52 determines that the segment necessary luminance data 1/α[3][4] is larger than the segment necessary luminance data 1/α[3][5] at Step S206 in FIG. 21 and substitutes the segment necessary luminance data 1/α[3][4] into the segment necessary luminance data 1/α[3][5] at Step S208.

When a comparison is made between FIG. 23 and FIG. 22, the segment necessary luminance data 1/α[3][6] is corrected from "50%" to "100%" in FIG. 23. This is because the segment necessary luminance corrector 52 determines that the segment necessary luminance data 1/α[3][5] is larger than the segment necessary luminance data 1/α[3][6] at Step S206 in FIG. 21 and substitutes the segment necessary luminance data 1/α[3][5] into the segment necessary luminance data 1/α[3][6] at Step S208.

When a comparison is made between FIG. 23 and FIG. 22, the segment necessary luminance data 1/α[6][2] is corrected from "50%" to "100%" in FIG. 23. This is because the segment necessary luminance corrector 52 determines that the segment necessary luminance data 1/α[6][3] is larger than the segment necessary luminance data 1/α[6][2] at Step S216 in FIG. 21 and substitutes the segment necessary luminance data 1/α[6][3] into the segment necessary luminance data 1/α[6][2] at Step S218.

When a comparison is made between FIG. 23 and FIG. 22, the segment necessary luminance data 1/α[6][1] is corrected from "50%" to "100%" in FIG. 23. This is because the segment necessary luminance corrector 52 determines that the segment necessary luminance data 1/α[6][2] is larger than the segment necessary luminance data 1/α[6][1] at Step S216 in FIG. 21 and substitutes the segment necessary luminance data 1/α[6][2] into the segment necessary luminance data 1/α[6][1] at Step S218.

When a comparison is made between FIG. 23 and FIG. 22, the segment necessary luminance data 1/α[7][2] is corrected from "50%" to "100%" in FIG. 23. This is because the segment necessary luminance corrector 52 determines that the segment necessary luminance data 1/α[7][3] is larger than the segment necessary luminance data 1/α[7][2] at Step S216 in FIG. 21 and substitutes the segment necessary luminance data 1/α[7][3] into the segment necessary luminance data 1/α[7][2] at Step S218.

When a comparison is made between FIG. 23 and FIG. 22, the segment necessary luminance data 1/α[7][1] is corrected from "50%" to "100%" in FIG. 23. This is because the segment necessary luminance corrector 52 determines that the segment necessary luminance data 1/α[7][2] is larger than the segment necessary luminance data 1/α[7][1] at Step S216 in FIG. 21 and substitutes the segment necessary luminance data 1/α[7][2] into the segment necessary luminance data 1/α[7][1] at Step S218.

When a comparison is made between FIG. 23 and FIG. 22, the segment necessary luminance data 1/α[8][2] is corrected from "50%" to "100%" in FIG. 23. This is because the segment necessary luminance corrector 52 determines that the segment necessary luminance data 1/α[8][3] is larger than the segment necessary luminance data 1/α[8][2] at Step S216 in FIG. 21 and substitutes the segment necessary luminance data 1/α[8][3] into the segment necessary luminance data 1/α[8][2] at Step S218.

When a comparison is made between FIG. 23 and FIG. 22, the segment necessary luminance data 1/α[8][1] is corrected from "50%" to "100%" in FIG. 23. This is because the segment necessary luminance corrector 52 determines that the segment necessary luminance data 1/α[8][2] is larger than the segment necessary luminance data 1/α[8][1] at Step S216 in FIG. 21 and substitutes the segment necessary luminance data 1/α[8][2] into the segment necessary luminance data 1/α[8][1] at Step S218.

When a comparison is made between FIG. 23 and FIG. 22, the segment necessary luminance data 1/α[6][6] is corrected from "50%" to "100%" in FIG. 23. This is because the segment necessary luminance corrector 52 determines that the segment necessary luminance data 1/α[6][5] is larger than the segment necessary luminance data 1/α[6][6] at Step S206 in FIG. 21 and substitutes the segment necessary luminance data 1/α[6][5] into the segment necessary luminance data 1/α[6][6] at Step S208.

When a comparison is made between FIG. 23 and FIG. 22, the segment necessary luminance data 1/α[7][6] is corrected from "50%" to "100%" in FIG. 23. This is because the segment necessary luminance corrector 52 determines that the segment necessary luminance data 1/α[7][5] is larger than the segment necessary luminance data 1/α[7][6] at Step S206 in FIG. 21 and substitutes the segment necessary luminance data 1/α[7][5] into the segment necessary luminance data 1/α[7][6] at Step S208.

When a comparison is made between FIG. 23 and FIG. 22, the segment necessary luminance data 1/α[8][6] is corrected from "50%" to "100%" in FIG. 23. This is because the segment necessary luminance corrector 52 determines that the segment necessary luminance data 1/α[8][5] is larger than the segment necessary luminance data 1/α[8][6] at Step S206 in FIG. 21 and substitutes the segment necessary luminance data 1/α[8][5] into the segment necessary luminance data 1/α[8][6] at Step S208.

When a comparison is made between FIG. 23 and FIG. 22, the segment necessary luminance data 1/α[9][3] is corrected from "50%" to "90%" in FIG. 23. This is because the segment necessary luminance corrector 52 determines that the segment necessary luminance data 1/α[9][2] is larger than the segment necessary luminance data 1/α[9][3] at Step S206 in FIG. 21 and substitutes the segment necessary luminance data 1/α[9][2] into the segment necessary luminance data 1/α[9][3] at Step S208.

When a comparison is made between FIG. 23 and FIG. 22, the segment necessary luminance data 1/α[9][6] is corrected from "50%" to "90%" in FIG. 23. This is because the segment necessary luminance corrector 52 determines that the segment necessary luminance data 1/α[9][5] is larger than the segment necessary luminance data 1/α[9][6] at Step S206 in FIG. 21 and substitutes the segment necessary luminance data 1/α[9][5] into the segment necessary luminance data 1/α[9][6] at Step S208.

Referring back to FIG. 14, the light emission amount calculator 53 calculates the amounts of light emission from the light sources 6*a* in accordance with the segment necessary luminance data 1/α corrected by the segment necessary luminance corrector 52. The light emission amount calculator 53 outputs the light emission amount control signals for controlling the amounts of light emission from the light sources 6*a* to the light emitter BL.

The virtual light source light emission amount calculator 54 calculates the amount of light emission from the first virtual light source and the second virtual light source at the block boundaries in accordance with the amounts of light emission from the light sources 6*a* calculated by the light emission amount calculator 53. The virtual light source light emission amount calculator 54 calculates the amount of light emission (La) from the first virtual light source or the second virtual light source individually for all the pixels Pix arranged within the range up to the m-th position in the directions away from each of the boundaries on both sides thereof using Expression (3) based on Expression (2).

The virtual light source light emission amount calculator 54 simply needs to calculate the amount of light emission from the first virtual light source or the second virtual light source at a block boundary between two display segments DSEG adjacent to each other across the block boundary only when an image object is displayed in at least one of the two display segments DSEG.

The pixel processor 55 performs the first correction or the second correction on all the pixels Pix arranged within the range up to the m-th position in the directions away from the boundary on both sides of the block boundary between the two display segments DSEG in accordance with the amount of light emission (La) from the first virtual light source or the second virtual light source calculated by the virtual light source light emission amount calculator 54. The pixel processor 55 outputs the corrected image data to the driver 19*a*. The pixel processor 55 performs the first correction or the second correction on all the pixels Pix arranged within the range up to the m-th position in the directions away from the boundary on both sides of the block boundary between the two display segments DSEG using Expression (4) or (5).

The pixel processor 55 simply needs to perform the first correction or the second correction on all the pixels Pix arranged within the range up to the m-th position in the directions away from the boundary on both sides of the block boundary between two display segments DSEG adjacent to each other across the block boundary only when an image object is displayed in at least one of the two display segments DSEG.

The control data cont_h and cont_v can be dynamically changed in each frame.

Figure 24:
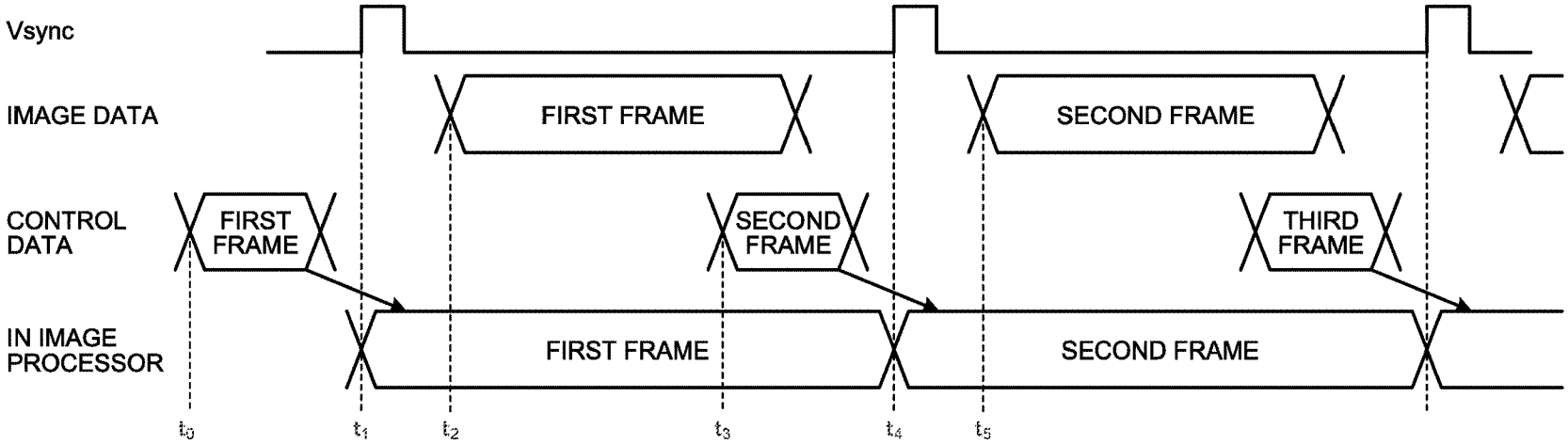
FIG. 24 is a timing chart of transmission and reception of data between the display apparatus and a host according to the embodiment.

FIG. 24 is a timing chart of transmission and reception of data between the display apparatus and the host according to the embodiment.

As illustrated in FIG. 24, control data (e.g., cont_h in FIG. 15 and cont_v in FIG. 16) for a first frame is supplied from the host HST to the segment necessary luminance corrector 52 of the image processor PR at a timing $t_0$.

At a timing $t_1$ serving as a start timing of the first frame and when a vertical synchronization signal Vsync is turned high, the segment necessary luminance corrector 52 latches (holds) the control data for the first frame.

At a timing $t_2$, image data of the first frame (e.g., image data for displaying the image illustrated in FIG. 9) is supplied to the image processor PR. The segment necessary luminance calculator 51 calculates the segment necessary luminance data $1/\alpha$ (refer to FIG. 18) in accordance with the image data of the first frame. The segment necessary luminance corrector 52 corrects the segment necessary luminance data $1/\alpha$ in accordance with the control data (refer to FIG. 23). The light emission amount calculator 53 calculates the amounts of light emission from the light sources 6*a* in accordance with the corrected segment necessary luminance data $1/\alpha$, and then outputs the light emission amount control signals for controlling the amounts of light emission from the light sources 6*a* to the light emitter BL.

The virtual light source light emission amount calculator 54 calculates the amount of light emission from the first virtual light source and the second virtual light source at the block boundaries in accordance with the amounts of light emission from the light sources 6*a* calculated by the light emission amount calculator 53. The virtual light source light emission amount calculator 54 calculates the amount of light emission (La) from the first virtual light source or the second virtual light source individually for all the pixels Pix arranged within the range up to the m-th position in the directions away from each of the boundaries on both sides thereof using Expression (3) based on Expression (2).

The pixel processor 55 performs the first correction or the second correction on all the pixels Pix arranged within the range up to the m-th position in the directions away from the boundary on both sides of the segment boundary between two display segments DSEG in accordance with the amount of light emission (La) from the first virtual light source or the second virtual light source calculated by the virtual light source light emission amount calculator 54. The pixel processor 55 then outputs the corrected image data to the driver 19*a*. The pixel processor 55 performs the first correction or the second correction on all the pixels Pix arranged within the range up to the m-th position in the directions away from the boundary on both sides of the segment boundary between the two display segments DSEG using Expression (4) or (5).

At a timing $t_3$, control data for a second frame is supplied from the host HST to the segment necessary luminance corrector 52 of the image processor PR.

At a timing $t_4$ serving as a start timing of the second frame, the segment necessary luminance corrector 52 latches (holds) the control data for the second frame.

At a timing $t_5$, image data for the second frame is supplied to the image processor PR.

Figure 25:
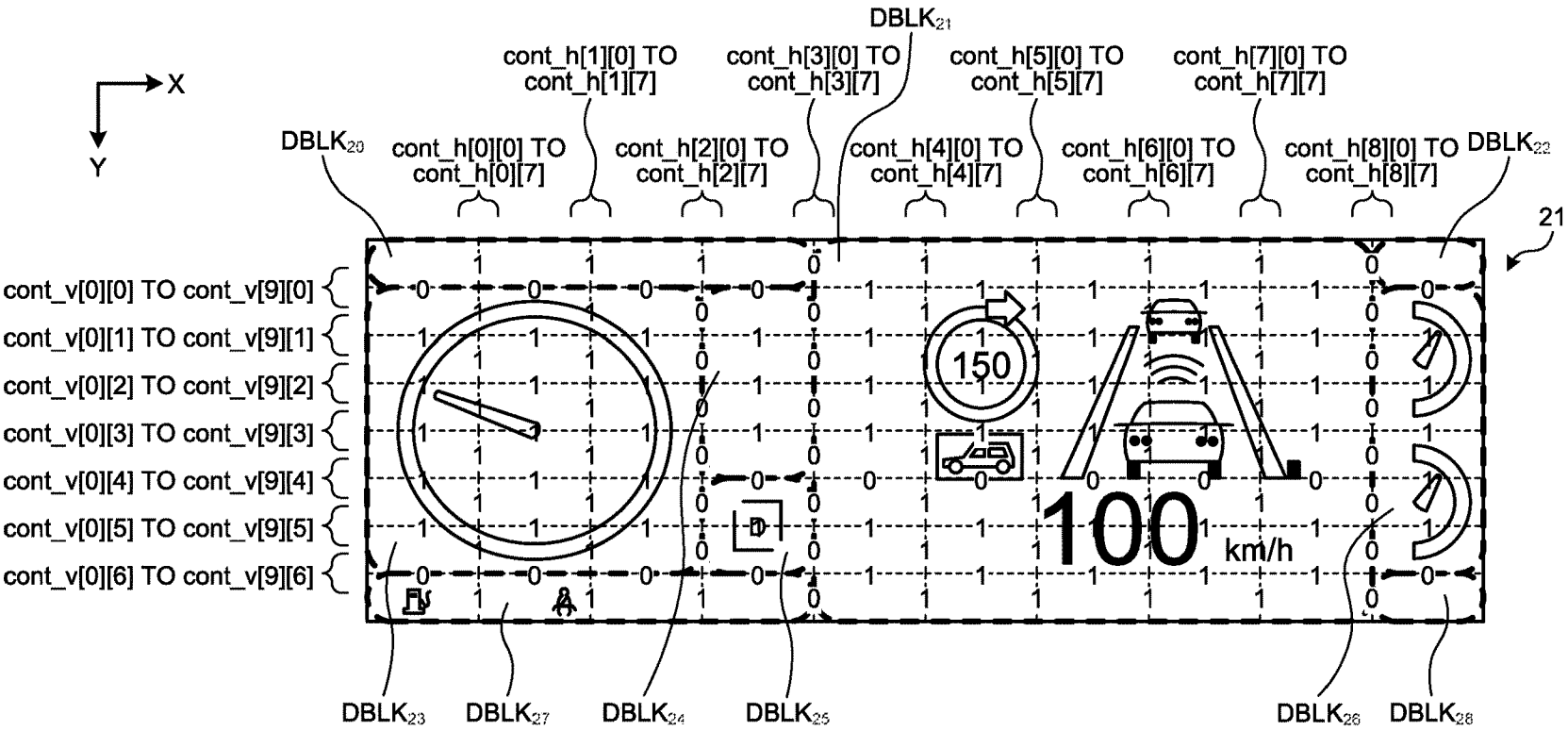
FIG. 25 is a diagram illustrating an example of an image displayed on the display region of the display apparatus according to the embodiment.

FIG. 25 is a diagram illustrating an example of an image displayed on the display region of the display apparatus according to the embodiment. In FIG. 25, the display region 21 includes display blocks $DBLK_{20}$ to $DBLK_{28}$. The display block $DBLK_{20}$ includes the display segments $DSEG_{(0,0)}$, $DSEG_{(1,0)}$, $DSEG_{(2,0)}$, and $DSEG_{(3,0)}$.

The display block $DBLK_{21}$ includes the display segments $DSEG_{(4,0)}$, $DSEG_{(5,0)}$, $DSEG_{(6,0)}$, $DSEG_{(7,0)}$, $DSEG_{(8,0)}$, $DSEG_{(4,1)}$, $DSEG_{(5,1)}$, $DSEG_{(6,1)}$, $DSEG_{(7,1)}$, $DSEG_{(8,1)}$, $DSEG_{(4,2)}$, $DSEG_{(5,2)}$, $DSEG_{(6,2)}$, $DSEG_{(7,2)}$, $DSEG_{(8,2)}$, $DSEG_{(4,3)}$, $DSEG_{(5,3)}$, $DSEG_{(6,3)}$, $DSEG_{(7,3)}$, $DSEG_{(8,3)}$, $DSEG_{(4,4)}$, $DSEG_{(5,4)}$, $DSEG_{(6,4)}$, $DSEG_{(7,4)}$, $DSEG_{(8,4)}$, $DSEG_{(4,5)}$, $DSEG_{(5,5)}$, $DSEG_{(6,5)}$, $DSEG_{(7,5)}$, $DSEG_{(8,5)}$, $DSEG_{(4,6)}$, $DSEG_{(5,6)}$, $DSEG_{(6,6)}$, $DSEG_{(7,6)}$, $DSEG_{(8,6)}$, $DSEG_{(4,7)}$, $DSEG_{(5,7)}$, $DSEG_{(6,7)}$, $DSEG_{(7,7)}$, and $DSEG_{(8,7)}$.

The display block $DBLK_{22}$ includes the display segment $DSEG_{(9,0)}$.

The display block $DBLK_{23}$ includes the display segments $DSEG_{(0,1)}$, $DSEG_{(1,1)}$, $DSEG_{(2,1)}$, $DSEG_{(0,2)}$, $DSEG_{(1,2)}$, $DSEG_{(2,2)}$, $DSEG_{(0,3)}$, $DSEG_{(1,3)}$, $DSEG_{(2,3)}$, $DSEG_{(0,4)}$, $DSEG_{(1,4)}$, $DSEG_{(2,4)}$, $DSEG_{(0,5)}$, $DSEG_{(1,5)}$, $DSEG_{(2,5)}$, $DSEG_{(0,6)}$, $DSEG_{(1,6)}$, and $DSEG_{(2,6)}$.

The display block $DBLK_{24}$ includes the display segments $DSEG_{(3,1)}$, $DSEG_{(3,2)}$, $DSEG_{(3,3)}$, and $DSEG_{(3,4)}$.

The display block $DBLK_{25}$ includes the display segments $DSEG_{(3,5)}$ and $DSEG_{(3,6)}$.

The display block $DBLK_{26}$ includes the display segments $DSEG_{(9,1)}$, $DSEG_{(9,2)}$, $DSEG_{(9,3)}$, $DSEG_{(9,4)}$, $DSEG_{(9,5)}$, and $DSEG_{(9,6)}$.

The display block $DBLK_{27}$ includes the display segments $DSEG_{(0,7)}$, $DSEG_{(1,7)}$, $DSEG_{(2,7)}$, and $DSEG_{(3,7)}$.

The display block $DBLK_{28}$ includes the display segment $DSEG_{(9,7)}$.

FIG. 25 is a diagram obtained by superimposing corresponding bits in the control data cont_h and cont_v on the respective boundaries between the display segments. FIG. 25 is just a schematic diagram, and the control data cont_h or cont_v is not displayed on the display device DP in the actual configuration. If the displayed data is changed as illustrated from FIG. 9 to FIG. 24, the image processor PR can control the luminance in units of blocks by receiving control data including information on the block boundaries between image objects.

As illustrated in FIG. 25, the image processor PR can divide the display region 21 into the display blocks $DBLK_{20}$ to $DBLK_{28}$ using the control data cont_h and cont_v for the second frame. The image processor PR can also divide the light-emitting region 31 into light-emitting blocks $LBLK_{20}$ to $LBLK_{28}$ using the control data cont_h and cont_v for the second frame.

The segment necessary luminance calculator 51 calculates the segment necessary luminance data $1/\alpha$ in accordance with the image data of the second frame. The segment necessary luminance corrector 52 corrects the segment necessary luminance data $1/\alpha$ in accordance with the control data. The light emission amount calculator 53 calculates the amounts of light emission from the light sources 6*a* in accordance with the corrected segment necessary luminance data $1/\alpha$. The light emission amount calculator 53 then outputs the light emission amount control signals for controlling the amounts of light emission from the light sources 6*a* to the light emitter BL.

The virtual light source light emission amount calculator 54 calculates the amount of light emission from the virtual light source at the block boundaries in accordance with the amounts of light emission from the light sources 6*a* calculated by the light emission amount calculator 53. The virtual light source light emission amount calculator 54 calculates the amount of light emission (La) from the first virtual light source or the second virtual light source individually for all the pixels Pix arranged within the range up to the m-th position in the directions away from each of the boundaries on both sides thereof using Expression (3) based on Expression (2).

The pixel processor 55 corrects the gradation values of the pixels in the image data supplied from the host HST in accordance with the amount of light emission (La) from the first virtual light source or the second virtual light source calculated by the virtual light source light emission amount calculator 54. The pixel processor 55 outputs the corrected image data to the driver 19*a*. The pixel processor 55 corrects the gradation values of the pixels in the image data supplied from the host HST using Expression (4) or (5).

Advantageous Effects of the Embodiment

The display apparatus 1 adjusts the luminance of one or a plurality of light-emitting segments LSEG included in the light-emitting blocks LBLK uniformly to the highest luminance of the respective light-emitting blocks LBLK. With this mechanism, the display apparatus 1 simply needs to calculate the luminance distribution at the block boundaries between the light-emitting blocks. Consequently, the display apparatus 1 can reduce the amount of calculation of the luminance distribution.

First Modification

The following describes a first modification of the embodiment according to the present disclosure. Because the configuration of the image processor PR according to the first modification is the same as that of the image processor PR according to the embodiment illustrated in FIG. 14, explanation thereof is omitted.

Figure 26:
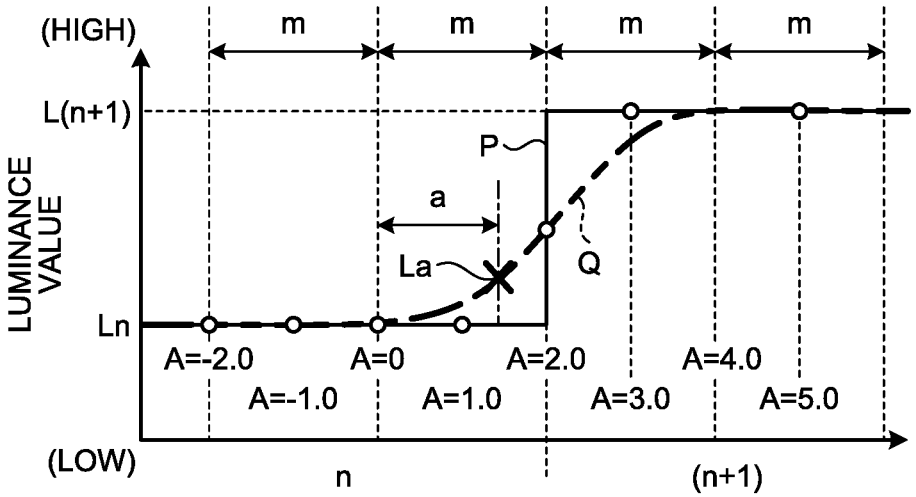
FIG. 26 is a diagram for explaining calculation of the luminance distribution at a boundary according to a first modification.

FIG. 26 is a diagram for explaining calculation of the luminance distribution at a boundary according to the first modification. Specifically, FIG. 26 is a graph indicating an example of the relation among the calculated luminance distribution Q between two display segments n and (n+1), the positions of the pixels Pix arranged up to the m-th position in the directions away from the boundary between the partial regions, and the position of the a-th pixel Pix counting from the side farther from the boundary out of the pixels Pix arranged up to the m-th position in the direction away from the boundary.

Assume that Ln is the amount of light emission from the light source 6*a* having a relatively small amount of light emission; L(n+1) is the amount of light emission from the light source 6*a* having a relatively large amount of light emission; La is the amount of light emission from the first virtual light source or the second virtual light source that irradiates the a-th pixel Pix counting from the side farther from the boundary and on the side of the light source 6*a* having a relatively small amount of light emission out of the pixels Pix arranged within a range up to the m-th position in the direction away from the boundary; and Coef is a predetermined variable. In this case, the virtual light source light emission amount calculator 54 according to the first modification determines Coef using any one of Expressions (7) to (10) based on A expressed by Expression (6). The virtual light source light emission amount calculator 54 determines La by Expression (11) using the determined Coef. When A<1 is satisfied, the virtual light source light emission amount calculator 54 uses Expression (7). When 1≤A<2 is satisfied, the virtual light source light emission amount calculator 54 uses Expression (8). When 2≤A<3 is satisfied, the virtual light source light emission amount calculator 54 uses Expression (9). When 3≤A<4 is satisfied, the virtual light source light emission amount calculator 54 uses Expression (10).

$$A=a/(2m/4) \tag{6}$$

$$\mathrm{Coef}=0.5\times\{-1/6\times(2.0-A-2.0)\hat{}3\} \tag{7}$$

$$\mathrm{Coef}=0.5\times[1/6\times\{3\times(2.0-A)\hat{}3-6\times(2.0-A)\hat{}2+4\}]+\{-1/6*(3.0-A-2.0)\hat{}3\} \tag{8}$$

$$\mathrm{Coef}=0.5\times[1/6\times\{3\times(A-2.0)\hat{}3-6\times(A-2.0)\hat{}2+4\}]+[1/6\times\{3\times(3.0-A)\hat{}3-6\times(3.0-A)\hat{}2+4\}]+\{-1/6*(4.0-A-2.0)\hat{}3\} \tag{9}$$

$$\mathrm{Coef}=0.5\times\{-1/6\times(A-2.0-2.0)\hat{}3\}+[1/6\times\{3\times(A-3.0)\hat{}3-6\times(A-3.0)\hat{}2+4\}]+[1/6\times\{3\times(4.0-A)\hat{}3-6\times(4.0-A)\hat{}2+4\}]+\{-1/6\times(5.0-A-2.0)\hat{}3\} \tag{10}$$

$$La=L(n+1)-\{L(n+1)-Ln\}\times\mathrm{Coef} \tag{11}$$

While FIG. 26 illustrates the values of A obtained when m=8 is satisfied, this is given by way of example only. The values of A are not limited thereto and may vary depending on m.

According to the first modification, Ln and L(n+1) are connected with each other by a three-dimensional spline curve where {Ln+L(n+1)}/2 is a boundary, Ln is the value of the pixel Pix positioned at −m/2 from the boundary, and L(n+1) is the value of the pixel Pix positioned at +m/2 from the boundary.

The specific mechanism for calculating a curve connecting Ln and L(n+1) is not limited to the embodiment and the modification described above and may be appropriately changed. The image processor PR, for example, may have Ln and L(n+1) as variables and determine the amount of light emission from the first virtual light source and the second virtual light source using a predetermined equation defining the curve connecting Ln and L(n+1). Alternatively, an LUT defining the curve may be provided. In this case, local dimming can be performed with an LUT having a significantly smaller storage capacity than the conventional LUT indicating the luminance distribution of the respective light sources 6*a*.

Second Modification

The following describes a second modification of the embodiment according to the present disclosure. Because the configuration of the image processor PR according to the second modification is the same as that of the image processor PR according to the embodiment illustrated in FIG. 14, explanation thereof is omitted.

The image processor PR according to the embodiment adjusts the luminance of one or a plurality of light-emitting segments LSEG included in the light-emitting blocks LBLK uniformly to the highest luminance of the respective light-emitting blocks LBLK. The present disclosure is not limited thereto. The image processor PR may control the luminance of one or a plurality of light-emitting segments LSEG included in the light-emitting blocks LBLK individually in accordance with the highest luminance of the respective light-emitting blocks LBLK.

Figure 27:
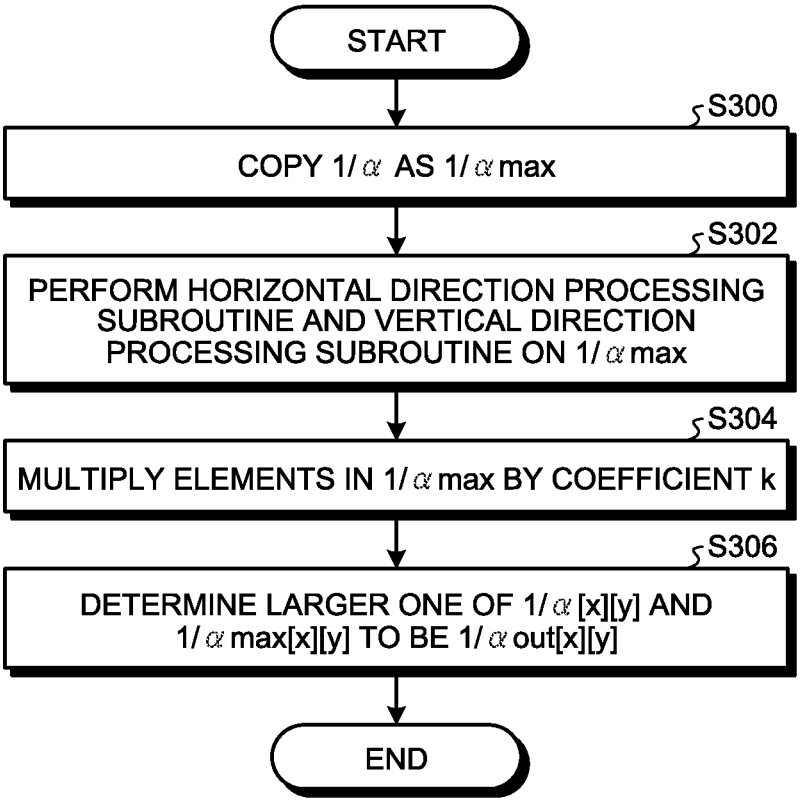
FIG. 27 is a flowchart for processing performed by the segment necessary luminance corrector according to a second modification.

FIG. 27 is a flowchart for processing performed by the segment necessary luminance corrector according to the second modification.

As illustrated in FIG. 27, the segment necessary luminance corrector 52 copies the segment necessary luminance data 1/α calculated by the segment necessary luminance calculator 51 as segment necessary luminance data 1/αmax at Step S300.

Figure 28:
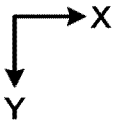
FIG. 28 is a diagram illustrating the segment necessary luminance data according to the second modification.

FIG. 28 is a diagram for the segment necessary luminance data according to the second modification. The segment necessary luminance data 1/αmax illustrated in FIG. 28 is identical with the segment necessary luminance data 1/α illustrated in FIG. 18 because it is obtained by copying the segment necessary luminance data 1/α.

Referring back to FIG. 27, the segment necessary luminance corrector 52 performs the horizontal direction processing subroutine (refer to FIG. 20) and the vertical direction processing subroutine (refer to FIG. 21) on the segment necessary luminance data 1/αmax at Step S302. The segment necessary luminance corrector 52 thus corrects the segment necessary luminance data 1/αmax.

Figure 29:
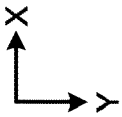
FIG. 29 is a diagram illustrating the segment necessary luminance data according to the second modification.

FIG. 29 is a diagram illustrating the segment necessary luminance data according to the second modification. The segment necessary luminance data 1/αmax illustrated in FIG. 29 is identical with the segment necessary luminance data 1/α illustrated in FIG. 23 because it is obtained by performing the horizontal direction processing subroutine and the vertical direction processing subroutine on the segment necessary luminance data 1/αmax illustrated in FIG. 28.

Referring back to FIG. 27, the segment necessary luminance corrector 52 multiplies each element in the segment necessary luminance data 1/αmax by a coefficient k at Step S304. The coefficient k may be determined in advance or supplied from the host HST together with the control data cont_h and cont_v.

Figure 30:
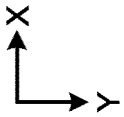
FIG. 30 is a diagram illustrating the segment necessary luminance data according to the second modification.

FIG. 30 is a diagram illustrating the segment necessary luminance data according to the second modification. The segment necessary luminance data 1/αmax illustrated in FIG. 30 is obtained by multiplying each element by a coefficient of 0.9. A coefficient of 0.9 is given by way of example only, and the coefficient k is not limited thereto. The coefficient k preferably falls within a range from 0.8 to 0.99 and more preferably within a range from 0.85 to 0.95.

Referring back to FIG. 27, the segment necessary luminance corrector 52 determines a larger one of the segment necessary luminance data 1/α[x][y] (x takes 0 to 9, and y takes 0 to 7) and the segment necessary luminance data 1/αmax[x][y] to be segment necessary luminance data 1/αout[x][y] at Step S306. In other words, the segment necessary luminance corrector 52 increases the luminance of the light-emitting segments LSEG to the values obtained by multiplying the highest luminance of the luminance necessary for the light-emitting segments LSEG by the coefficient k in the light-emitting blocks LBLK. The segment necessary luminance corrector 52 then outputs the segment necessary luminance data 1/αout to the light emission amount calculator 53.

The light emission amount calculator 53 calculates the amounts of light emission from the light sources 6*a* in accordance with the segment necessary luminance data 1/αout corrected by the segment necessary luminance corrector 52. The light emission amount calculator 53 then outputs the light emission amount control signals for controlling the amounts of light emission from the light sources 6*a* to the light emitter BL.

The virtual light source light emission amount calculator 54 calculates the amount of light emission from the first virtual light source and the second virtual light source at the segment boundaries in accordance with the amounts of light emission from the light sources 6*a* calculated by the light emission amount calculator 53. The virtual light source light emission amount calculator 54 calculates the amount of light emission (La) from the first virtual light source or the second virtual light source individually for all the pixels Pix arranged within the range up to the m-th position in the directions away from each of the boundaries on both sides thereof using Expression (3) based on Expression (2).

The virtual light source light emission amount calculator 54 simply needs to calculate the amount of light emission from the virtual light source at a segment boundary between two display segments DSEG adjacent to each other across the segment boundary only when an image object is displayed in at least one of the two display segments DSEG.

The pixel processor 55 performs the first correction or the second correction on all the pixels Pix arranged within the range up to the m-th position in the directions away from the boundary on both sides of the segment boundary between two display segments DSEG in accordance with the amount of light emission (La) from the first virtual light source or the second virtual light source calculated by the virtual light source light emission amount calculator 54. The pixel processor 55 then outputs the corrected image data to the driver 19*a*. The pixel processor 55 performs the first correction or the second correction on all the pixels Pix arranged within the range up to the m-th position in the directions away from the boundary on both sides of the segment boundary between the two display segments DSEG using Expression (4) or (5).

The pixel processor 55 simply needs to perform the first correction or the second correction on all the pixels Pix arranged within the range up to the m-th position in the directions away from the boundary on both sides of the segment boundary between the two display segments DSEG adjacent to each other across the segment boundary only when an image object is displayed in at least one of the two display segments DSEG.

Figure 31:
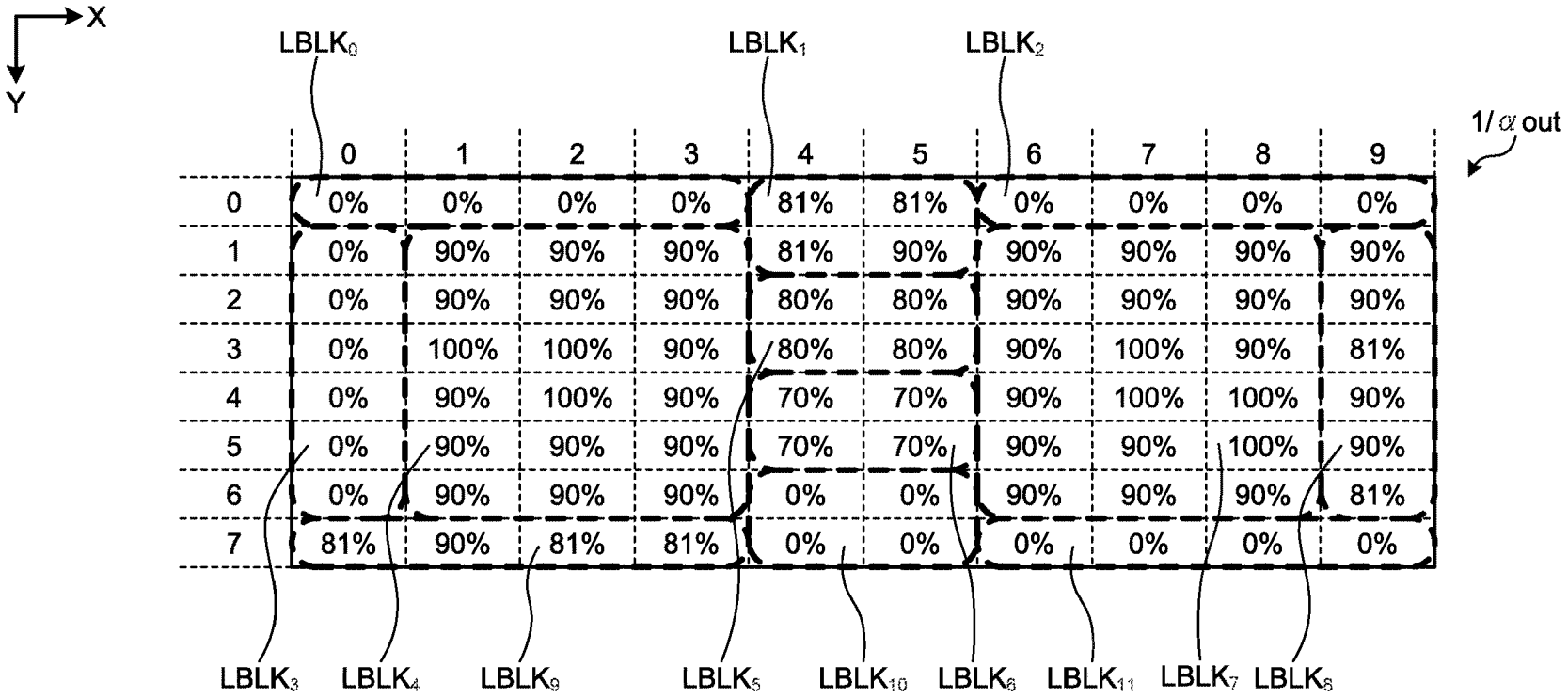
FIG. 31 is a diagram illustrating the segment necessary luminance data according to the second modification.

FIG. 31 is a diagram illustrating the segment necessary luminance data according to the second modification.

When a comparison is made between FIG. 31 and FIG. 18, the luminance of the light-emitting segments $LSEG_{(4,0)}$, $LSEG_{(5,0)}$, and $LSEG_{(4,1)}$ in the light-emitting block $LBLK_1$ is increased from "0%" to "81%" in FIG. 31. By contrast, the luminance of the light-emitting segment $LSEG_{(5,1)}$ in the light-emitting block $LBLK_1$ is maintained at "90%". This is because, if the luminance of the light-emitting segment $LSEG_{(5,1)}$ is changed from "90%" to "81%", the luminance is not increased but decreased, and the luminance necessary for displaying the image object fails to be provided.

When a comparison is made between FIG. 31 and FIG. 18, the luminance of the light-emitting segments $LSEG_{(1,1)}$, $LSEG_{(2,1)}$, $LSEG_{(3,1)}$, $LSEG_{(1,2)}$, $LSEG_{(2,2)}$, $LSEG_{(3,2)}$, $LSEG_{(3,3)}$, $LSEG_{(1,4)}$, $LSEG_{(3,4)}$, $LSEG_{(1.5)}$, $LSEG_{(2,5)}$, $LSEG_{(3,5)}$, $LSEG_{(1,6)}$, $LSEG_{(2,6)}$, and $LSEG_{(3,6)}$ in the light-emitting block $LBLK_4$ is increased to "90%" in FIG. 31. By contrast, the luminance of the light-emitting segments $LSEG_{(1,3)}$, $LSEG_{(2,3)}$, and $LSEG_{(2,4)}$ in the light-emitting block $LBLK_4$ is maintained at "100%". This is because, if the luminance of the light-emitting segments $LSEG_{(1,3)}$, $LSEG_{(2,3)}$, and $LSEG_{(2,4)}$ is changed from "100%" to "90%", the luminance is not increased but decreased, and the luminance necessary for displaying the image object fails to be provided.

When a comparison is made between FIG. 31 and FIG. 18, the luminance of the light-emitting segments $LSEG_{(6,1)}$, $LSEG_{(7,1)}$, $LSEG_{(8,1)}$, $LSEG_{(6,2)}$, $LSEG_{(7,2)}$, $LSEG_{(8,2)}$, $LSEG_{(6,3)}$, $LSEG_{(8,3)}$, $LSEG_{(6,4)}$, $LSEG_{(6,5)}$, $LSEG_{(7,5)}$, $LSEG_{(6,6)}$, $LSEG_{(7,6)}$, and $LSEG_{(8,6)}$ in the light-emitting block $LBLK_7$ is increased to "90%" in FIG. 31. By contrast, the luminance of the light-emitting segments $LSEG_{(7,3)}$, $LSEG_{(7,4)}$, $LSEG_{(8,4)}$, and $LSEG_{(8,5)}$ in the light-emitting block $LBLK_7$ is maintained at "100%". This is because, if the luminance of the light-emitting segments $LSEG_{(7,3)}$, $LSEG_{(7,4)}$, $LSEG_{(8,4)}$, and $LSEG_{(8,5)}$ is changed from "100%" to "90%", the luminance is not increased but decreased, and the luminance necessary for displaying the image object fails to be provided.

When a comparison is made between FIG. 31 and FIG. 18, the luminance of the light-emitting segments $LSEG_{(9,3)}$, and $LSEG_{(9,6)}$ in the light-emitting block $LBLK_8$ is increased from "50%" to "81%" in FIG. 31. By contrast, the luminance of the light-emitting segments $LSEG_{(9,1)}$, $LSEG_{(9,2)}$, $LSEG_{(9,4)}$, and $LSEG_{(9,5)}$ in the light-emitting block $LBLK_8$ is maintained at "90%". This is because, if the luminance of the light-emitting segments $LSEG_{(9,1)}$, $LSEG_{(9,2)}$, $LSEG_{(9,4)}$, and $LSEG_{(9,5)}$ is changed from "90%" to "81%", the luminance is not increased but decreased, and the luminance necessary for displaying the image object fails to be provided.

When a comparison is made between FIG. 31 and FIG. 18, the luminance of the light-emitting segments $LSEG_{(0,7)}$, $LSEG_{(2,7)}$, and $LSEG_{(3,7)}$ in the light-emitting block $LBLK_9$ is increased to "81%" in FIG. 31. By contrast, the luminance of the light-emitting segment $LSEG_{(1,7)}$ in the light-emitting block $LBLK_9$ is maintained at "90%". This is because, if the luminance of the light-emitting segment $LSEG_{(1,7)}$ is changed from "90%" to "81%", the luminance is not increased but decreased, and the luminance necessary for displaying the image object fails to be provided.

The second modification can reduce the amount of light emission in the light emitter BL, thereby reducing the power consumption, in comparison with the embodiment. The second modification increases the luminance of the light-emitting segments LSEG in each of the light-emitting blocks LBLK to the values obtained by multiplying the highest luminance of the luminance necessary for the light-emitting segments LSEG by the coefficient k. Even if an image object (e.g., the needle point in the image object 105 of the speed meter illustrated in FIG. 9) moves, the second modification can reduce the variation range in the luminance of the light-emitting segment LSEG from which the image object moves and the variation range in the luminance of the light-emitting segment LSEG to which the image object moves. Consequently, the second modification can prevent a user from visually recognizing the change in the luminance.

While an exemplary embodiment according to the present disclosure has been described, the embodiment is not intended to limit the present disclosure. The contents disclosed in the embodiment are given by way of example only, and various changes may be made without departing from the spirit of the present disclosure. Appropriate changes made without departing from the spirit of the present disclosure naturally fall within the technical scope of the present disclosure.

What is claimed is:

1. A display apparatus comprising:

a light emitter having a light-emitting region that is divided into a plurality of light-emitting blocks based on control data supplied from outside, wherein each of the light-emitting blocks include one or more light-emitting segments, the light-emitting blocks include a first light-emitting block and a second light-emitting block, and a number of the one or more light-emitting segments in the first light-emitting block is different from a number of the one or more light-emitting segments in the second light-emitting block;

a display device having a display area that is divided into a plurality of display blocks based on the control data supplied from the outside, wherein each of the display blocks includes a plurality of display segments corresponding to the one or more respective light-emitting segments, and the display blocks correspond to the respective light-emitting blocks; and a control circuit configured to output, to the light emitter, a light emission amount control signal for controlling the amount of light emission from the one or more light-emitting segments, in accordance with image data supplied from an outside and the control data supplied from the outside, wherein the control circuit comprises:

a segment necessary luminance calculator configured to create segment necessary luminance data indicating luminance necessary for each of the light-emitting segments in accordance with the image data;

a segment necessary luminance corrector configured to correct the segment necessary luminance data for each of the light-emitting blocks according to the highest luminance of one or a plurality of the light-emitting segments included in each of the light-emitting blocks, in accordance with the control data and the segment necessary luminance data; and a light emission amount calculator configured to calculate the amount of light emission from the light-emitting segments in accordance with the segment necessary luminance data corrected by the segment necessary luminance corrector, and output the light emission amount control signal to the light emitter, wherein the control circuit includes a virtual light source light emission amount calculator configured to determine La using Expression (2) based on Expression (1):

$$A=a/2m \tag{1}$$

$$La=L(n+1)-\{L(n+1)-Ln\}\times(2\times A\hat{}3-3\times A\hat{}2+1) \tag{2}$$

where Ln is an amount of light emission from the light-emitting segment having a relatively small amount of light emission, L(n+1) is an amount of light emission from the light-emitting segment having a relatively large amount of light emission, and La is an amount of light emission from a first virtual light source or a second virtual light source that irradiates an a-th pixel counting from a side farther from the boundary and on a side of the light-emitting segment having a relatively small amount of light emission out of the pixels arranged within a range up to the m-th position in the direction away from the boundary.

2. The display apparatus according to claim 1, wherein the segment necessary luminance corrector is configured to correct the luminance of the one or more light-emitting segments included in each of the light-emitting blocks to the highest luminance of each of the light-emitting blocks.

3. The display apparatus according to claim 1, wherein the segment necessary luminance corrector is configured to increase the luminance of the one or more light-emitting segments included in each of the light-emitting blocks to a value obtained by multiplying the highest luminance of each of the light-emitting blocks by a predetermined coefficient.

4. The display apparatus according to claim 1, wherein the display area includes $n_1$ pixels, the display segments each include $n_2$ pixels aligned in at least one direction, two of the light-emitting segments adjacent to each other correspond to two of the display segments adjacent to each other, wherein the two of the display segments includes:

a first display segment that corresponds to a first light-emitting segment having a relatively large amount of light emission among the two of the light-emitting segments, and a second display segment that corresponds to a second light-emitting segment have a relatively small amount of light emission among the two of the light-emitting segments, a first boundary is between the first display segment and the second display segment from which the amounts of light emission are different, first pixels are the pixels arranged up to an m-th position in a direction away from the first boundary, in the first display segment, second pixels are the pixels arranged up to the m-th position in the direction away from the first boundary, in the second display segment, the control circuit comprises:

a virtual light source light emission amount calculator configured to calculate the amount of light emission from a first virtual light source in the first pixels, and the amount of light emission from a second virtual light source in the second pixels; and a pixel processor configured to perform, when the amounts of light emission from the two light-emitting segments corresponding to the two adjacent display segments are different, first correction of decreasing an output gradation value of the first pixels in accordance with the amount of light emission from the first virtual light source, and second correction of increasing the output gradation value of the second pixels in accordance with the amount of light emission from the second virtual light source, the corrected output gradation value by the first correction is an output gradation value obtained when the pixels controlled by the output gradation value prior to the first correction are irradiated with light from the first virtual light source such that: an amount of light emission from which is smaller than the amount of light emission from the light-emitting segment having a relatively large amount of light emission, and is equal to or larger than an intermediate amount of light emission of the amounts of light emission from the two light-emitting segments, the corrected output gradation value by the second correction is an output gradation value obtained when the pixels controlled by the output gradation value prior to the second correction are irradiated with light from the second virtual light source such that: an amount of light emission from which is larger than the amount of light emission from the light-emitting segment having a relatively small amount of light emission, and is equal to or smaller than the intermediate amount of light emission of the amounts of light emission from the two light-emitting segments, and $n_1>n_2>m\geq 1$ is satisfied.

5. The display apparatus according to claim 4, wherein $m\geq 2$ is satisfied, and the pixel processor is configured to increase a degree of correction on the output gradation value of the pixels positioned closer to the boundary in the first correction and the second correction.

6. The display apparatus according to claim 4, wherein the virtual light source light emission amount calculator is configured to determine La using Expression (2) based on Expression (1):

$$A=a/2m \tag{1}$$

$$La=L(n+1)-\{L(n+1)-Ln\}\times(2\times A\hat{}3-3\times A\hat{}2+1) \tag{2}$$

where Ln is the amount of light emission from the light-emitting segment having a relatively small amount of light emission, L(n+1) is the amount of light emission from the light-emitting segment having a relatively large amount of light emission, and La is the amount of light emission from the first virtual light source or the second virtual light source that irradiates an a-th pixel counting from a side farther from the boundary and on a side of the light-emitting segment having a relatively small amount of light emission out of the pixels arranged within a range up to the m-th position in the direction away from the boundary.

7. The display apparatus according to claim 4, wherein the virtual light source light emission amount calculator is configured to determine Coef using any one of Expressions (4) to (7) based on A expressed by Expression (3), determine La by Expression (8) using the determined Coef, use Expression (4) when $A<1$ is satisfied, use Expression (5) when $1\leq A<2$ is satisfied, use Expression (6) when $2\leq A<3$ is satisfied, and use Expression (7) when $3\leq A<4$ is satisfied:

$$A=a/(2m/4) \tag{3}$$

$$\text{Coef}=0.5\times\{-1/6\times(2.0-A-2.0)\hat{}3\} \tag{4}$$

$$\text{Coef}=0.5\times[1/6\times\{3\times(2.0-A)\hat{}3-6\times(2.0-A)\hat{}2+4\}]+\{-1/6*(3.0-A-2.0)\hat{}3\} \tag{5}$$

$$\text{Coef}=0.5\times[1/6\times\{3\times(A-2.0)\hat{}3-6\times(A-2.0)\hat{}2+4\}]+[1/6\times\{3\times(3.0-A)\hat{}3-6\times(3.0-A)\hat{}2+4\}]+\{-1/6*(4.0-A-2.0)\hat{}3\} \tag{6}$$

$$\text{Coef}=0.5\times\{-1/6\times(A-2.0-2.0)\hat{}3\}+[1/6\times\{3\times(A-3.0)\hat{}3-6\times(A-3.0)\hat{}2+4\}]+[1/6\times\{3\times(4.0-A)\hat{}3-6\times(4.0-A)\hat{}2+4\}]+\{-1/6\times(5.0-A-2.0)\hat{}3\} \tag{7}$$

$$La=L(n+1)-\{L(n+1)-Ln\}\times\text{Coef} \tag{8}$$

where Ln is the amount of light emission from the light-emitting segment having a relatively small amount of light emission, L(n+1) is the amount of light emission from the light-emitting segment having a relatively large amount of light emission, La is the amount of light emission from the first virtual light source or the second virtual light source that irradiates an a-th pixel counting from a side farther from the boundary and on a side of the light-emitting segment having a relatively small amount of light emission out of the pixels arranged within a range up to the m-th position in the direction away from the boundary, and Coef is a predetermined variable.

8. The display apparatus according to claim 4, wherein the virtual light source light emission amount calculator is configured to calculate the amounts of light emission from the first virtual light source and the second virtual light source at the boundary only when an image object is displayed in at least one of the two adjacent display segments, and the pixel processor is configured to perform the first correction or the second correction at the boundary only when the image object is displayed in at least one of the two adjacent display segments.

9. The display device of claim 1, wherein the control circuit is configured to control the amount of light emission individually in the light-emitting blocks that are defined by dividing the light-emitting region based on the control data and that include the first light-emitting block and the second light-emitting block, and the number of the one or more light-emitting segments in the first light-emitting block is different from the number of the one or more light-emitting segments in the second light-emitting block.

10. A display apparatus comprising:

a light emitter having a light-emitting region that is divided into a plurality of light-emitting blocks based on control data supplied from outside, wherein each of the light-emitting blocks includes one or more light-emitting segments;

a display device having a display area that is divided into a plurality of display blocks based on the control data supplied from the outside, wherein each of the display blocks includes a plurality of display segments corresponding to the one or more respective light-emitting segments, and the display blocks correspond to the respective light-emitting blocks; and a control circuit configured to output, to the light emitter, a light emission amount control signal for controlling the amount of light emission from the one or more light-emitting segments, in accordance with image data supplied from an outside and control data supplied from the outside, wherein the control circuit is configured to control the amount of light emission individually in the light-emitting blocks that are defined by dividing the light-emitting region based on the control data, the light-emitting blocks include a first light-emitting block and a second light-emitting block, and a number of the one or more light-emitting segments in the first light-emitting block is different from a number of the one or more light-emitting segments in the second light-emitting block, wherein the control circuit includes a virtual light source light emission amount calculator configured to determine La using Expression (2) based on Expression (1):

$$A=a/2m \quad (1)$$

$$La=L(n+1)-\{L(n+1)-Ln\}\times(2\times A^3-3\times A^2+1) \quad (2)$$

where Ln is an amount of light emission from the light-emitting segment having a relatively small amount of light emission, L(n+1) is an amount of light emission from the light-emitting segment having a relatively large amount of light emission, and La is an amount of light emission from a first virtual light source or a second virtual light source that irradiates an a-th pixel counting from a side farther from the boundary and on a side of the light-emitting segment having a relatively small amount of light emission out of the pixels arranged within a range up to the m-th position in the direction away from the boundary.

11. A display apparatus comprising:

a light emitter having a light-emitting region that is divided into a plurality of light-emitting blocks, wherein each of the light-emitting blocks includes one or more light-emitting segments, the light-emitting blocks include a first light-emitting block and a second light-emitting block, and a number of the one or more light-emitting segments in the first light-emitting block is different from a number of the one or more light-emitting segments in the second light-emitting block;

a display device having a display area that is divided into a plurality of display blocks, wherein each of the display blocks includes a plurality of display segments corresponding to the one or more respective light-emitting segments, and the display blocks correspond to the respective light-emitting blocks; and a control circuit configured to control the display device and the light emitter in accordance with image data supplied from an outside, wherein a necessary luminance is a luminance to display a brightest display segment in each of the light-emitting blocks, the control circuit is configured to determine the necessary luminance for each of the light emitting blocks in accordance with the image data; and control each of the one or more light-emitting segments based on the necessary luminance in each of the light-emitting blocks, wherein the control circuit includes a virtual light source light emission amount calculator configured to determine La using Expression (2) based on Expression (1):

$$A=a/2m \quad (1)$$

$$La=L(n+1)-\{L(n+1)-Ln\}\times(2\times A^3-3\times A^2+1) \quad (2)$$

where Ln is an amount of light emission from the light-emitting segment having a relatively small amount of light emission, L(n+1) is an amount of light emission from the light-emitting segment having a relatively large amount of light emission, and La is an amount of light emission from a first virtual light source or a second virtual light source that irradiates an a-th pixel counting from a side farther from the boundary and on a side of the light-emitting segment having a relatively small amount of light emission out of the pixels arranged within a range up to the m-th position in the direction away from the boundary.

12. The display apparatus according to claim 11, wherein the control circuit includes a segment necessary luminance corrector configured to correct the luminance of the one or more light-emitting segments included in each of the light-emitting blocks to the highest luminance of each of the light-emitting blocks.

13. The display apparatus according to claim 12, wherein the segment necessary luminance corrector is configured to increase the luminance of the one or more light-emitting segments included in each of the light-emitting blocks to a value obtained by multiplying the highest luminance of each of the light-emitting blocks by a predetermined coefficient.

14. The display apparatus according to claim 11, wherein the display area includes $n_1$ pixels, the display segments each include $n_2$ pixels, $n_2$ being smaller than $n_1$, the control circuit is configured to perform a luminance distribution processing when amounts of light emission of two adjacent light-emitting segments are different from each other, and perform a correction of a gradation value of the image data in accordance with the luminance distribution of the two adjacent light emitting segments.

15. The display apparatus according to claim 14, wherein the control circuit is configured to increase a degree of correction on the output gradation value of the pixels from the boundary of the two adjacent light emitting-segments to one light-emitting segment which has higher luminance than another light emitting-segment of the two light-emitting-segments, and decrease a degree of correction on the output gradation value of the pixels from the boundary of the two adjacent light emitting-segments to one light-emitting segment which has lower luminance than another light emitting-segment of the two light-emitting-segments, in the correction.

16. The display apparatus according to claim 14, wherein the control circuit includes a virtual light source light emission amount calculator configured to determine Coef using any one of Expressions (4) to (7) based on A expressed by Expression (3), determine La by Expression (8) using the determined Coef, use Expression (4) when A<1 is satisfied, use Expression (5) when 1≤A<2 is satisfied, use Expression (6) when 2≤A<3 is satisfied, and use Expression (7) when 3≤A<4 is satisfied:

$$A=a/(2m/4) \tag{3}$$

$$\text{Coef}=0.5\times\{-1/6\times(2.0-A-2.0)\hat{}3\} \tag{4}$$

$$\text{Coef}=0.5\times[1/6\times\{3\times(2.0-A)\hat{}3-6\times(2.0-A)\hat{}2+4\}]+\{-1/6*(3.0-A-2.0)\hat{}3\} \tag{5}$$

$$\text{Coef}=0.5\times[1/6\times\{3\times(A-2.0)\hat{}3-6\times(A-2.0)\hat{}2+4\}]+[1/6\times\{3\times(3.0-A)\hat{}3-6\times(3.0-A)\hat{}2+4\}]+\{-1/6*(4.0-A-2.0)\hat{}3\} \tag{6}$$

$$\text{Coef}=0.5\times\{-1/6\times(A-2.0-2.0)\hat{}3\}+[1/6\times\{3\times(A-3.0)\hat{}3-6\times(A-3.0)\hat{}2+4\}]+[1/6\times\{3\times(4.0-A)\hat{}3-6\times(4.0-A)\hat{}2+4\}]+\{-1/6\times(5.0-A-2.0)\hat{}3\} \tag{7}$$

$$La=L(n+1)-\{L(n+1)-Ln\}\times\text{Coef} \tag{8}$$

where Ln is an amount of light emission from the light-emitting segment having a relatively small amount of light emission, L(n+1) is an amount of light emission from the light-emitting segment having a relatively large amount of light emission, La is an amount of light emission from the first virtual light source or the second virtual light source that irradiates an a-th pixel counting from a side farther from the boundary and on a side of the light-emitting segment having a relatively small amount of light emission out of the pixels arranged within a range up to the m-th position in the direction away from the boundary, and Coef is a predetermined variable.

17. The display apparatus according to claim 14, wherein the control circuit includes a virtual light source light emission amount calculator configured to calculate the amounts of light emission from a first virtual light source and a second virtual light source at the boundary only when an image object is displayed in at least one of the two adjacent display segments, and the pixel processor is configured to perform a first correction or a second correction at the boundary only when the image object is displayed in at least one of the two adjacent display segments.

* * * * *